US008248328B1

(12) United States Patent
Wedding et al.

(10) Patent No.: US 8,248,328 B1
(45) **Date of Patent: *Aug. 21, 2012**

(54) PLASMA-SHELL PDP WITH ARTIFACT REDUCTION

(75) Inventors: Carol Ann Wedding, Toledo, OH (US); Jeffrey W. Guy, Toledo, OH (US); Daniel K. Wedding, Toledo, OH (US); Oliver M. Strbik, III, Holland, OH (US)

(73) Assignee: Imaging Systems Technology, Toledo, OH (US)

( * ) Notice: Subject to any disclaimer, the term of this patent is extended or adjusted under 35 U.S.C. 154(b) by 962 days.

This patent is subject to a terminal disclaimer.

(21) Appl. No.: 12/115,636

(22) Filed: May 6, 2008

Related U.S. Application Data

(60) Provisional application No. 60/917,151, filed on May 10, 2007.

(51) Int. Cl.
*G09G 3/28* (2006.01)

(52) U.S. Cl. ..... 345/63; 345/60

(58) Field of Classification Search ..... 345/63
See application file for complete search history.

(56) References Cited

U.S. PATENT DOCUMENTS

| | | | |
|---|---|---|---|
| 3,499,167 | A | 3/1970 | Baker et al. |
| 3,559,190 | A | 1/1971 | Bitzer et al. |
| 3,603,836 | A | 9/1971 | Grier |
| 3,801,861 | A | 4/1974 | Petty et al. |
| 3,803,449 | A | 4/1974 | Schmersal |
| 4,063,131 | A | 12/1977 | Miller |
| 4,087,805 | A | 5/1978 | Miller |
| 4,087,807 | A | 5/1978 | Miavecz |
| 4,126,807 | A | 11/1978 | Wedding et al. |
| 4,126,809 | A | 11/1978 | Wedding et al. |
| 4,233,623 | A | 11/1980 | Pavliscak |
| 4,320,418 | A | 3/1982 | Pavliscak |
| 4,494,038 | A | 1/1985 | Wedding et al. |
| 4,611,203 | A | 9/1986 | Criscimagna et al. |
| 4,680,645 | A | 7/1987 | Dispoto et al. |
| 4,683,470 | A | 7/1987 | Criscimagna et al. |
| 4,890,167 | A | 12/1989 | Nakazato et al. |
| 5,012,163 | A | 4/1991 | Alcorn et al. |
| 5,045,952 | A | 9/1991 | Eschbach |
| 5,386,304 | A | 1/1995 | Suzuki |

(Continued)

FOREIGN PATENT DOCUMENTS

| | | | |
|---|---|---|---|
| EP | 0720139 | A1 | 7/1997 |

(Continued)

OTHER PUBLICATIONS

Floyd et al., An Adaptive Algorithm for Spatial Grey Scale, SID 75 Digest, 1975, pp. 36 to 37.

(Continued)

*Primary Examiner* — Richard Hjerpe
*Assistant Examiner* — Towfiq Elahi
(74) *Attorney, Agent, or Firm* — Donald K. Wedding

(57) ABSTRACT

Visual artifact reduction methods for a display including gamma corrections, error diffusion and/or dithering. The invention is described with reference to an AC gas discharge display (PDP) comprising a multiplicity of plasma-shells, but may be practiced with other display technologies. The methods of this invention are disclosed for use with a number of PDP structures and PDP electronic addressing architectures including ADS, AWD, SAS, and ALIS.

20 Claims, 48 Drawing Sheets

U.S. PATENT DOCUMENTS

| | | | | |
|---|---|---|---|---|
| 5,410,219 | A | 4/1995 | Takei et al. | |
| 5,434,672 | A | 7/1995 | McGuire | |
| 5,436,634 | A | 7/1995 | Kanazawa | |
| 5,446,344 | A | 8/1995 | Kanazawa | |
| 5,541,618 | A | 7/1996 | Shinoda | |
| 5,546,101 | A | 8/1996 | Sugawara | |
| 5,606,631 | A | 2/1997 | Weiss et al. | |
| 5,623,281 | A | 4/1997 | Markandey et al. | |
| 5,661,500 | A | 8/1997 | Shinoda et al. | |
| 5,674,553 | A | 10/1997 | Shinoda et al. | |
| 5,724,054 | A | 3/1998 | Shinoda | |
| 5,736,815 | A | 4/1998 | Amemiya | |
| 5,745,086 | A | 4/1998 | Weber | |
| 5,793,158 | A | 8/1998 | Wedding, Sr. | |
| 5,828,356 | A | 10/1998 | Stoller | |
| 5,903,245 | A | 5/1999 | Shimizu et al. | |
| 5,914,563 | A | 6/1999 | Lee et al. | |
| 6,008,793 | A | 12/1999 | Shigeta | |
| 6,018,329 | A | 1/2000 | Kida et al. | |
| 6,025,818 | A | 2/2000 | Okano | |
| 6,034,657 | A | 3/2000 | Tokunaga et al. | |
| 6,040,876 | A | 3/2000 | Pettitt | |
| 6,052,101 | A | 4/2000 | Moon | |
| 6,088,009 | A | 7/2000 | Moon | |
| 6,097,358 | A | 8/2000 | Hirakawa et al. | |
| 6,097,368 | A | 8/2000 | Zhu et al. | |
| 6,198,476 | B1 | 3/2001 | Hong et al. | |
| 6,208,081 | B1 | 3/2001 | Eo et al. | |
| 6,215,468 | B1 | 4/2001 | Van Mourik | |
| 6,215,913 | B1 | 4/2001 | Clatanoff et al. | |
| 6,252,574 | B1 | 6/2001 | Hosoi et al. | |
| 6,262,699 | B1 | 7/2001 | Suzuki et al. | |
| 6,288,693 | B1 | 9/2001 | Song et al. | |
| 6,340,960 | B1 | 1/2002 | Song et al. | |
| 6,342,898 | B1 | 1/2002 | Pettitt | |
| 6,344,841 | B1 | 2/2002 | Moon | |
| 6,362,800 | B1 | 3/2002 | Moon | |
| 6,384,802 | B1 | 5/2002 | Moon | |
| 6,384,803 | B2 | 5/2002 | Kasahara et al. | |
| 6,388,645 | B2 | 5/2002 | Kasahara et al. | |
| 6,407,509 | B1 * | 6/2002 | Ikeda et al. | 315/169.4 |
| 6,433,763 | B1 | 8/2002 | Lim et al. | |
| 6,466,187 | B1 | 10/2002 | Moon | |
| 6,473,464 | B1 | 10/2002 | Weitbruch et al. | |
| 6,476,781 | B1 | 11/2002 | Suzuki et al. | |
| 6,476,875 | B2 | 11/2002 | Correa et al. | |
| 6,492,776 | B2 | 12/2002 | Rutherford | |
| 6,495,968 | B2 | 12/2002 | Tokunaga | |
| 6,593,903 | B2 | 7/2003 | Nakamura et al. | |
| 6,646,625 | B1 | 11/2003 | Shigeta et al. | |
| 6,654,028 | B1 | 11/2003 | Yamakawa | |
| 6,661,469 | B1 | 12/2003 | Kawabata et al. | |
| 6,661,470 | B1 | 12/2003 | Kawakami et al. | |
| 6,707,943 | B2 | 3/2004 | Gicquel et al. | |
| 6,771,832 | B1 | 8/2004 | Naito et al. | |
| 6,774,873 | B2 | 8/2004 | Hsu et al. | |
| 6,778,182 | B2 | 8/2004 | Yamakawa | |
| 6,836,263 | B2 | 12/2004 | Naka et al. | |
| 6,864,631 | B1 * | 3/2005 | Wedding | 313/587 |
| 6,897,836 | B2 | 5/2005 | Tokunaga | |
| 6,900,780 | B1 * | 5/2005 | Amano | 345/60 |
| 6,956,583 | B2 | 10/2005 | Lee | |
| 6,985,125 | B2 * | 1/2006 | Velayudhan et al. | 345/60 |
| 6,985,126 | B2 | 1/2006 | Hoppenbrouwers et al. | |
| 7,025,252 | B2 | 4/2006 | Kim | |
| 7,071,954 | B2 | 7/2006 | Takahashi | |
| 7,075,243 | B2 | 7/2006 | Park | |
| 7,075,504 | B2 | 7/2006 | Tokunaga et al. | |
| 7,075,560 | B2 | 7/2006 | Ohe et al. | |
| 7,088,313 | B2 | 8/2006 | Kang | |
| 7,088,316 | B2 | 8/2006 | Kao et al. | |
| 7,102,696 | B2 | 9/2006 | Kao et al. | |
| 1,122,961 | A1 | 10/2006 | Wedding | |
| 7,126,563 | B2 | 10/2006 | Lin et al. | |
| 7,157,854 | B1 | 1/2007 | Wedding | |
| 7,176,628 | B1 | 2/2007 | Wedding | |
| 7,180,480 | B2 | 2/2007 | Lee et al. | |
| 7,187,348 | B2 | 3/2007 | Iwami et al. | |
| 7,236,147 | B2 | 6/2007 | Morita et al. | |
| 7,247,989 | B1 | 7/2007 | Wedding | |
| 7,307,602 | B1 | 12/2007 | Wedding et al. | |
| 7,339,554 | B2 | 3/2008 | Hsu et al. | |
| 7,339,706 | B2 | 3/2008 | Ohta | |
| 7,355,570 | B2 | 4/2008 | Choi | |
| 7,365,711 | B2 | 4/2008 | Kim | |
| 7,375,342 | B1 | 5/2008 | Wedding | |
| 7,397,445 | B2 | 7/2008 | Baek | |
| 7,408,530 | B2 | 8/2008 | Yang | |
| 7,414,598 | B2 | 8/2008 | Lee | |
| 7,420,571 | B2 | 9/2008 | Lee et al. | |
| 7,420,576 | B2 | 9/2008 | Takeuchi et al. | |
| 2002/0135548 | A1 | 9/2002 | Moon | |
| 2002/0175906 | A1 | 11/2002 | Moon | |
| 2004/0070590 | A1 | 4/2004 | Lee et al. | |
| 2004/0109088 | A1 | 6/2004 | Lee et al. | |
| 2004/0263538 | A1 | 12/2004 | Ohta et al. | |
| 2005/0225562 | A1 | 10/2005 | Higgins et al. | |
| 2005/0276502 | A1 | 12/2005 | Elliott et al. | |
| 2006/0001606 | A1 | 1/2006 | Yim | |
| 2006/0022906 | A1 | 2/2006 | Kamiyamaguchi et al. | |
| 2006/0125718 | A1 | 6/2006 | Weitbruch et al. | |
| 2007/0065008 | A1 | 3/2007 | Kao et al. | |
| 2007/0230813 | A1 | 10/2007 | Yamamoto et al. | |
| 2008/0018561 | A1 | 1/2008 | Song et al. | |

FOREIGN PATENT DOCUMENTS

| | | |
|---|---|---|
| EP | 1 020 838 A1 | 7/2000 |
| EP | 1020838 A1 | 7/2000 |
| EP | 1022714 A1 | 7/2000 |
| WO | WO 00/30065 | 5/2000 |

OTHER PUBLICATIONS

Shigeta et al., Improvement of Moving-Video Image Quality on PDPs by Reducing the Dynamic False Contour, SID 98 Digest, 1998, pp. 287 to 290.

Tokunaga et al., High-Contrast, Low Energy Address and Reduction of False Contour Sequence "Clear", IDW '99, 1999, pp. 787 to 790.

Choi et al., Quantitative Measure of Dynamic False Contours on Plasma Display, IDW '99, 1999, pp. 783 to 786.

Son, Luminance and Picture-Quality Improvement of DCPDPs and ACPDPs by Irregular Addressing for Gray-Scale Control, SID 97Digest, 1997, pp. 607 to 610.

Yamaguchi et al., An Improvement of PDP Picture Quality by Using a Modified-Binary-Coded Scheme with a 3D Scattering of Motional Artifacts, IEICE Transactions on Electronics vol. E80-C No. 8, Aug. 1997, pp. 1079 to 1085.

Yoshitani et al., Reduction of Blur and Color Distortion of PDP Motional Images Originated from Slow Phosphor Response by Rearrangement of Active Sub-Fields, IRDC 03, 2003, pp. 125 to 128.

J. Ryeom et al., "High-Luminance and High-Contrast HDTV PDP with Overlapping Driving Scheme", pp. 743-746, *Proceedings of the Sixth International Display Workshops*, IDW 99, Dec. 1-3, 1999, Sendai, Japan.

Kanazawa et al., *1999Digest of the Society for Information Display*, pp. 154-157.

Tokunaga et al., "Development of New Driving Method for AC-PDPs", *Pioneer Proceedings of the Sixth International Display Workshops*, IDW 99, pp. 787-790, Dec. 1-3, 1999, Sendai, Japan.

* cited by examiner

Section A-A View

PLASMA-SHELL PDP WITH ARTIFACT REDUCTION

RELATED APPLICATION

This application claims priority under 35 U.S.C. 119(e) from U.S. Provisional Application Ser. No. 60/917,151, filed May 10, 2007.

FIELD OF THE INVENTION

The invention relates to digital signal processing of a video image for improved picture quality on a display. This invention particularly relates to the reduction of static and dynamic visual artifacts and anomalies such as false contour in a plasma display panel comprising a multiplicity of plasma-shells.

Static false contour is typically defined as the visual artifact that occurs on a still frame when pixels in close proximity have similar values expressed by opposite or very different subfield weighting. Dynamic false contour is typically defined as the visual artifact that occurs in a moving image when a pixel changes from its current value to a close value expressed by a subfield weighting that is opposite or significantly different from the original value. Dynamic false contour is a motion artifact. This invention uses artifact reduction that includes gamma correction, error diffusion, and/or dithering.

The hollow plasma-shell is filled with an ionizable gas and used to define and contain a pixel or sub-pixel in a gas discharge plasma display panel (PDP) device. Combinations of plasma-shells in pairs may be used in the PDP such as plasma-discs and plasma-domes, plasma-discs and plasma-spheres, plasma-domes and plasma-spheres. Also all three may be used in various pixel combinations.

This invention also relates to the use a PDP made up of one or more plasma-shells in combination with one or more elongated hollow plasma-tubes filled with ionizable gas. The plasma-tube is filled with ionizable gas and used to define and contain multiple pixels or sub-pixels in a gas discharge plasma display device.

This invention is described herein with reference to an AC gas discharge plasma display panel (PDP) comprised of plasma-shells. However, this invention may also be practiced with other display technologies including other flat panel displays and projection displays. Both passive and matrix displays may be used including passive matrix and active matrix displays.

PDP Background

PDP Structures and Operation

This invention is described with reference to AC gas discharge memory displays. In an AC gas discharge plasma display panel (PDP), a single addressable picture element is a cell, sometimes referred to as a pixel. In a multi-color PDP, two or more cells or pixels may be addressed as sub-cells or sub-pixels to form a single cell or pixel. As used herein cell or pixel means sub-cell or sub-pixel. The cell or pixel element is defined by two or more electrodes positioned in such a way so as to provide a voltage potential across an electrode gap containing an ionizable gas. When sufficient voltage is applied across the gap between the electrodes, the gas ionizes to produce light. In an AC gas discharge plasma display, the electrodes at a cell site are coated with a dielectric for charge storage and memory. The electrodes are generally grouped in a matrix configuration to allow for selective addressing of each cell or pixel.

To form a display image, several types of voltage pulses may be applied across a plasma display cell gap. These pulses include a write pulse, which is the voltage potential sufficient to ionize the gas at the pixel site. A write pulse is selectively applied across selected cell sites. The ionized gas will produce visible light, UV or IR light, which excites a phosphor to glow. Sustain pulses are a series of pulses that produce a voltage potential across pixels to maintain ionization of cells previously ionized. An erase pulse is used to selectively extinguish ionized pixels. The voltage at which a pixel will ionize, sustain, and erase depends on a number of factors including the distance between the electrodes, the composition of the ionizing gas, and the pressure of the ionizing gas. Also of importance is the dielectric composition and thickness. To maintain uniform electrical characteristics throughout the display it is desired that the various physical parameters adhere to required tolerances. Maintaining the required tolerance depends on cell geometry, fabrication methods, and the materials used. The prior art discloses a variety of plasma display structures, a variety of methods of construction, and materials.

Examples of open cell gas discharge (plasma) devices include both monochrome (single color) AC plasma displays and multi-color (two or more colors) AC plasma displays. Also monochrome and multi-color DC plasma displays are contemplated. Examples of monochrome AC gas discharge (plasma) displays are well known in the prior art and include those disclosed in U.S. Pat. No. 3,559,190 (Bitzer et al.), U.S. Pat. No. 3,499,167 (Baker et al.), U.S. Pat. No. 3,860,846 (Mayer) U.S. Pat. No. 3,964,050 (Mayer), U.S. Pat. No. 4,080,597 (Mayer), U.S. Pat. No. 3,646,384 (Lay) and U.S. Pat. No. 4,126,807 (Wedding), all incorporated herein by reference. Examples of multi-color AC plasma displays are well known in the prior art and include those disclosed in U.S. Pat. No. 4,233,623 ( Pavliscak), U.S. Pat. No. 4,320,418 (Pavliscak), U.S. Pat. No. 4,827,186 (Knauer, et al.), U.S. Pat. No. 5,661,500 (Shinoda et al.), U.S. Pat. No. 5,674,553 (Shinoda, et al.), U.S. Pat. No. 5,107,182 (Sano et al.), U.S. Pat. No. 5,182,489 (Sano), U.S. Pat. No. 5,075,597 (Salavin et al.), U.S. Pat. No. 5,742,122 (Amemiya, et al.), U.S. Pat. No. 5,640,068 (Amemiya et al.), U.S. Pat. No. 5,736,815 (Amemiya), U.S. Pat. No. 5,541,479 (Nagakubi), U.S. Pat. No. 5,745,086 (Weber) and U.S. Pat. No. 5,793,158 (Wedding), all incorporated herein by reference.

This invention may be practiced in a DC gas discharge (plasma) display which is well known in the prior art, for example as disclosed in U.S. Pat. No. 3,886,390 (Maloney et al.), U.S. Pat. No. 3,886,404 (Kurahashi et al.), U.S. Pat. No. 4,035,689 (Ogle et al.) and U.S. Pat. No. 4,532,505 (Holz et al.), all incorporated herein by reference.

This invention will be described with reference to an AC plasma display. The PDP industry has used two different AC plasma display panel (PDP) structures, the two-electrode columnar discharge structure, and the three-electrode surface discharge structure. Columnar discharge is also called co-planar discharge.

Columnar PDP

The two-electrode columnar or co-planar discharge plasma display structure is disclosed in U.S. Pat. No. 3,499,167 (Baker et al.) and U.S. Pat. No. 3,559,190 (Bitzer et al.) The two-electrode columnar discharge structure is also referred to as opposing electrode discharge, twin substrate discharge, or co-planar discharge. In the two-electrode columnar discharge AC plasma display structure, the sustaining voltage is applied between an electrode on a rear or bottom substrate and an opposite electrode on the front or top viewing substrate. The gas discharge takes place between the two opposing electrodes in between the top viewing substrate and the bottom substrate.

The columnar discharge PDP structure has been widely used in monochrome AC plasma displays that emit orange or red light from a neon gas discharge. Phosphors may be used in a monochrome structure to obtain a color other than neon orange.

In a multi-color columnar discharge PDP structure as disclosed in U.S. Pat. No. 5,793,158 (Wedding), phosphor stripes, or layers are deposited along the barrier walls and/or on the bottom substrate adjacent to and extending in the same direction as the bottom electrode. The discharge between the two opposite electrodes generates electrons and ions that bombard and deteriorate the phosphor thereby shortening the life of the phosphor and the PDP. In a two electrode columnar discharge PDP as disclosed by Wedding '158, each light emitting pixel is defined by a gas discharge between a bottom or rear electrode x and a top or front opposite electrode y, each cross-over of the two opposing arrays of bottom electrodes x and top electrodes y defining a pixel or cell.

Surface Discharge PDP

The three-electrode multi-color surface discharge AC plasma display panel structure is widely disclosed in the prior art including U.S. Patent Nos. 5,661,500 (Shinoda et al.), 5,674,553 (Shinoda et al.), 5,745,086 (Weber), and 5,736,815 (Amemiya), all incorporated herein by reference. In a surface discharge PDP, each light emitting pixel or cell is defined by the gas discharge between two electrodes on the top substrate. In multi-color RGB display, the pixels may be called sub-pixels or sub-cells. Photons from the discharge of an ionizable gas at each pixel or sub-pixel excite a photoluminescent phosphor that emits red, blue, or green light. In a three-electrode surface discharge AC plasma display, a sustaining voltage is applied between a pair of adjacent parallel electrodes that are on the front or top viewing substrate. These parallel electrodes are called the bulk sustain electrode and the row scan electrode. The row scan electrode is also called a row sustain electrode because of its dual functions of address and sustain. The opposing electrode on the rear or bottom substrate is a colunm data electrode and is used to periodically address a row scan electrode on the top substrate. The sustaining voltage is applied to the bulk sustain and row scan electrodes on the top substrate. The gas discharge takes place between the row scan and bulk sustain electrodes on the top viewing substrate.

In a three-electrode surface discharge AC plasma display panel, the sustaining voltage and resulting gas discharge occurs between the electrode pairs on the top or front viewing substrate above and remote from the phosphor on the bottom substrate. This separation of the discharge from the phosphor minimizes electron bombardment and deterioration of the phosphor deposited on the walls of the barriers or in the grooves (or channels) on the bottom substrate adjacent to and/or over the third (data) electrode. Because the phosphor is spaced from the discharge between the two electrodes on the top substrate, the phosphor is subject to less electron bombardment than in a colunmar discharge PDP.

Single Substrate PDP

There may be used a PDP structure having a so-called single substrate or monolithic plasma display panel structure having one substrate with or without a top or front viewing envelope or dome. Single-substrate or monolithic plasma display panel structures are well known in the prior art and are disclosed by U.S. Pat. Nos. 3,646,384 (Lay), 3,652,891 (Janning), 3,666,981 (Lay), 3,811,061 (Nakayama et al.), 3,860,846 (Mayer), 3,885,195 (Amano), 3,935,494 (Dick et al.), 3,964,050 (Mayer), 4,106,009 (Dick), 4,164,678 (Biazzo et al.), and 4,638,218 (Shinoda), all incorporated herein by reference.

Related Prior Art Spheres, Beads, Ampoules, Capsules

The construction of a PDP out of gas-filled hollow microspheres is known in the prior art. Such microspheres are referred to as spheres, beads, ampoules, capsules, bubbles, shells, and so forth. The following prior art relates to the use of microspheres in a PDP and are incorporated herein by reference. U.S. Pat. No. 2,644,113 (Etzkorn) discloses ampoules or hollow glass beads containing luminescent gases that emit a colored light. In one embodiment, the ampoules are used to radiate ultraviolet light onto a phosphor external to the ampoule itself. U.S. Pat. No. 3,848,248 (Maclntyre) discloses the embedding of gas-filled beads in a transparent dielectric. The beads are filled with a gas using a capillary. The external shell of the beads may contain phosphor. U.S. Pat. No. 3,998,618 (Kreick et al.) discloses the manufacture of gas-filled beads by the cutting of tubing. The tubing is cut into ampoules and heated to form shells. The gas is a rare gas mixture, 95% neon, and 5% argon at a pressure of 300 TOM U.S. Pat. No. 4,035,690 (Roeber) discloses a plasma panel display with a plasma forming gas encapsulated in clear glass shells. Roeber used commercially available glass shells containing gases such as air, $SO_2$ or $CO_2$ at pressures of 0.2 to 0.3 atmosphere. Roeber discloses the removal of these residual gases by heating the glass shells at an elevated temperature to drive out the gases through the heated walls of the glass shell. Roeber obtains different colors from the glass shells by filling each shell with a gas mixture, which emits a color upon discharge, and/or by using a glass shell made from colored glass. U.S. Pat. No. 4,963,792 (Parker) discloses a gas discharge chamber including a transparent dome portion. U.S. Pat. No. 5,326,298 (Hotomi) discloses a light emitter for giving plasma light emission. The light emitter comprises a resin including fine bubbles in which a gas is trapped. The gas is selected from rare gases, hydrocarbons, and nitrogen. Japanese Patent 11238469A, published Aug. 31, 1999, by Tsuruoka Yoshiaki of Dainippon discloses a plasma display panel containing a gas capsule. The gas capsule is provided with a rupturable part, which ruptures when it absorbs a laser beam. U.S. Pat. No. 6,545,422 (George et al.) discloses a light-emitting panel with a plurality of sockets with spherical or other shape micro-components in each socket sandwiched between two substrates. The micro-component includes a shell filled with a plasma-forming gas or other material. The light-emitting panel may be a plasma display, electroluminescent display, or other display device.

Other patents by George et al. and various joint inventors include U.S. Pat. Nos. 6,570,335 (George et al.), 6,612,889 (Green et al.), 6,620,012 (Johnson et al.), 6,646,388 (George et al.), 6,762,566 (George et al.), 6,764,367 (Green et al.), 6,791,264 (Green et al.), 6,796,867 (George et al.), 6,801,001 (Drobot et al.), 6,822,626 (George et al.), 6,902,456 (George et al.), 6,935,913 (Wyeth et al.), 6,975,068 (Green et al.), 7,005,793 (George et al.), 7,025,648 (Green et al.), 7,125,305 (Green et al.), 7,137,857 (George et al.), and 7,140,941 (Green et al.), all incorporated herein by reference. U.S. Patent Applications filed by George et al. and the various joint inventors of George et al. include U.S. Patent Application PUblication Nos. 2004/0063373 (Johnson et al.), U.S. 2005/0095944 (George et al.), and U.S. 2006/0097620 (George et al.), all incorporated herein by reference. Also incorporated herein is U.S. Pat. No. 6,864,631 (Wedding), which discloses a PDP, comprised of microspheres filled with ionizable gas.

Related Prior Art Methods of Producing Microspheres

In the practice of this invention, any suitable method or process may be used to produce the plasma-shells including plasma-spheres, plasma-discs, and plasma-domes. Numerous methods and processes to produce hollow shells or microspheres are well known in the prior art. Microspheres have been formed from glass, ceramic, metal, plastic, and other inorganic and organic materials. Varying methods and processes for producing shells and microspheres have been disclosed and practiced in the prior art. Some of the prior art methods for producing plasma-shells are disclosed hereafter. Some methods used to produce hollow glass microspheres incorporate a so-called blowing gas into the lattice of a glass while in frit form. The frit is heated and glass bubbles are formed by the in-permeation of the blowing gas. Microspheres formed by this method have diameters ranging from about 5 μm to approximately 5,000 μm. This method produces shells with a residual blowing gas enclosed in the shell. The blowing gases typically include $SO_2$, $CO_2$, and $H_2O$. These residual gases will quench a plasma discharge. Because of these residual gases, microspheres produced with this method are not acceptable for producing plasma-spheres for use in a PDP. Methods of manufacturing glass frit for forming hollow microspheres are disclosed by U.S. Pat. Nos. 4,017,290 (Budrick et al.) and 4,021,253 (Budrick et al.). Budrick et al. 290 discloses a process whereby occluded material gasifies to form the hollow microsphere.

Hollow microspheres are disclosed in U.S. Pat. No. 5,500,287 (Henderson), and U.S. Pat. No. 5,501,871 (Henderson). According to Henderson 287, the hollow microspheres are formed by dissolving a permeant gas (or gases) into glass frit particles. The gas permeated frit particles are then heated at a high temperature sufficient to blow the frit particles into hollow microspheres containing the permeant gases. The gases may be subsequently out-permeated and evacuated from the hollow shell as described in step D in column 3 of Henderson 287. Henderson 287 and 871 are limited to gases of small molecular size. Some gases such as xenon, argon, and krypton used in plasma displays may be too large to be permeated through the frit material or wall of the microsphere. Helium, which has a small molecular size, may leak through the microsphere wall or shell. U.S. Pat. No. 4,257,798 (Hendricks et al.) discloses a method for manufacturing small hollow glass spheres filled with a gas introduced during the formation of the spheres, and is incorporated herein by reference. The gases disclosed include argon, krypton, xenon, bromine, DT, hydrogen, deuterium, helium, hydrogen, neon, and carbon dioxide. Other Hendricks patents for the manufacture of glass spheres include U.S. Pat. Nos. 4,133,854 and 4,186,637, both incorporated herein by reference. Hendricks 798 is also incorporated herein by reference. Microspheres are also produced as disclosed in U.S. Pat. No. 4,415,512 (Torobin), incorporated herein by reference. This method by Torobin comprises forming a film of molten glass across a blowing nozzle and applying a blowing gas at a positive pressure on the inner surface of the film to blow the film and form an elongated cylinder shaped liquid film of molten glass. An inert entraining fluid is directed over and around the blowing nozzle at an angle to the axis of the blowing nozzle so that the entraining fluid dynamically induces a pulsating or fluctuating pressure at the opposite side of the blowing nozzle in the wake of the blowing nozzle. The continued movement of the entraining fluid produces asymmetric fluid drag forces on a molten glass cylinder, which close and detach the elongated cylinder from the coaxial blowing nozzle. Surface tension forces acting on the detached cylinder form the latter into a spherical shape, which is rapidly cooled and solidified by cooling means to form a glass microsphere. In one embodiment of the above method for producing the microspheres, the ambient pressure external to the blowing nozzle is maintained at a super atmospheric pressure. The ambient pressure external to the blowing nozzle is such that it substantially balances, but is slightly less than the blowing gas pressure. Such a method is disclosed by U.S. Pat. No. 4,303,432 (Torobin) and WO 8000438A1 (Torobin), both incorporated herein by reference. The microspheres may also be produced using a centrifuge apparatus and method as disclosed by U.S. Pat. No. 4,303,433 (Torobin) and WO8000695A1 (Torobin), both incorporated herein by reference. Other methods for forming microspheres of glass, ceramic, metal, plastic, and other materials are disclosed in other Torobin patents including U.S. Pat. Nos. 5,397,759; 5,225,123; 5,212,143; 4,793,980; 4,777,154; 4,743,545; 4,671,909; 4,637,990; 4,582,534; 4,568,389; 4,548,196; 4,525,314; 4,363,646; 4,303,736; 4,303,732; 4,303,731; 4,303,603; 4,303,431; 4,303,730; 4,303,729; and 4,303,061, all incorporated herein by reference. U.S. Pat. No. 3,607,169 (Coxe) discloses an extrusion method in which a gas is blown into molten glass and individual shells are formed. As the shells leave the chamber, they cool and some of the gas is trapped inside. Because the shells cool and drop at the same time, the shell shells do not form uniformly. It is also difficult to control the amount and composition of gas that remains in the shell. U.S. Pat. No. 4,349,456 (Sowman), incorporated herein by reference, discloses a process for making ceramic metal oxide microspheres by blowing a slurry of ceramic and highly volatile organic fluid through a coaxial nozzle. As the liquid dehydrates, gelled microcapsules are formed. These microcapsules are recovered by filtration, dried, and fired to convert them into microspheres. Prior to firing, the microcapsules are sufficiently porous that, if placed in a vacuum during the firing process, the gases can be removed and the resulting microspheres will generally be impermeable to ambient gases. The shells formed with this method may be easily filled with a variety of gases and pressurized from near vacuums to above atmosphere. This is a suitable method for producing microspheres. However, shell uniformity may be difficult to control. U.S. Patent Application 2002/0004111 (Matsubara et al.), incorporated herein by reference discloses a method of preparing hollow glass microspheres by adding a combustible liquid (kerosene) to a material containing a foaming agent.

Methods for forming microspheres are also disclosed in U.S. Pat. No. 3,848,248 (Maclntyre), U.S. 3,998,618 (Kreick et al.), and U.S. Pat. No. 4,035,690 (Roeber), discussed above and incorporated herein by reference. Methods of manufacturing hollow microspheres are disclosed in U.S. Pat. Nos. 3,794,503 (Netting), 3,796,777 (Netting), 3,888,957 (Netting), and 4,340,642 (Netting et al.), all incorporated herein by reference. Other prior art methods for forming microspheres are disclosed in the prior art including U.S. Pat. Nos. 3,528,809 (Farnand et al.), 3,957,194 (Farnand et al.), 4,025,689 (Kobayashi et al.), 4,211,738 (Genes), 4,307,051 (Sargeant et al.), 4,569,821 (Duperray et al.) 4,775,598 (Jaeckel), and 4,917,857 (Jaeckel et al.), all of which are incorporated herein by reference. These references disclose a number of methods which comprise an organic core such as naphthalene or a polymeric core such as foamed polystyrene which is coated with an inorganic material such as aluminum oxide, magnesium, refractory, carbon powder, and the like. The core is removed such as by pyrolysis, sublimation, or decomposition and the inorganic coating sintered at an elevated temperature to form a sphere or microsphere. Farnand et al. 809 discloses the production of hollow metal spheres by coating a core material such as naphthalene or anthracene with metal flakes such as aluminum or magnesium. The organic core is sublimed at room temperature over 24 to 48 hours. The aluminum or magnesium is then heated to an elevated temperature in oxygen to form aluminum or magnesium oxide. The core may also be coated with a metal oxide such as aluminum oxide and reduced to metal. The resulting hollow spheres are used for thermal insulation, plastic filler, and bulking of liquids such as hydrocarbons. Farnand 194 discloses a similar process comprising polymers dissolved in naphthalene including polyethylene and polystyrene. The core is sublimed or evaporated to form hollow spheres or microballoons. Kobayashi et al. 689 discloses the coating of a core of polystyrene with carbon powder. The core is heated and decomposed and the carbon powder heated in argon at 3000° C. to obtain hollow porous graphitized spheres. Genes 738 discloses the making of lightweight aggregate using a nucleus of expanded polystyrene pellet with outer layers of sand and cement. Sargeant et al. 051 discloses the making of light weight-refractories by wet spraying core particles of polystyrene with an aqueous refractory coating such as clay with alumina, magnesia, and/or other oxides. The core particles are subject to a tumbling action during the wet spraying and fired at 1730° C. to form porous refractory. Duperray et al. 821 discloses the making of a porous metal body by suspending metal powder in an organic foam which is heated to pyrolyze the organic and sinter the metal. Jaeckel 598 and Jaeckel et al. 857 disclose the coating of a polymer core particle such as foamed polystyrene with metals or inorganic materials followed by pyrolysis on the polymer and sintering of the inorganic materials to form the sphere. Both disclose the making of metal spheres such as copper or nickel spheres which may be coated with an oxide such as aluminum oxide. Jaeckel et al. 857 further discloses a fluid bed process to coat the core.

Related Prior Art Tubes

The construction of a PDP out of gas-filled hollow tubes is know in the prior art. The following prior art references relate to the use of tubes in a PDP and are incorporated herein by reference.

U.S. Pat. No. 3,602,754 (Pfaender et al.) discloses a multiple discharge gas display panel in which filamentary or capillary size glass tubes are assembled and formed as a monolayer to form a gas discharge panel. U.S. Pat. Nos. 3,654,680 (Bode et al.), 3,927,342 (Bode et al.) and 4,038,577 (Bode et al.) disclose a gas discharge display in which filamentary or capillary size gas tubes are assembled to form a gas discharge panel. U.S. Pat. No. 3,969,718 (Strom) discloses a plasma display system utilizing tubes arranged in a side-by-side, parallel fashion. U.S. Pat. No. 3,990,068 (Mayer et al.) discloses a capillary tube plasma display with a plurality of capillary tubes arranged parallel in a close pattern. U.S. Pat. No. 4,027,188 (Bergman) discloses a tubular plasma display consisting of parallel glass capillary tubes sealed in a plenum and attached to a rigid substrate. U.S. Pat. No. 5,984,747 (Bhagavatula et al.) discloses rib structures for containing plasma in electronic displays are formed by drawing glass performs into fiber-like rib components. The rib components are then assembled to form rib/channel structures suitable for flat panel displays. U.S. Patent Application 2001/0028216A1 (Tokai et al.) discloses a group of elongated illuminators in a gas discharge device. U.S. Pat. No. 6,255,777 (Kim et al.) and U.S. Patent Application 2002/0017863 (Kim et al.), of Plasmion disclose a capillary electrode discharge PDP device and a method of fabrication. U.S. Pat. Nos. 6,633,117 (Shinoda et al.), 6,650,055 (Ishimoto et al.), and 6,677,704 (Ishimoto et al.), disclose a PDP with elongated display tubes, all incorporated herein by reference. European Patent 1,288,993 (Ishimoto et al.) also discloses a PDP with elongated display tubes and is incorporated herein by reference. U.S. Pat. Nos. 6,914,382 (Ishimoto et al.), 6,893,677 (Yamada et al.), 6,857,923 (Yamada et al.), 6,841,929 (Ishimoto et al.), 6,836,064 (Yamada et al.), 6,836,063 (Ishimoto et al.), 6,794,812 (Yamada et al.), 6,677,704 (Ishimoto et al.), 6,650,055 (Ishimoto et al.), 6,633,117 (Shinoda et al.), 6,930,442 (Awamoto et al.), 6,932,664 (Yamada et al.), 6,969,292 (Tokai et al.), 7,049,748 (Tokai et al.), and 7,083,681 (Yamada et al.), disclose PDP structures with elongated display tubes and are incorporated herein by reference. U.S. Patent Application Nos. 2004/0033319 (Yamada et al.) and 2003/0182967 (Tokai et al.) disclose PDP structures with elongated display tubes and are incorporated herein by reference.

As used herein elongated tube is intended to include capillary, filament, filamentary, illuminator, hollow rods, or other such terms. It includes an elongated enclosed gas-filled structure having a length dimension that is greater than its cross-sectional width dimension. The width of the tube is typically the viewing direction of the display. Also as used herein, an elongated plasma-tube has multiple gas discharge pixels of 100 or more, typically 500 to 1000 or more, whereas a plasma-shell typically has only one gas discharge pixel. In some special embodiments, the plasma-shell may have more than one pixel, i.e., 2, 3, or 4 pixels up to 10 pixels. The U.S. Patents issued to George et al. and listed below as related microsphere prior art also disclose elongated tubes and are incorporated herein by reference.

Artifact Reduction

As part of each display cell or pixel element, there is an ionizable gas. When the appropriate voltages are applied to the row and column electrodes, the ionizable gas discharges. The discharge may produce visible light or UV light that excites a phosphor. In either case, the cell only has two states, a "light-emitting" state, and a "non-light-emitting" state. In most applications, gray scale is achieved through time multiplexing. In a single video frame, the number of times cells are put into the discharge state is proportional to the input luminance defined by the input video signal. The input luminescence is the digitally created video input to a PDP from a video receiver or other source.

A single video field is divided in time into 'n' number of weighted subfields, each weighted by a unique number of discharge pulses (or sustain pulses). A subfield consists of an addressing period in which cells are selected to be "light-emitting" or "non-light emitting" and a sustain period in which cells that have been selected to be "light-emitting" produce light proportional to the number of sustains in the subfield. In practice the number of subfields (n) in a field is limited by various timing constraints including addressing time and sustain time. These in turn may be dependent on various physical attributes of the plasma display panel, including display structure, display resolution, gas composition, gas pressure, and the number of rows to address.

Displays including PDP represent gray levels by techniques that may cause undesirable visual artifacts such as false contours including flicker and noise. Various methods have been proposed in the prior art to reduce static and dynamic false contours in displays including PDP. These methods include spatial multiplexing, frame multiplexing, binary weighting of subfields, non-binary weighting of subfields, control of light pulse timing, error diffusion, gamma correction, equalizing pulse, compression of light emission time, and optimization of subfield pattern. Optimization of subfield pattern includes optimizing the number of subfields in a frame and optimizing the sustain ratios from subfield to subfield.

Prior Art Artifact Reduction

Pioneer of Tokyo, Japan has disclosed a technique called CLEAR for the reduction of false contour and related problems. CLEAR stands for High-Contrast, Low Energy Address, and Reduction of False Contour Sequence. See Development of New Driving Method for AC-PDPs by Tokunaga et al. of Pioneer *Proceedings of the Sixth International Display Workshops*, IDW 99, pages 787-790, Dec. 1-3, 1999, Sendai, Japan. Also see European Patent Application EP 1 020 838 A1 published Jul. 19, 2000 by Tokunaga et al. of Pioneer.

CLEAR is one example of a technique that combines multiple concepts of dither gray scale, error diffusion, gamma correction, and subfield weighting to produce a PDP with few visual artifacts. The present invention also combines multiple concepts to improve electronic addressing and reduce visual artifacts in a display device.

The following are incorporated herein by reference: U.S. Pat. Nos. 6,018,329 issued to Hiroshi Kida et al. of Pioneer Electronic Corporation, Tokyo, Japan; 6,008,793 issued to Tetsuya Shigeta of Pioneer Electronic Corporation, Tokyo, Japan; U.S. Patent Application Publication 2003/0006944 A1 by Takashi Iwami et al. of Pioneer Corporation, Japan; European Patent application EP 1 022 714A2, by Tetsuya Shigeta et al. of Pioneer Corp. Display, Yamanashi, Japan, published Jul. 26, 2000; European Patent Application EP 1 020 838 A1, by Tsutomu Tokunaga et al. of Pioneer Corporation, Mejuro-ku, Tokyo, Japan, published Jul. 19, 2000; European Patent Application EP 0 720 139 A3, by Takashi Okano et al. of Pioneer Electronic Corporation, Meguro-ku, Tokyo, Japan, published Jul. 30, 1997; Development of New Driving Method for AC-PDPs, High Contract, Low Energy Address and Reduction of False Contour Sequence "CLEAR," by T. Tokunaga et al. of Pioneer Corporation, Yamanashi, Japan, IDW 99, Proceedings of The Sixth International Display Workshops, Sendai, Japan, pp. 787 to 790, Dec. 1-3, 1999; Improvement of Moving Video Image Quality on PDPs by Reducing the Dynamic False Contour by T. Shigata et al., SID 98 Digest, pp. 287-290 (1998).

SUMMARY OF THE INVENTION

In accordance with this invention, there is provided a method to achieve gray scale through time multiplexing and spatial multiplexing that reduces visual artifacts and provides high contrast at low brightness and luminance in a plasma display panel (PDP) comprising a multiplicity of plasma-shells. This invention comprises artifact reduction in a plasma-shell PDP by means of gamma correction, error diffusion, and/or dithering.

This invention also comprises a center of light mass artifact reduction method and a unique drive method that provides for the addressing of a large number of rows without dual scan, without decreasing brightness, and without causing flicker.

This invention is directed to methods of improving image and/or preventing burn in for displays that use time multiplexed grayscale such as plasma displays or digital light mirrors. These methods include detecting a still image, error diffusion, error diffusion seeding, adjusting gamma to achieve low-level brightness, and adjusting gamma to prevent artifacts.

Detecting a Still Image to Prevent Burn-in

The fill factor is defined in the prior art as pixel load on a display screen. Fill factor is determined by the number of 'on' pixels and brightness of 'on' pixels. Fill factor is monitored on a frame-to-frame basis. To reduce power consumed, fill factor is monitored. In a PDP, when fill factor is high, the sustains are reduced. When the fill factor is low, the number of sustains are increased for a given frame.

In one embodiment hereof, display burn-in is prevented by reducing the number of sustains when the fill factor is unchanged over a specified period of time. If fill factor remains unchanged to within a specified tolerance over a specified period of time, it can be inferred that the image is essentially still. When this is detected, the number of sustains can be decreased to reduce the amount of burn-in. This will decrease the global brightness. Decreasing the number of sustains per frame is done gradually so as not to be detected by the viewer.

Error Diffusion

Error diffusion is a method for achieving the illusion for a quantized image of having greater color depth than its maximum. This technique also allows smoother color transitions than would usually occur after color quantization as a result of changing color depth.

Floyd Steinberg is a traditional method of dithering an image. Each gray value has a native error associated with it. The native error is the difference between the gray value and the next closest lowest value that can be presented by the display. One row of native error value is saved to allow distribution to the next row according to the typical Floyd Steinberg weighting method. Other weighting methods are possible. A small random value is often applied to prevent noticeable stagnant patterns. For example:

| | | |
|---|---|---|
| 1*E1 | 5*E2 | 3*E3 |
| 7*E4 | 16*E5 | |

In accordance with another embodiment, error diffusion is achieved using two separate error diffusion means, 'Little Error Diffusion' and 'Big Error Diffusion'. Little Error Diffusion is used to select between only two quantized values.

Little Error Diffusion sets a fill pattern between two consecutive values. Big Error Diffusion selects between two or more quantized values. It helps distribute error between large gaps in the subfield code. Large gaps in the subfield code occur in PDP because, although there may be many potential subfield codes, only a limited number of subfield codes are permissible due to artifact problems.

In the case of a plasma display, Big Error Diffusion is calculated using the differences between an input gray level and a quantized gray level in whole sustain numbers. Because a whole number of sustains is used for the error value and because the steps between subfield codes are not uniform, error can propagate between two or more subfield codes.

Invention to Improve Error Diffusion Seeding

In accordance with this embodiment, random seed is only changed every other frame. Detect edges using only the saved error results. For example IF (E1=E2=E3) and (E4=E5) and (E5−E2>=some threshold), THEN add seed value to E5.

Adjusting Gamma Between Red, Blue, and Green to Achieve Low-Level Brightness

In the prior art, a gamma correction is applied to red, blue, and green input signals to a display to correct the input signals to make them more closely match the desired output. Gamma can be applied to correct for non-linearity due to phosphors, non-linearly of the input signal, or other reasons. Usually red, green, blue have different gamma correction functions.

In accordance with this invention, there is provided a method of achieving low-level gray in which gamma correction for blue extends blue deeper into the low-level grays then red or green and red is extended deeper into the low-level gray than green. In this way true gamma correction is sacrificed to achieve better low-level gray detail. It is possible to modify the order, but the following is one preferred method.

TABLE I

| Notional Example | | | |
|---|---|---|---|
| Grayscale Level | R | G | B |
| 0 | 0 | 0 | 0 |
| 1 | 0 | 0 | 1 |
| 2 | 1 | 0 | 1 |
| 3 | 1 | 1 | 1 |
| 4 | 1 | 1 | 2 |
| 5 | 2 | 1 | 2 |
| 6 | 2 | 2 | 2 |
| 7 | 2 | 2 | 3 |
| 8 | 3 | 2 | 3 |
| 9 | 3 | 3 | 3 |

Adjusting Gamma to Prevent Artifacts

There is a noticeable problem that occurs when error diffusion interacts with dithering. Dithering is a technique used in plasma display in which two adjacent subfield codes separated by a large gap in brightness are displayed in a checkerboard fashion to achieve effective brightness midway between the two. The checkerboard pattern inverts every other frame. Two subfield codes dithered in this manner are termed "dither pairs".

Dither pairs are a 50% ratio. If error diffusion is at or close to a 50% ratio, the two will interact to cause noticeable dark and light patterns in the display.

In accordance with this invention, the red, blue, and green gamma are adjusted such that the gray levels that map to dither pairs, or subfield codes immediately above or below dither pairs will not have errors that produce at or close to a 50% ratio. In this way true gamma correction is sacrificed to achieve better a more pleasing image.

The PDP comprises one or more plasma-shells on or within a rigid or flexible substrate with each plasma-shell being electrically connected to at least two electrical conductors such as electrodes for addressing and sustaining. In accordance with one embodiment of this invention, insulating barriers may be used to prevent contact between the electrodes. The plasma-shell may be of any suitable geometric shape such as a plasma-sphere, plasma-disc, or plasma-dome for use in a gas discharge plasma display device. As used herein, plasma-shell includes plasma-sphere, plasma-disc, and/or plasma-dome. The plasma-shells may by used alone or in combination with plasma-tubes.

A plasma-sphere is a primarily hollow sphere with relatively uniform shell thickness. The shell is typically composed of a dielectric material. It is filled with an ionizable gas at a desired mixture and pressure. The gas is selected to produce visible, UV, and/or infrared discharge when a voltage is applied. The shell material is selected to optimize dielectric properties and optical transmissivity. Additional beneficial materials may be added to the inside or outer surface of the sphere including magnesium oxide for secondary electron emission. The magnesium oxide and other materials including organic and/or inorganic luminescent substances may also be added directly to the shell material.

A plasma-disc is similar to the plasma-sphere in material composition and gas selection. It differs from the plasma-sphere in that it is flattened on at least two opposing sides such as the top and bottom. A plasma-sphere or sphere may be flattened to form a plasma-disc by applying heat and pressure simultaneously to the top and bottom of the sphere using two substantially flat and ridged members, either of which may be heated. Each of the other four sides may be flat or round.

A plasma-dome is similar to a plasma-sphere in material composition and ionizable gas selection. It differs in that one side is domed and the opposing side is flat. A plasma-sphere is flattened on one or more other sides to form a plasma-dome, typically by applying heat and pressure simultaneously to the top and bottom of the plasma-sphere or sphere using one substantially flat and ridged member and one substantially elastic member. In one embodiment, the substantially rigid member is heated. A plasma-dome may also be made by cutting an elongated tube as shown in U.S. Pat. No. 3,998,618 (Kreick et al.) incorporated herein by reference As illustrated herein, the conductors are electrically connected to a plasma-shell or plasma-tube located within or on a rigid or flexible substrate or other body, by means of an electrically conductive or insulating dielectric bonding substance applied to the substrate or to each plasma-shell or plasma-tube. In one embodiment, each electrical connection to each plasma-shell or plasma-tube is separated from each other electrical conductive bonding substance connection by an insulating barrier so as to prevent the conductive substance forming one electrical connection from flowing and electrically shorting out another electrical connection.

The plasma-shell may be of any suitable geometric shape including a plasma-sphere, plasma-dome, or plasma-disc. In one preferred embodiment of this invention, there is used a PDP comprised of one or more plasma-discs alone or in combination with one or more other plasma-shell geometric shapes. The practice of this invention is illustrated and described hereafter with respect to a PDP with plasma-discs. However, other plasma-shell shapes are contemplated and may be used. Likewise, the plasma-tube may be of any suitable geometric configuration. Luminescent material may be positioned near or on each plasma-shell and/or plasma-tube to provide or enhance light output.

In one embodiment, this invention also relates to the fabrication and operation of a PDP comprised of one or more plasma-shells with a high frequency sustain rate typically in the mega-hertz range so as to produce a high brightness PDP. The operation of the PDP at the high frequency sustain rate also reduces the false contour and other visual artifacts. In accordance with such embodiment, the plasma-shell PDP is operated at a high frequency sustain rate sufficient to provide a high brightness in the visible range of about 2,000 to about 15,000 candelas per meter squared (cd/m$^2$), typically about 3,000 to about 10,000 cd/m$^2$. The plasma-shell PDP may be operated at a frequency range of about 250 kilohertz (KHz) to about 10 megahertz (MHz), typically about 750 KHz to about 5 MHz, preferably about 1 to about 3 MHz.

In accordance with this embodiment, an AC PDP with plasma-shells has a high frequency, mega-hertz sustain rate, electronic waveform driver that provides high-brightness light output as well as significant memory margin for the AC PDP display. Such a display is comprised of an array of individual plasma-shells containing one isolated ionizing gas cavity per pixel. The electronic drive circuit contains a high frequency L-C tank circuit with a single high voltage transistor that produces an order of magnitude or more brightness per pixel. The tank circuit produces a very efficient use of electrical energy and precludes the need for an add-on energy recovery circuitry having increased electronic complexity and less efficiency than the tank circuit drive. This provides mega-hertz and greater sustain frequency waveforms to deliver individual pixel brightness levels of 2000 cd/m$^2$ or greater with increased luminous efficiencies.

BRIEF DESCRIPTION OF DRAWINGS

FIGS. 23A to 34A show plasma-discs of various geometric shapes and are section views of FIGS. 23B to 34B.

FIGS. 23B to 34B are section views of FIGS. 23A to 35A.

DETAILED DESCRIPTION OF DRAWINGS AND EMBODIMENTS OF INVENTION

This invention is described with reference to a plasma-shell PDP, wherein the plasma-shell is a plasma-disc. In accordance with this embodiment, at least two conductors or electrodes are electrically connected to a plasma-disc located on a substrate. In one embodiment, the electrodes are connected to the plasma-disc by means of an electrically conductive bonding substance applied to each plasma-disc and/or to the electrode and/or to both the plasma-disc and the electrode. In another embodiment, each electrically conductive connection to each plasma-disc is separated from each other electrically conductive connection to the plasma-disc by an insulating barrier to prevent electrical shorting between connections. This also prevents the conductive bonding substance from freely flowing and forming one electrical connection, and/or shorting out other electrical connections.

DETAILED DESCRIPTION OF THE DRAWINGS

Figure 1B:
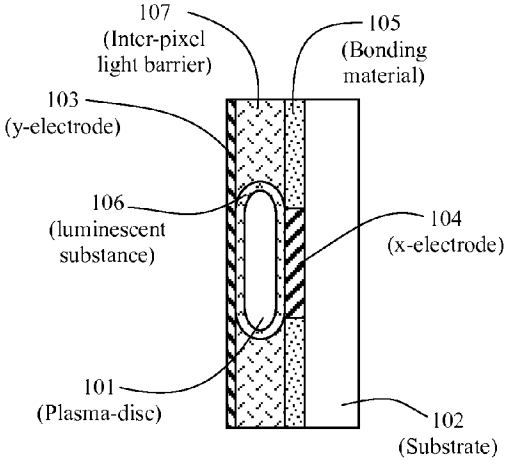
FIG. 1B is a Section View 1B-1B of FIG. 1.
Figure 1C:
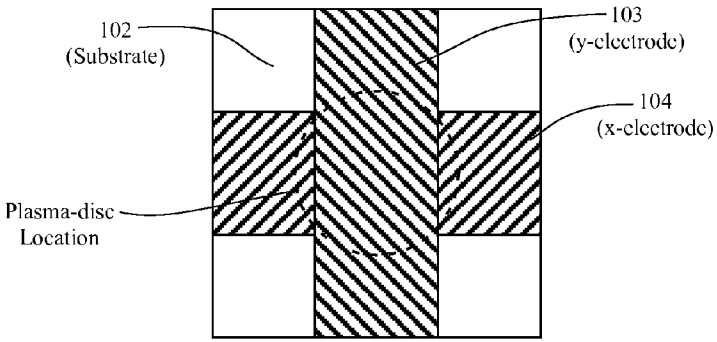
FIG. 1C is a top view of the FIG. 1 substrate showing the x-electrode and y-electrode configuration with the plasma-disc location shown with broken lines.
Figure 1:
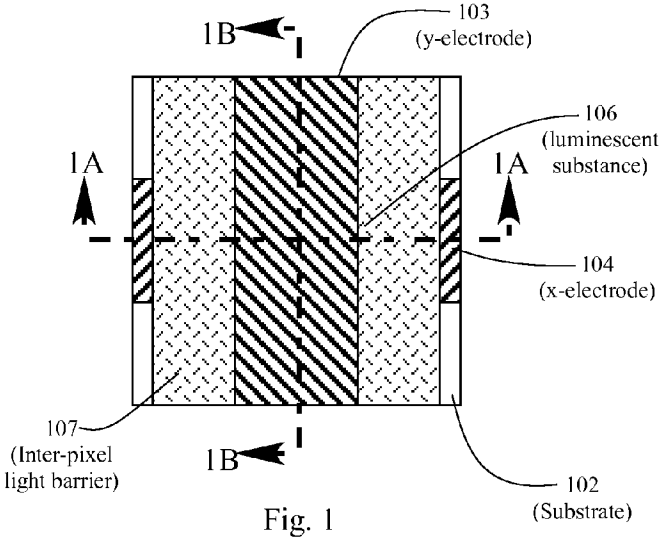
FIG. 1 is a top view of a plasma-disc located on a substrate with x-electrode and y-electrode.

FIG. 1 shows substrate 102 with transparent y-electrode 103, luminescent substance 106, x-electrode 104, and inter-pixel light barrier 107. The y-electrode 103 and x-electrode 104 are crosshatched for identification purposes. The y-electrode 103 is transparent because it is shown covering much of the plasma-disc 101 not shown in FIG. 1.

Figure 1A:
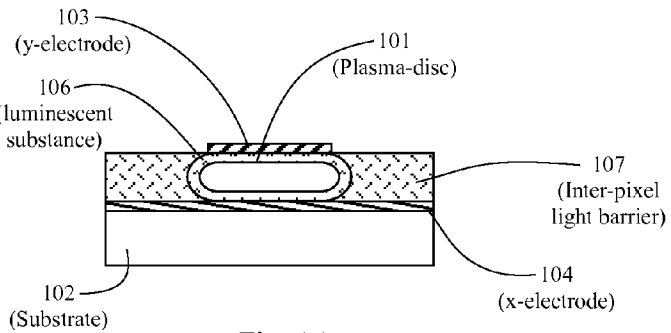
FIG. 1A is a Section View 1A-1A of FIG. 1.

FIG. 1A is a Section View 1A-1A of FIG. 1 and FIG. 1B is a Section View 1B-1B of FIG. 1, each Section View showing the plasma-disc 101 located on the bottom x-electrode 104 which is attached to the surface of substrate 102 with top y-electrode 103 covering the top of the plasma-disc 101, and inter-pixel light barrier 107 surrounding the plasma-disc 101. The plasma-disc 101 is attached to the bottom x-electrode 104 with bonding material 105. Luminescent substance 106 is located on the top surface of plasma-disc 101. In one embodiment, the plasma-disc 101 is partially or completely coated with the luminescent substance 106. As illustrated in FIGS. 1A and 1B plasma-disc 101 is sandwiched between a y-electrode 103 and x-electrode 104. Inter-pixel light barrier 107 is of substantially the same thickness or height as plasma-disc 101. The light barrier may extend and bridge between adjacent pixels. This allows the transparent y-electrode 103, to be applied to a substantially flat surface. The light barrier 107 is made of an opaque or non-transparent material to prevent optical cross-talk between adjacent plasma-discs. The plasma-disc 101 is attached to the substrate 102 with bonding material 105. As practiced in this invention, bonding material is liberally applied to the entire substrate 102 before the plasma-disc 101 is attached. Bonding material 105 may coat some or all of the x-electrode 104. Bonding material provides a dielectric interface between the electrode and the plasma-disc 101. The bonding material 105 can be of any suitable adhesive substance. In one embodiment hereof, there is used a so-called Z-Axis electrically conductive tape such as manufactured by 3M. FIG. 1C shows the electrodes 103 and 104 on the substrate 102 with the location of the plasma-disc 101 (not shown) indicated with broken lines.

Figure 2B:
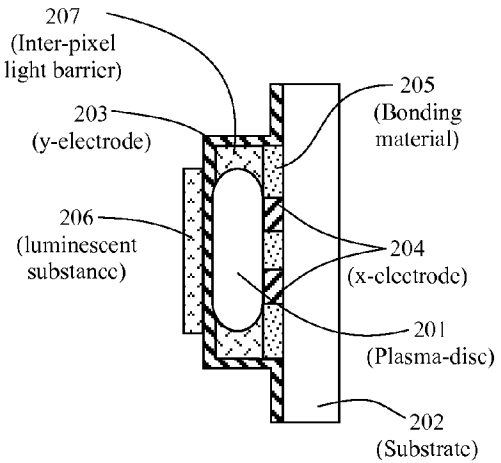
FIG. 2B is a Section View 2B-2B of FIG. 2.
Figure 2C:
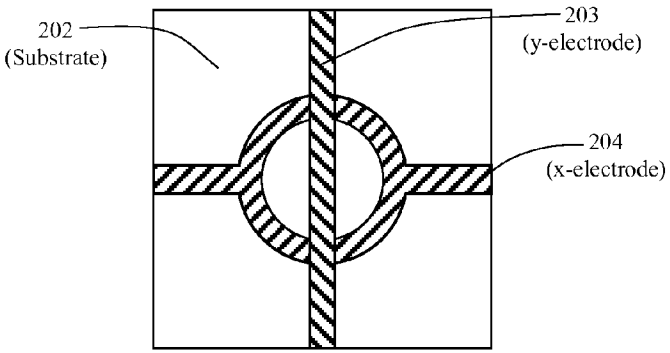
FIG. 2C is a top view of the FIG. 2 substrate showing the x-electrode and y-electrode in a ring and cross configuration without the plasma-disc shown.
Figure 2:
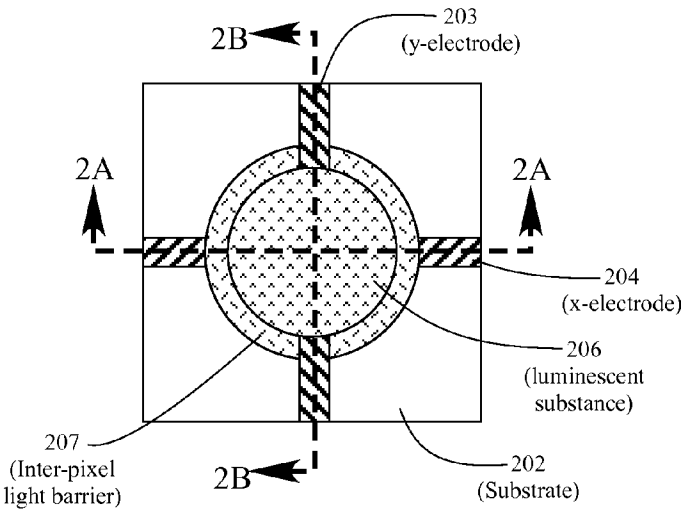
FIG. 2 is a top view of a plasma-disc located on a substrate with x-electrode and y-electrode.
Figure 2A:
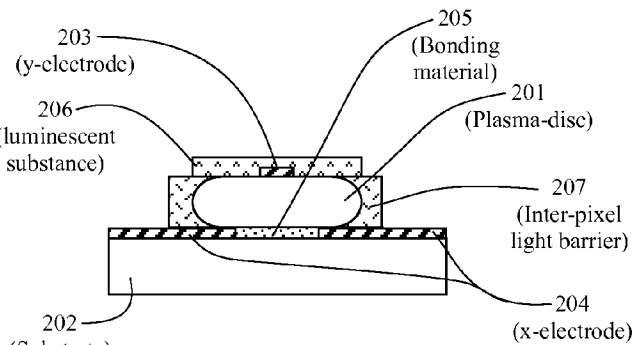
FIG. 2A is a Section View 2A-2A of FIG. 2.

FIG. 2 shows substrate 202 with y-electrode 203, luminescent substance 206, x-electrode 204, and inter-pixel light barrier 207. The y-electrode 203 and x-electrode 204 are crosshatched for identification purposes. The y-electrode 203 may be transparent or not depending upon its width and obscurity of the plasma-disc 201 not shown in FIG. 2. In this embodiment, the inter-pixel light barrier 207 does not extend and form a bridge between adjacent pixels. FIG. 2A is a Section View 2A-2A of FIG. 2 and FIG. 2B is a Section View 2B-2B of FIG. 2, each Section View showing the plasma-disc 201 located on the bottom x-electrode 204 which is attached to the surface of substrate 202 with top y-electrode 203 and inter-pixel light barrier 207. The plasma-disc 201 is attached to the substrate 202 with bonding material 205. The luminescent substance 206 is located on the top surface of the plasma-disc 201. FIG. 2C shows the y-electrode 203 and x-electrode 204 on the substrate 202, the x-electrode 204 being in a ring and cross configuration where the plasma-disc 201 (not shown) is to be positioned. In this FIG. 2 embodiment the discharge between the x- and y-electrodes will first occur at the intersection of electrodes 203 and 204 and spread around the donut shape of 204. This spreading of the discharge from a small gap to a wide gap increases efficiency. Other electrode configurations are also contemplated.

Figure 3B:
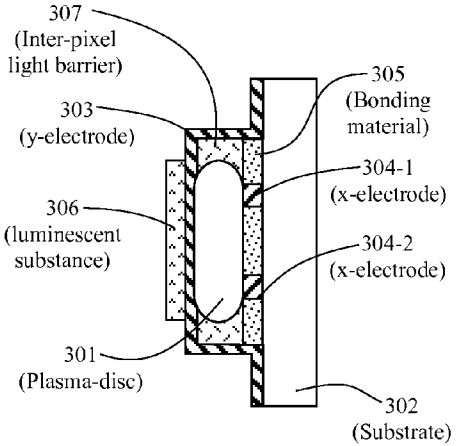
FIG. 3B is a Section View 3B-3B of FIG. 3.
Figure 3C:
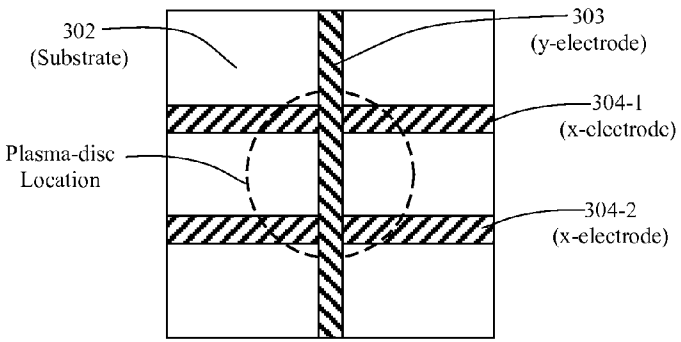
FIG. 3C is a top view of the FIG. 3 substrate showing the two x-electrodes and y-electrode configuration with the plasma-disc location shown with broken lines.
Figure 3:
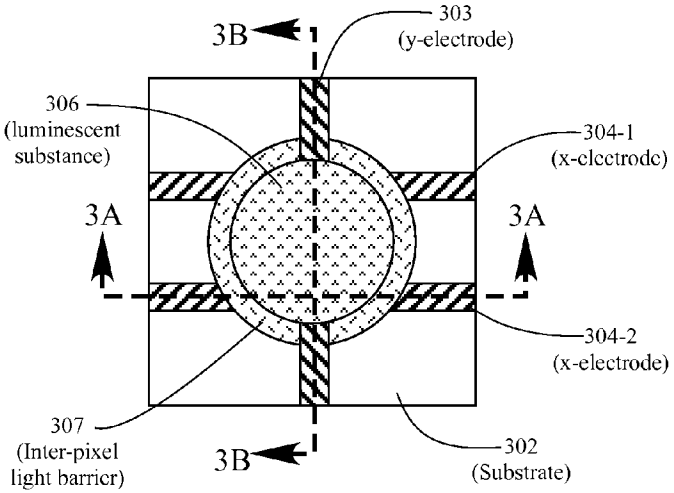
FIG. 3 is a top view of a plasma-disc located on a substrate with two x-electrodes and one y-electrode.
Figure 3A:
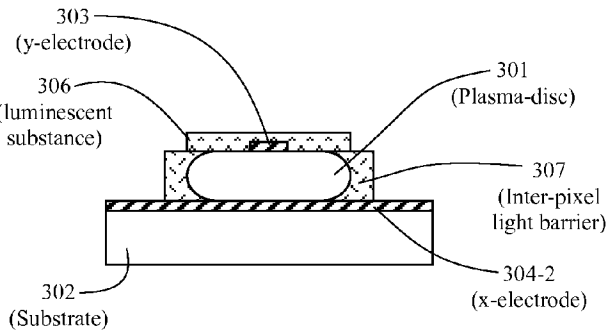
FIG. 3A is a Section View of 3A-3A of FIG. 3.

FIGS. 3, 3A, 3B, and 3C are several views of a three-electrode configuration and embodiment employing positive column discharge. FIG. 3 shows substrate 302 with top y-electrode 303, dual bottom x-electrodes 304-1, 304-2, luminescent substance 306, and inter-pixel light barrier 307. The y-electrode 303 and x-electrodes 304-1, 304-2 are crosshatched for identification purposes. FIG. 3A is a Section View 3A-3A of FIG. 3 and FIG. 3B is a Section View 3B-3B of FIG. 3, each Section View showing the plasma-disc 301 located on the surface of the substrate 302 with top y-electrode 303 and dual bottom x-electrodes 304-1 and 304-2, inter-pixel light barrier material 307, and luminescent substance 306. The plasma-disc 301 is attached to the substrate 302 with bonding material 305. The luminescent substance 306 is on top of the plasma-disc 301 and y-electrode 303. FIG. 3C shows the electrodes 303, 304-1, and 304-2 on the substrate 302 with the location of the plasma-disc 301 (not shown) indicated with broken lines. This embodiment is similar to the FIG. 2 embodiment except that the donut shaped x-electrode 204 is replaced with two independent x-electrodes 304-1 and 304-2. After a discharge is initiated at the intersection of electrode 303 and 304-1 or 304-2, it is maintained by a longer positive column discharge between 304-1 and 304-2.

Figure 4B:
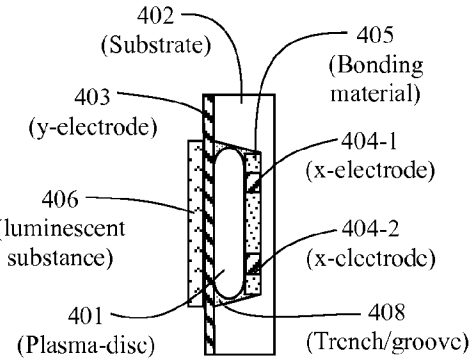
FIG. 4B is a Section View of 4B-4B of FIG. 4.
Figure 4C:
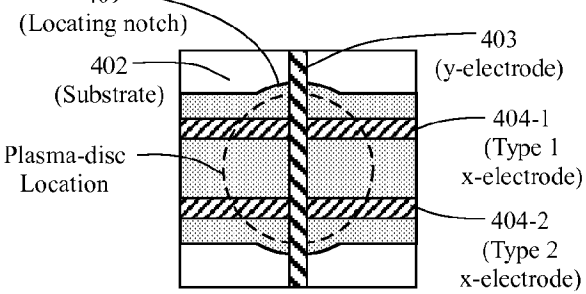
FIG. 4C is a top view of the substrate and electrodes in FIG. 4 with the plasma-disc location shown in broken lines.
Figure 4:
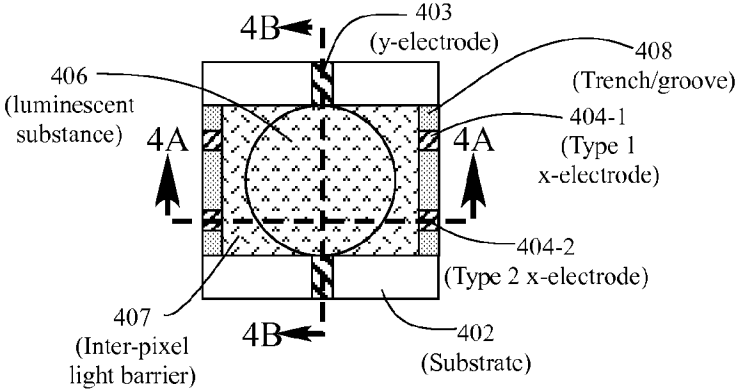
FIG. 4 is a top view of a plasma-disc located on a substrate with two x-electrodes and one y-electrode.
Figure 4A:
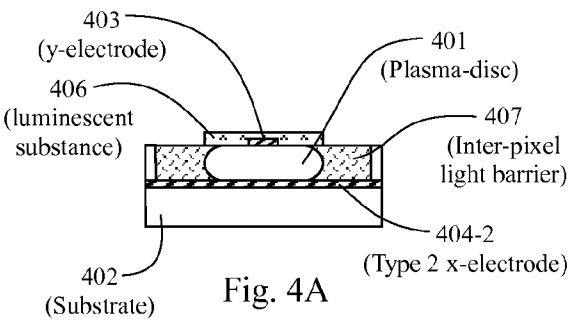
FIG. 4A is a Section View 4A-4A of FIG. 4.

FIGS. 4, 4A, 4B, and 4C are several views of a three-electrode configuration and embodiment in which the plasma-disc 401 is embedded in a trench or groove 408. FIG. 4 shows substrate 402 with top y-electrode 403, dual bottom x-electrodes 404-1, 404-2, luminescent substance 406, inter-pixel light barrier 407 and trench or groove 408. The y-electrode 403 and x-electrodes 404-1, 404-2 are crosshatched for identification purposes. FIG. 4A is a Section View 4A-4A of FIG. 4 and FIG. 4B is a Section View 4B-4B of FIG. 4, each Section View showing the plasma-disc 401 located in the trench or groove 408 on the surface of the substrate 402 with top y-electrode 403 and dual bottom x-electrodes 404-1 and 404-2, inter-pixel light barrier material 407, and luminescent substance 406. The plasma-disc 401 is positioned within the trench or groove 408 and attached to the substrate 402 with bonding material 405. FIG. 4C shows the electrodes 403, 404-1, and 404-2 on the substrate 402 with the location of the plasma-disc 401 (not shown) indicated with broken lines. This FIG. 4 embodiment is a three-electrode structure with similar characteristics to the FIG. 2 embodiment. However x-electrodes 404-1 and 404-2 extend down the middle of trench 408 formed in substrate 402. The plasma-disc 401 is attached with bonding material to the inside of the trench. Optional light barrier material 407 may be applied around the plasma-disc. Y-electrode 403 is applied across the top of the substrate and optional luminescent substance 406 may be applied over the top of the plasma-disc. FIG. 4C shows optional locating notch 409 to help position the plasma-disc.

Figure 5B:
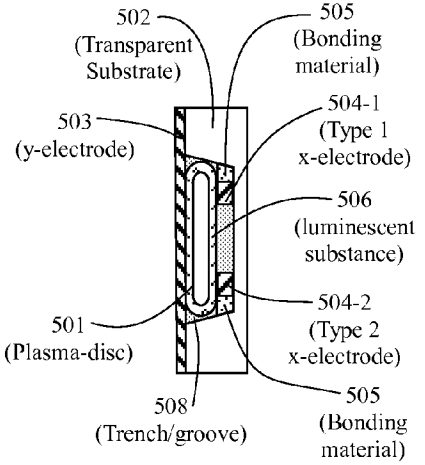
FIG. 5B is a Section View of 5B-5B of FIG. 5.
Figure 5C:
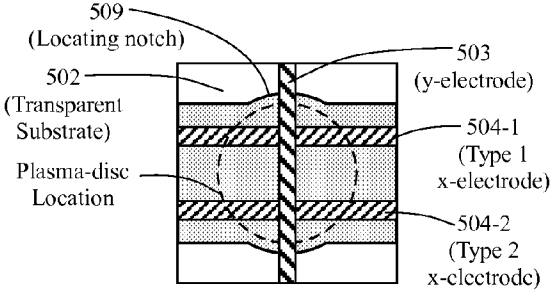
FIG. 5C is a top view of the substrate and electrodes in FIG. 5 with the plasma-disc location shown in broken lines.
Figure 5:
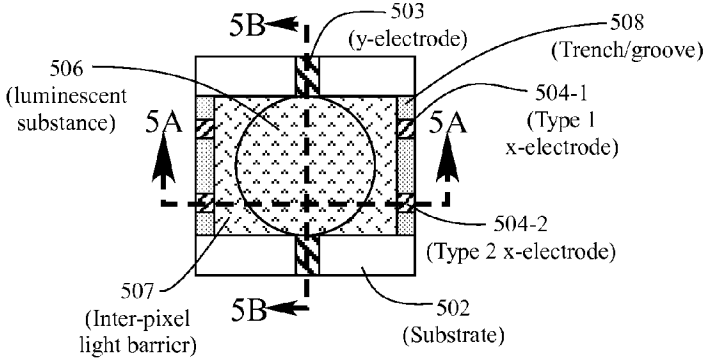
FIG. 5 is a top view of a plasma-disc located on a substrate with two x-electrodes and one y-electrode.
Figure 5A:
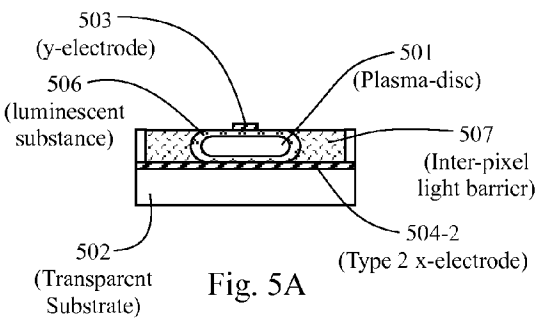
FIG. 5A is a Section View 5A-5A of FIG. 5.

FIGS. 5, 5A, 5B, and 5C are several views of a three-electrode configuration and embodiment in which the plasma-disc 501 is embedded in a trench or groove 508. FIG. 5 shows transparent substrate 502 with top y-electrode 503, dual bottom x-electrodes 504-1, 504-2, luminescent substance 506, inter-pixel light barrier 507, and trench or groove 508. The y-electrode 503 and x-electrodes 504-1, 504-2 are crosshatched for identification purposes. FIG. 5A is a Section View 5A-5A of FIG. 5 and FIG. 5B is a Section View 5B-5B of FIG. 5, each Section View showing the plasma-disc 501 located in the trench or groove 508 on the surface of the substrate 502 with top y-electrode 503 and dual bottom x-electrodes 504-1 and 504-2, inter-pixel light barrier 507, and luminescent substance 506. The plasma-disc 501 is bonded within the trench or groove 508 and attached to the substrate 502 with bonding material 505. As shown in FIG. 5B, the luminescent substance 506 covers the surface of the plasma-disc 501. FIG. 5C shows the electrodes 503, 504-1, and 504-2 on the substrate 502 with the location of the plasma-disc 501 (not shown) indicated with broken lines. A locating notch 509 is shown.

Figure 6B:
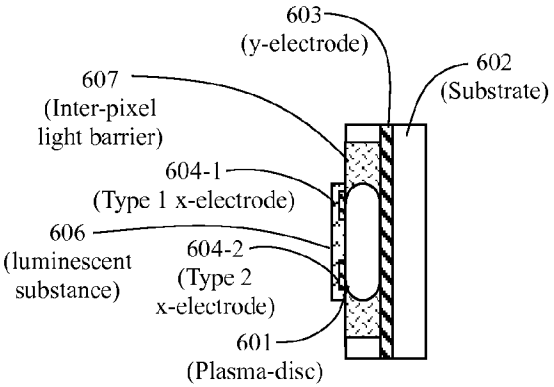
FIG. 6B is a Section View of 6B-6B of FIG. 6.
Figure 6C:
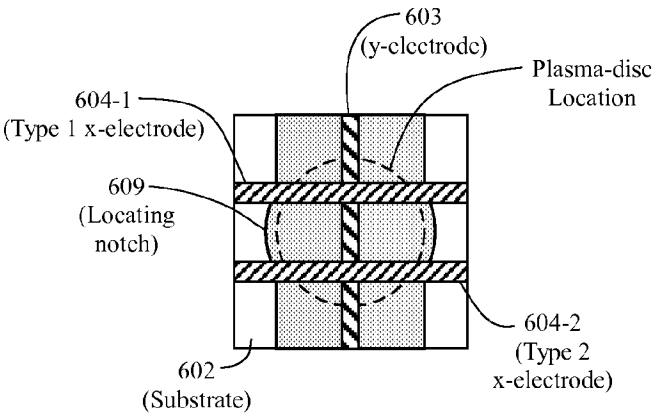
FIG. 6C is a top view of the substrate and electrodes in FIG. 6 with the plasma-disc location shown in broken lines.
Figure 6:
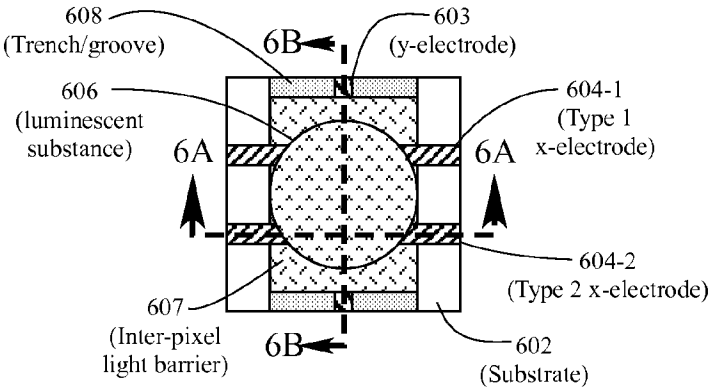
FIG. 6 is a top view of a plasma-disc located on a substrate with two x-electrodes and one y-electrode.
Figure 6A:
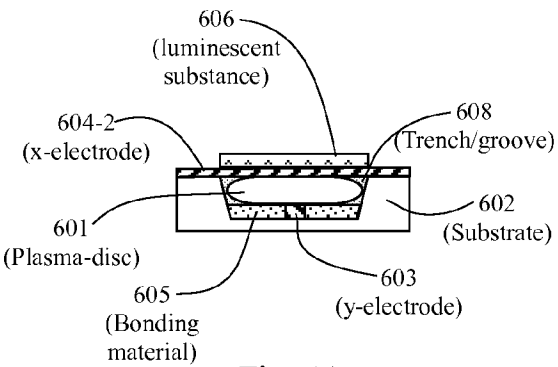
FIG. 6A is a Section View 6A-6A of FIG. 6.

FIGS. 6, 6A, 6B, and 6C are several views of a three-electrode configuration and embodiment in which the plasma-disc 601 is embedded in a trench or groove 608. FIG. 6 shows substrate 602 with dual top x-electrodes 604-1, 604-2, bottom y-electrode 603, luminescent substance 606, inter-pixel light barrier 607, and trench or groove 608. The x-electrodes 604-1, 604-2 and bottom y-electrodes 603 are crosshatched for identification purposes. FIG. 6A is a Section View 6A-6A of FIG. 6 and FIG. 6B is a Section View 6B-6B of FIG. 6, each Section View showing the plasma-disc 601 located within trench or groove 608 on the surface of the substrate 602 with bottom y-electrode 603 and dual top x-electrodes 604-1 and 604-2, inter-pixel light barrier 607, and luminescent substance 606. The plasma-disc 601 is within the trench or groove 608 and attached to the substrate 602 with bonding material 605. FIG. 6C shows the electrodes 603, 604-1, and 604-2 on the substrate 602 with the location of the plasma-disc 601 (not shown) indicated with broken lines. A plasma-disc locating notch 609 is shown. The FIG. 6 embodiment differs from the FIG. 4 embodiment in that a single y-electrode 603 extends through the parallel center of the trench 608 and x-electrodes 604-1 and 604-2 are perpendicular or orthogonal to the trench and run along the top surface.

Figure 7:
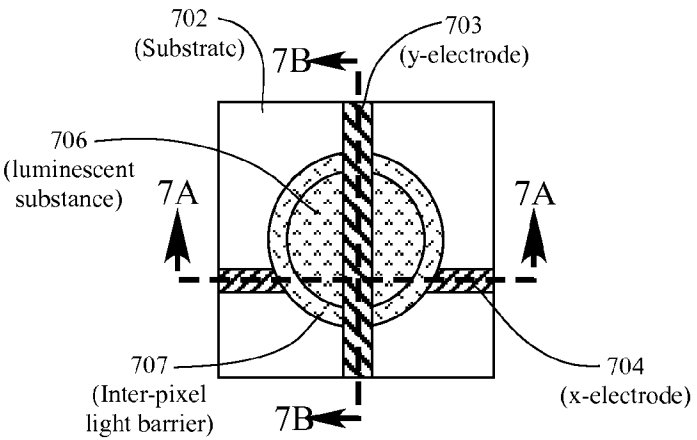
FIG. 7 is a top view of a plasma-disc located on a substrate with one x-electrode and one y-electrode.
Figure 7B:
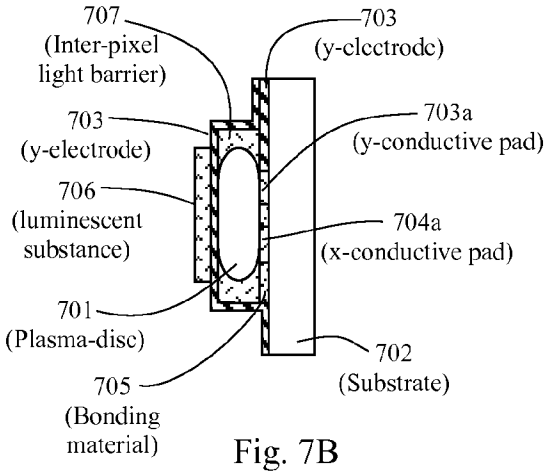
FIG. 7B is a Section View of 7B-7B of FIG. 7.
Figure 7C:
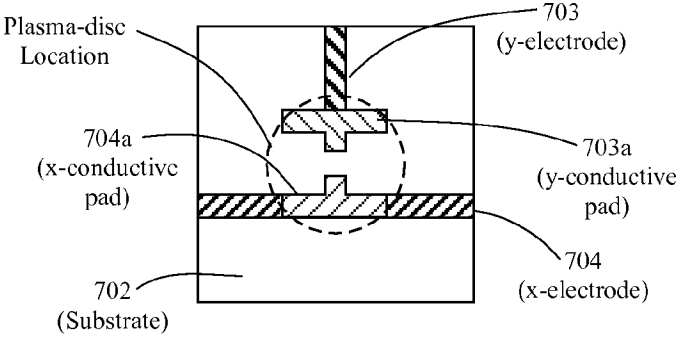
FIG. 7C is a top view of the substrate, electrodes of FIG. 7, and conductive pads, each conductive pad in a "T" configuration with the plasma-disc location shown in broken lines.
Figure 7A:
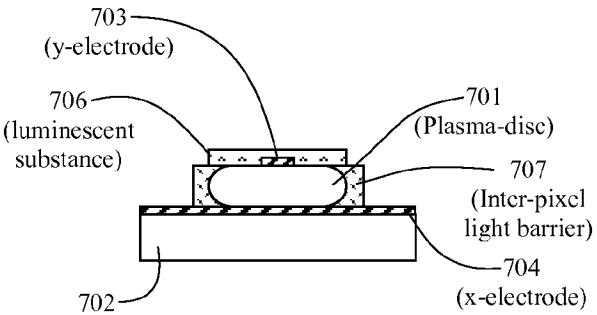
FIG. 7A is a Section View 7A-7A of FIG. 7.

FIGS. 7, 7A, 7B, and 7C are several views of a two-electrode embodiment with a two-electrode configuration and pattern that employs positive column discharge. FIG. 7 shows substrate 702 with top y-electrode 703, bottom x-electrodes 704, luminescent substance 706, and inter-pixel light barrier 707. The y-electrode 703 and x-electrode 704 are crosshatched for identification purposes. FIG. 7A is a Section View 7A-7A of FIG. 7 and FIG. 7B is a Section View 7B-7B of FIG. 7, each Section View showing the plasma-disc 701 located on the surface of substrate 702 with top y-electrode 703 and bottom x-electrode 704, inter-pixel light barrier 707, and luminescent substance 706. The plasma-disc 701 is attached to the substrate 702 with bonding material 705. There is also shown in FIG. 7B y-electrode or conductive pad 703*a* and x-electrode or conductive pad 704*a*. FIG. 7C shows the electrodes 703 and 704 on the substrate 702 with the location of the plasma-disc 701 (not shown) indicated with broken lines. There is also shown y-conductive pad 703*a* and x-conductive pad 704*a* in a "T" shape for contact with plasma-disc 701. As in FIG. 2, FIG. 7 shows a two-electrode configuration and embodiment, which employs positive column discharge. The top y-electrode 703 is applied over the plasma-disc 701 and light barrier 707. Additionally, the electrode 703 runs under plasma-disc 701 and forms a 'T' shaped conductive pad 703*a*. In this configuration, the discharge is initiated at the closest point between the two electrodes 703*a* and 704*a* under the plasma-disc and spread to the wider gap electrode regions, including electrode 703, which runs over the top of the plasma-disc. It will be obvious to one skilled in the art that there are conductive pad shapes and configurations other than the 'T' configuration that perform essentially the same function.

Figure 8B:
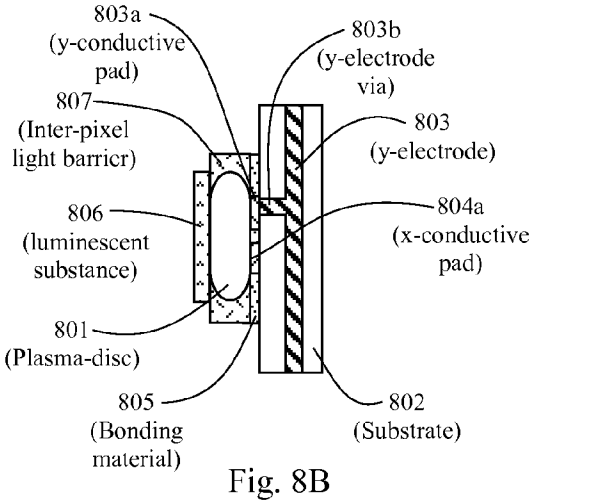
FIG. 8B is a Section View of 8B-8B of FIG. 8.
Figure 8C:
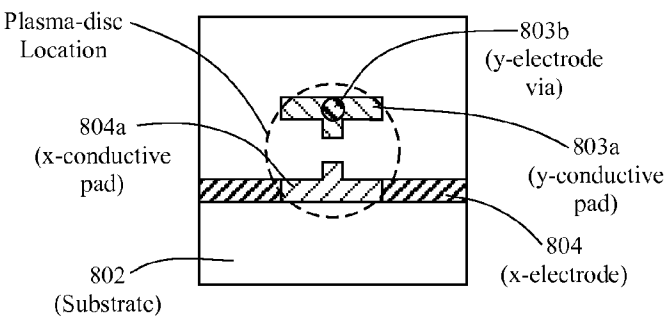
FIG. 8C is a top view of the substrate, electrodes of FIG. 8, and conductive pads, each conductive pad in a "T" configuration with the plasma-disc location shown in broken lines.
Figure 8:
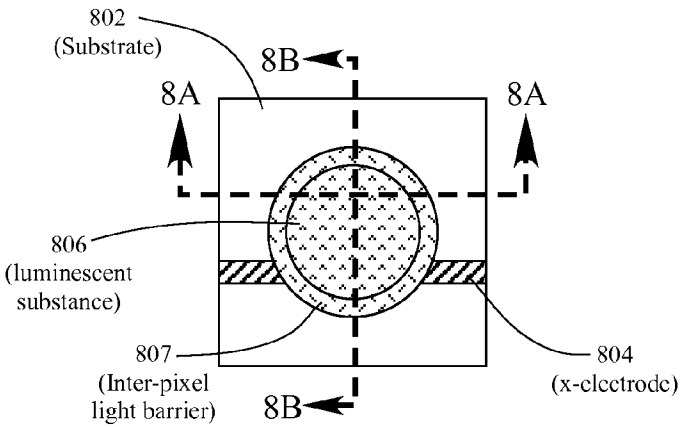
FIG. 8 is a top view of a plasma-disc located on a substrate with one x-electrode.
Figure 8A:
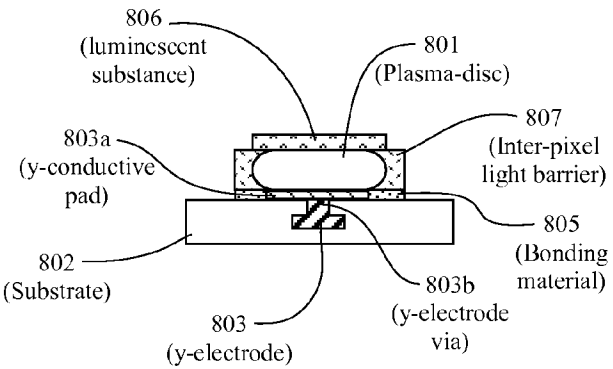
FIG. 8A is a Section View 8A-8A of FIG. 8.

FIGS. 8, 8A, 8B, and 8C are several views of a two-electrode configuration and embodiment in which neither the x-nor the y-electrode runs over the plasma-disc 801. FIG. 8 shows substrate 802 with x-electrode 804, luminescent substance 806, and inter-pixel light barrier 807. The x-electrode 804 is crosshatched for identification purposes. FIG. 8A is a Section View 8A-8A of FIG. 8 and FIG. 8B is a Section View 8B-8B of FIG. 8, each Section View showing the plasma-disc 801 located on the surface of substrate 802 with bottom y-electrode 803, top x-conductive pad 804*a*, inter-pixel light barrier 807, and a top layer of luminescent substance 806. The plasma-disc 801 is attached to the substrate 802 with bonding material 805. Also shown is y-conductive pad 803*a* and y-electrode via 803*b* forming a connection to y-electrode 803. The pads 803*a* and 804*a* are in contact with the plasma-disc 801. FIG. 8C shows x-electrode 804 with pad 804*a* and y-conductive pad 803*a* in a "T" configuration with y-electrode via 803*b* on the substrate 802 with the location of the plasma-disc 801 indicated with broken lines. In this configuration x-electrode 804 extends along the surface of substrate 802 and y-electrode 803 extends along an inner layer of substrate 802. The y-electrode 803 is orthogonal to x-electrode 804. Contact with plasma-disc 801 is made with 'T' shaped conductive pads 804*a* and 803*a*. The 'T' shaped conductive pad is beneficial to promote positive column discharge. Conductive pad 803*a* is connected to electrode 803 by via 803*b*. Although y-electrode 803 is shown internal to substrate 802, it may also extend along the exterior surface of 802, opposite to the side that the plasma-disc is located.

Figure 9B:
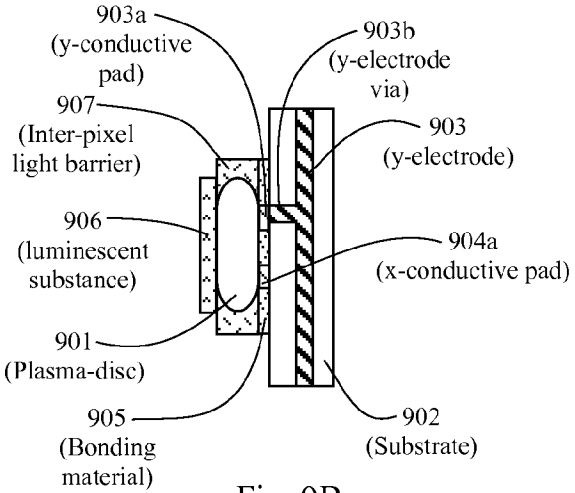
FIG. 9B is a Section View of 9B-9B of FIG. 9.
Figure 9C:
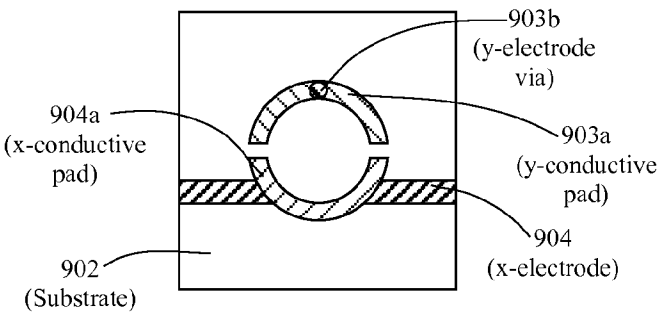
FIG. 9C is a top view of the substrate, electrodes in FIG. 9, and arc shaped conductive pads without the plasma-disc.
Figure 9:
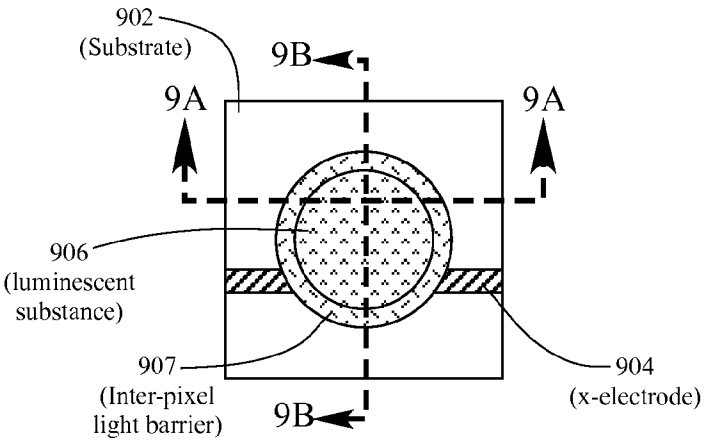
FIG. 9 is a top view of a plasma-disc located on a substrate with one x-electrode.

FIGS. 9, 9A, 9B, and 9C are several views of an alternative two-electrode configuration and embodiment in which neither x-electrode nor y-electrode extends over the plasma-disc 901. FIG. 9 shows substrate 902 with x-electrode 904, luminescent substance 906, and inter-pixel light barrier 907. The x-electrode 904 is crosshatched for identification purposes.

Figure 9A:
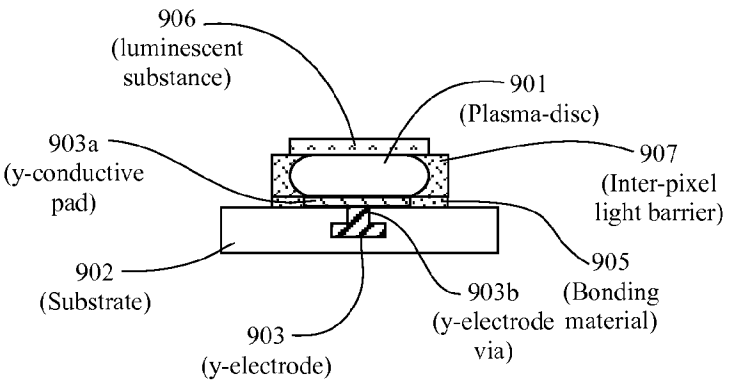
FIG. 9A is a Section View 9A-9A of FIG. 9.

FIG. 9A is a Section View 9A-9A of FIG. 9 and FIG. 9B is a Section View 9B-9B of FIG. 9, each Section View showing the plasma-disc 901 located on the surface of substrate 902 with bottom y-electrode 903 and bottom x-conductive pad 904*a*, inter-pixel light barrier 907, and luminescent substance 906. The plasma-disc 901 is attached to the substrate 902 with bonding material 905. Also shown is y-conductive pad 903*a* and y-electrode via 903*b* connected to y-electrode 903. Also shown is x-conductive pad 904*a*. The pads 903*a* and 904*a* are in contact with the plasma-disc 901. FIG. 9C shows x-electrode 904 with x-conductive pad 904*a* and y-conductive pad 903*a* with y-electrode via 903*b* on the substrate 902 with conductive pads 903*a*, 904*a* forming an arc configuration for contact with the plasma-disc 901 (not shown in FIG. 9C) to be positioned on the substrate 902.

Figure 10B:
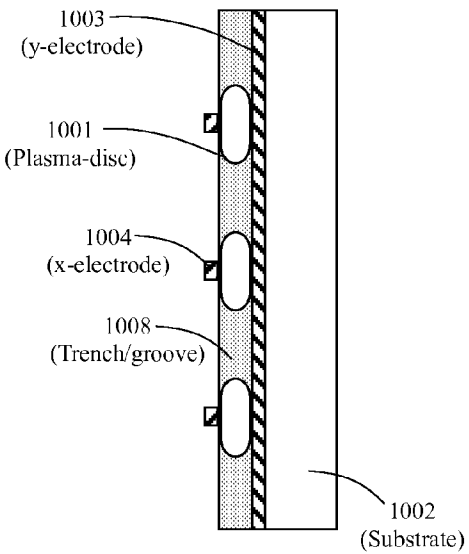
FIG. 10B is a Section View of 10B-10B of FIG. 10.
Figure 10:
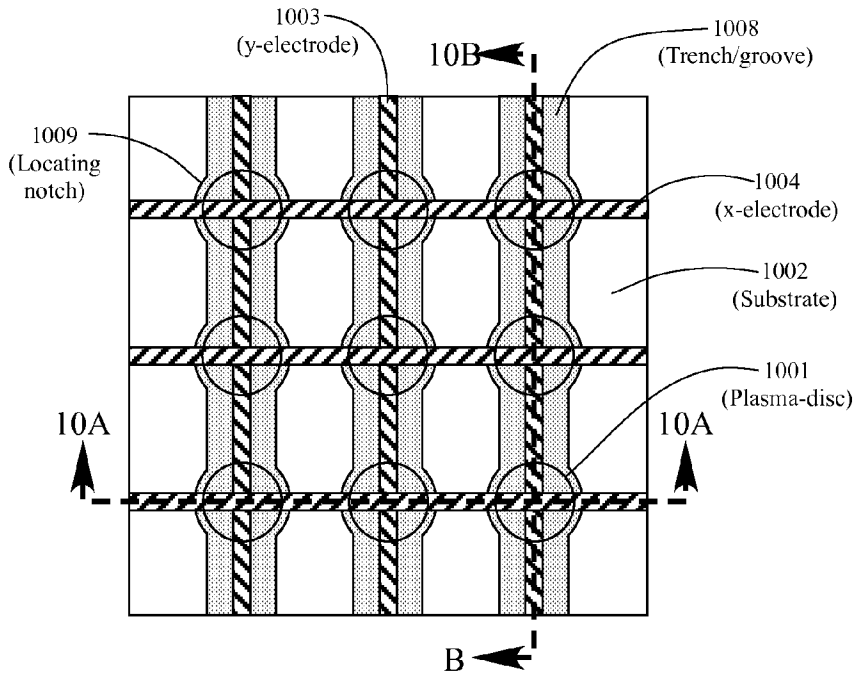
FIG. 10 is a top view of a substrate with multiple x-electrodes, multiple y-electrodes, and trenches or grooves for receiving plasma-discs.
Figure 10A:
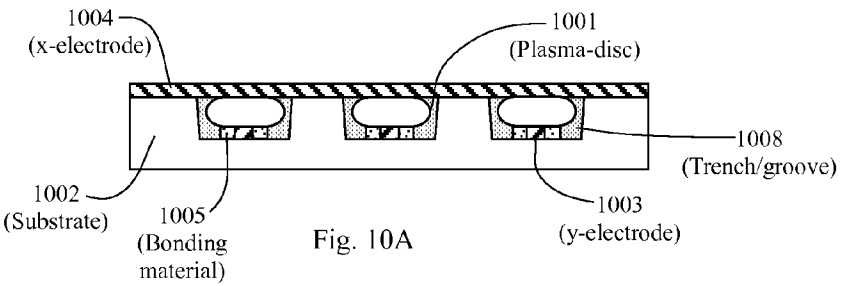
FIG. 10A is a Section View 10A-10A of FIG. 10.

FIG. 10 shows substrate 1002 with y-electrodes 1003 positioned in trenches or grooves 1008, x-electrodes 1004, and plasma-disc locating notches 1009. The plasma-discs 1001 are located within the trenches or grooves 1008 at the positions of the locating notches 1009 as shown. The y-electrodes 1003 and x-electrodes 1004 are crosshatched for identification purposes. FIG. 10A is a Section View 10A-10A of FIG. 10 and FIG. 10B is a Section View 10B-10B of FIG. 10, each Section View showing each plasma-disc 1001 located within a trench or groove 1008 and attached to the substrate 1002 with bonding material 1005. Each plasma-disc 1001 is in contact with a top x-electrode 1004 and a bottom y-electrode 1003. Luminescent substance is not shown, but may be provided near or on each plasma-disc 1001. Inter-pixel light barriers are not shown, but may be provided.

Figure 11B:
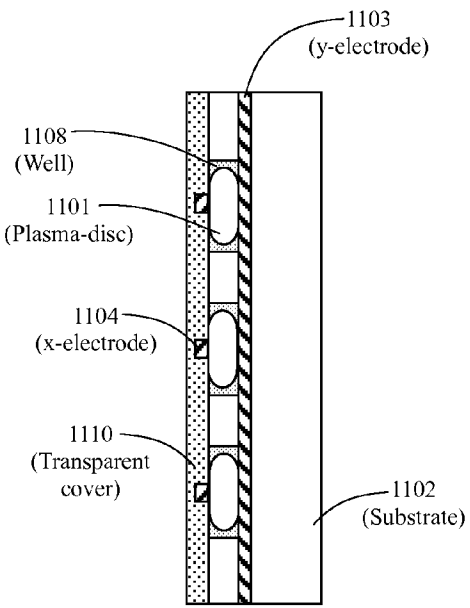
FIG. 11B is a Section View of 11B-11B of FIG. 11.
Figure 11:
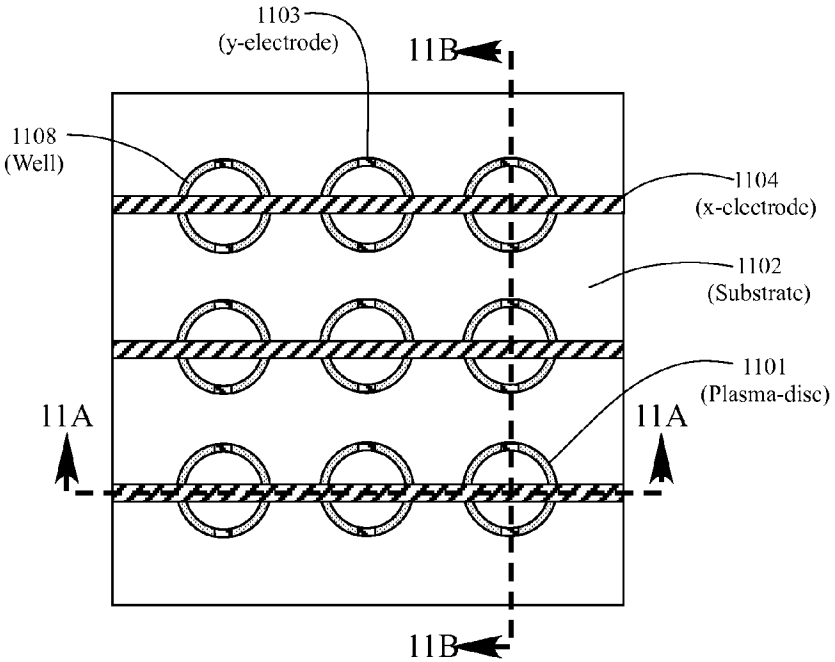
FIG. 11 is a top view of a substrate with multiple x-electrodes, multiple y-electrodes, and multiple wells or cavities for receiving plasma-discs.
Figure 11A:
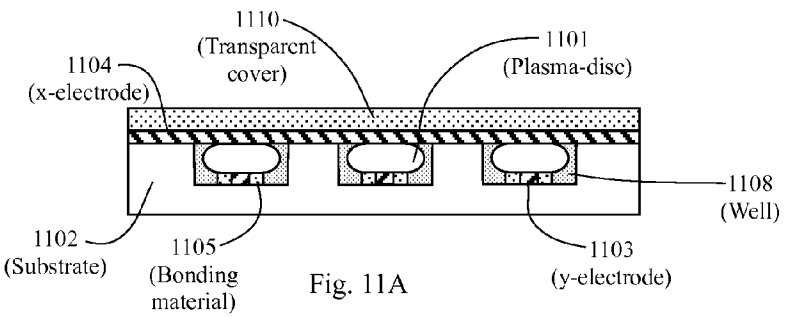
FIG. 11A is a Section View 11A-11A of FIG. 11.

FIG. 11 shows substrate 1102 with y-electrodes 1103, x-electrodes 1104, and plasma-disc wells 1108. The plasma-discs 1101 are located within wells 1108 as shown. The y-electrodes 1103 and x-electrodes 1104 are crosshatched for identification purposes. FIG. 11A is a Section View 11A-11A of FIG. 11 and FIG. 11B is a Section View 11B-11B of FIG. 11, each Section View showing each plasma-disc 1101 located within a well 1108 to substrate 1102 with bonding material 1105. Each plasma-disc 1101 is in contact with a top x-electrode 1104 and a bottom y-electrode 1103. Luminescent substance is not shown, but may be provided near or on each plasma-disc. Inter-pixel light barriers are not shown, but may be provided. The x-electrodes 1104 are positioned under a transparent cover 1110 and may be integrated into the cover.

Figure 12B:
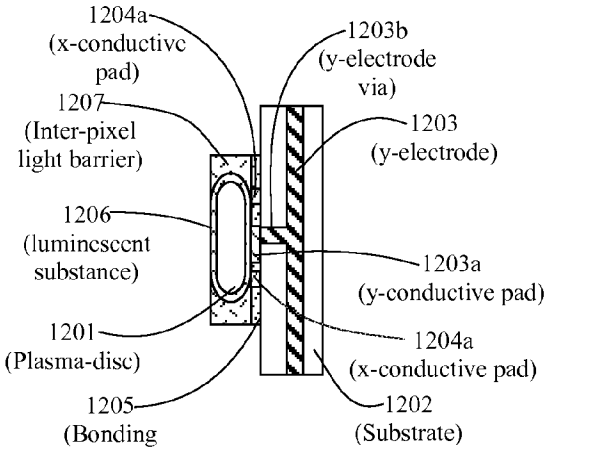
FIG. 12B is a Section View of 12B-12B of FIG. 12.
Figure 12C:
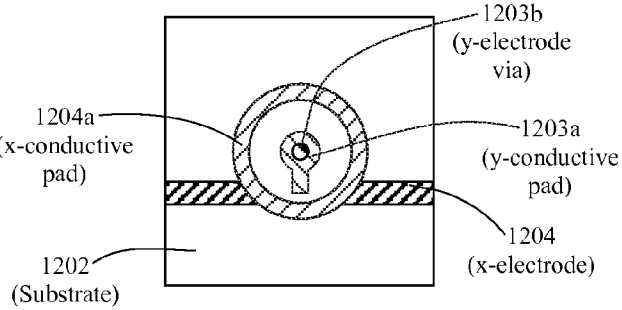
FIG. 12C is a top view of the substrate, electrodes of FIG. 12, and conductive pads being shown in a keyhole and ring configuration, without the plasma-disc.
Figure 12:
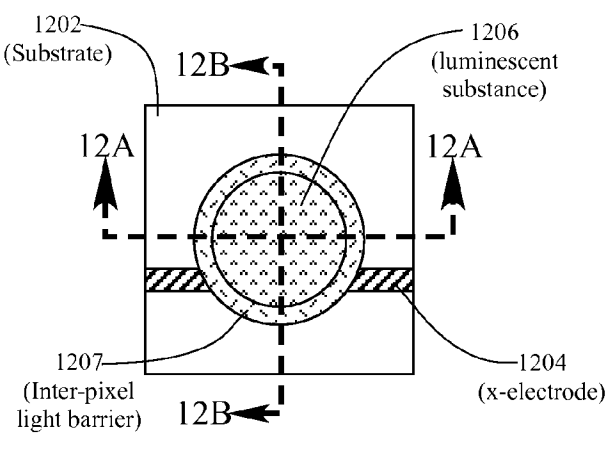
FIG. 12 is a top view of a plasma-disc located on a substrate with one x-electrode.
Figure 12A:
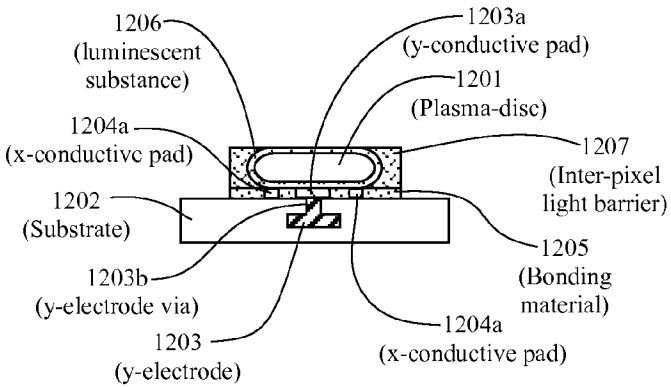
FIG. 12A is a Section View 12A-12A of FIG. 12.

FIGS. 12, 12A, 12B, and 12C are several views of an alternate two-electrode configuration or embodiment in which neither the x-electrode nor the y-electrode extends over the plasma-disc 1201. FIG. 12 shows substrate 1202 with x-electrode 1204, luminescent substance 1206, and inter-pixel light barrier 1207. The x-electrode 1204 is crosshatched for identification purposes. FIG. 12A is a Section View 12A-12A of FIG. 12 and FIG. 12B is a Section View 12B-12B of FIG. 12, each Section View showing the plasma-disc 1201 located on the surface of substrate 1202 with bottom y-electrode 1203 and bottom x-conductive pad 1204*a*, inter-pixel light barrier 1207, and luminescent substance 1206. The plasma-disc 1201 is bonded to the substrate 1202 with bonding material 1205. Also shown is y-conductive pad 1203*a* and via 1203*b* connected to y-electrode 1203. The pads 1203*a* and 1204*a* are in contact with the plasma-disc 1201. FIG. 12C shows x-electrode 1204 with x-conductive pad 1204*a* and y-conductive pad 1203*a* with y-electrode via 1203*b* on the surface 1202. The x-conductive pad 1204*a* forms a ring configuration for contact with the plasma-disc 1201 (not shown) to be positioned on the substrate 1202. The y-conductive pad 1203*a* is shown as a keyhole configuration within the ring configuration and centered within x-conductive pad 1204*a*.

Figure 13B:
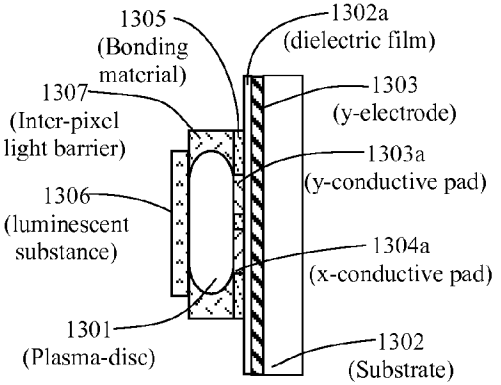
FIG. 13B is a Section View of 13B-13B of FIG. 13.
Figure 13C:
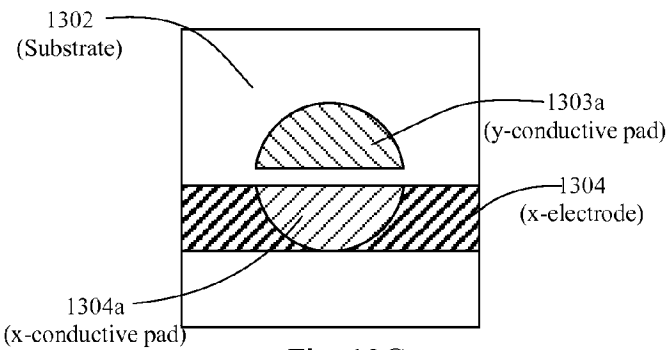
FIG. 13C is a top view of the substrate, electrodes in FIG. 13, and conductive pads in a half moon configuration, without the plasma-disc.
Figure 13:
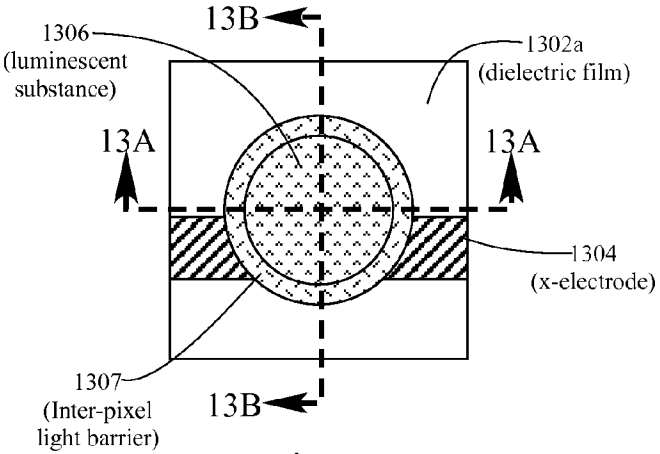
FIG. 13 is a top view of a plasma-disc located on a substrate with one x-electrode.
Figure 13A:
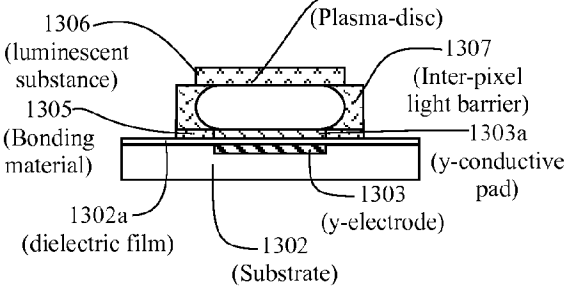
FIG. 13A is a Section View 13A-13A of FIG. 13.

FIGS. 13, 13A, 13B, and 13C are several views of an alternate two-electrode configuration and embodiment in which neither the x-electrode nor the y-electrode extends over the plasma-disc 1301. These Figs. illustrate charge or capacitive coupling. FIG. 13 shows dielectric film or layer 1302*a* on top surface of substrate 1302 (not shown) with x-electrode 1304, luminescent substance 1306, and inter-pixel light barrier 1307. The x-electrode 1304 is crosshatched for identification purposes. FIG. 13A is a Section View 13A-13A of FIG. 13 and FIG. 13B is a Section View 13B-13B of FIG. 13, each Section View showing the plasma-disc 1301 located on the dielectric film or layer 1302*a* with y-electrode 1303 and x-conductive pad 1304*a*, inter-pixel light barrier 1307, and luminescent substance 1306. The plasma-disc 1301 is bonded to the dielectric film 1302*a* with bonding material 1305. Also is substrate 1302 and y-conductive pad 1303*a*, which is capacitively coupled through dielectric film 1302*a* to the y-electrode 1303. FIG. 13C shows the x-electrode 1304, half moon shaped x-conductive pad 1304*a*, and half moon shaped y-conductive pad 1303*a* on the substrate 1302 with the location of the plasma-disc 1301 (not shown) indicated by the semi-circular pads 1303*a* and 1304*a*. In this configuration and embodiment, x-electrode 1304 is on the top of the substrate 1302 and y-electrode 1303 is embedded in substrate 1302. Also in this embodiment, substrate 1302 is formed from a material with a dielectric constant sufficient to allow charge coupling from 1303 to 1303*a*. Also to promote good capacitive coupling, pad 1303*a* is large and the gap between 1303*a* and 1303 is small. Conductive pads 1303*a* and 1304*a* may be selected from a reflective metal such as copper or silver or coated with a reflective material. This will help direct light out of the plasma-disc and increase efficiency. Reflective conductive pads may be used in any configuration in which the electrodes are attached to the plasma-disc from the back of the substrate. The larger the area of the conductive pad, the greater the advantage achieved by reflection.

Figure 14B:
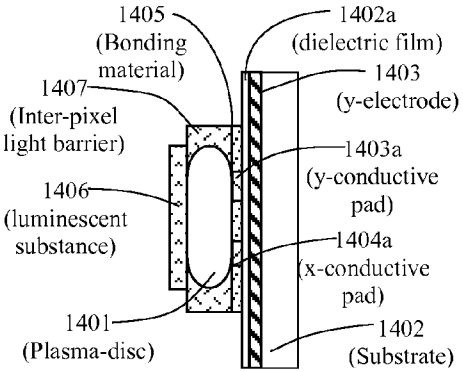
FIG. 14B is a Section View of 14B-14B of FIG. 14.
Figure 14C:
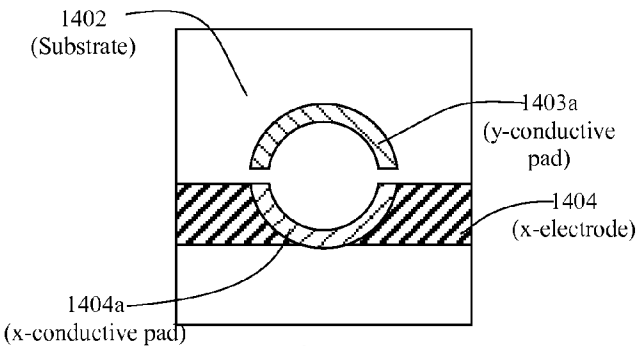
FIG. 14C is a top view of the substrate, electrodes in FIG. 14, and arc shaped conductive pads, without the plasma-disc.
Figure 14:
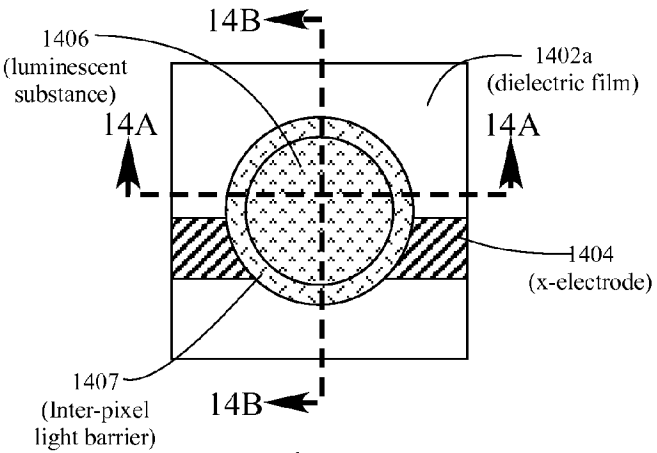
FIG. 14 is a top view of a plasma-disc located on a substrate with one x-electrode.

FIGS. 14, 14A, 14B, and 14C are several views of an alternate two-electrode configuration and embodiment. FIG. 14 shows dielectric film or layer 1402*a* on the top surface of substrate 1402 (not shown) with x-electrode 1404, luminescent substance 1406, and inter-pixel light barrier 1407. The x-electrode 1404 is crosshatched for identification purposes.

Figure 14A:
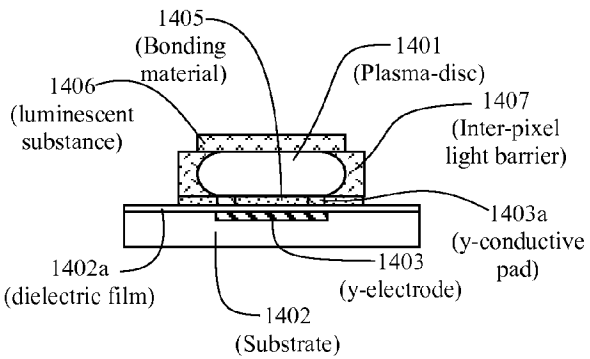
FIG. 14A is a Section View 14A-14A of FIG. 14.

FIG. 14A is a Section View 14A-14A of FIG. 14 and FIG. 14B is a Section View 14B-14B of FIG. 14, each Section View showing the plasma-disc 1401 located on the surface of dielectric film 1402*a* with bottom y-electrode 1403, bottom x-conductive pad 1404*a*, inter-pixel light barrier 1407, and luminescent substance 1406. The plasma-disc 1401 is bonded to the dielectric film 1402*a* with bonding material 1405. Also shown are substrate 1402 and y-conductive pad 1403*a*, which is capacitively coupled through the dielectric film 1402*a* to the y-electrode 1403. FIG. 14C shows x-electrode 1404 and conductive pads 1403*a* and 1404*a* on the substrate 1402. The conductive pads 1403*a* and 1404*a* form an arc configuration for contact with the plasma-disc 1401 (not shown in FIG. 14C). FIG. 14 differs from FIG. 13 in the shape of the conductive pads. This can be seen in FIG. 14C. Y-conductive pad 1403*a* is shaped like a 'C' and x-conductive pad 1404 is also formed as a 'C' shape. This configuration promotes a positive column discharge.

Figure 15B:
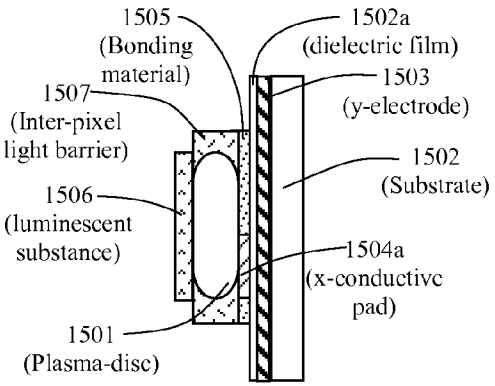
FIG. 15B is a Section View of 15B-15B of FIG. 15.
Figure 15C:
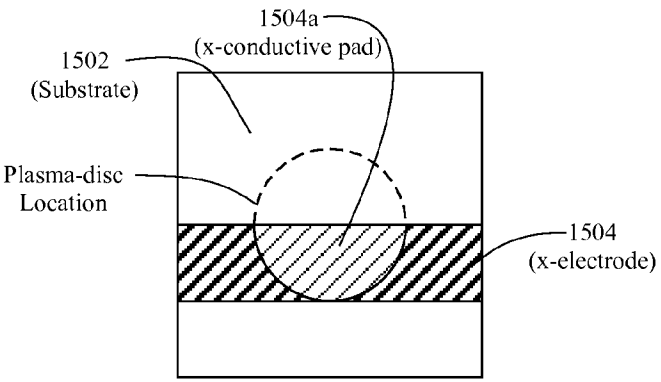
FIG. 15C is a top view of the substrate, electrode in FIG. 15, and conductive pad in a half moon configuration, with the plasma-disc location shown in broken lines.
Figure 15:
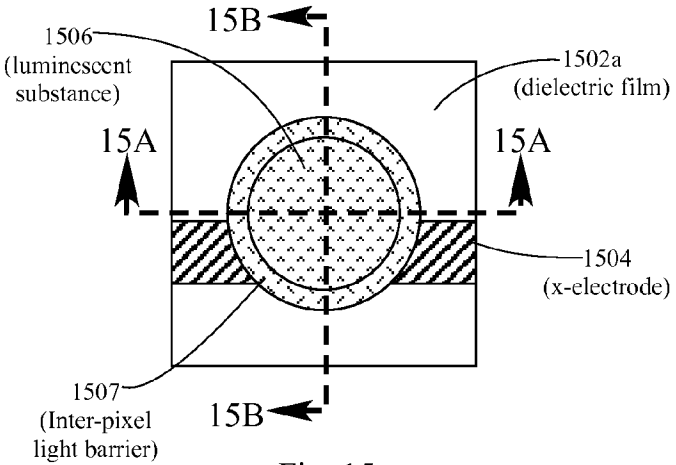
FIG. 15 is a top view of a plasma-disc located on a substrate with one x-electrode.

FIGS. 15, 15A, 15B, and 15C are several views of an alternate two-electrode configuration and embodiment. These Figs. illustrate charge or capacitive coupling. FIG. 15 shows dielectric film or layer 1502*a* on the surface of substrate 1502 (not shown) with bottom x-electrode 1504, luminescent substance 1506 and inter-pixel light barrier 1507. The x-electrode 1504 is crosshatched for identification purposes.

Figure 15A:
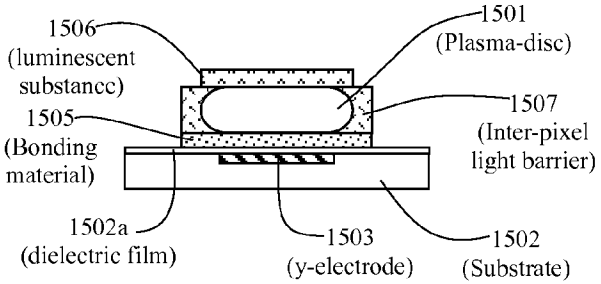
FIG. 15A is a Section View 15A-15A of FIG. 15.

FIG. 15A is a Section View 15A-15A of FIG. 15 and FIG. 15B is a Section View 15B-15B of FIG. 15, each Section View showing the plasma-disc 1501 located on the surface of dielectric film 1502*a* with bottom y-electrode 1503 and bottom x-electrode 1504, inter-pixel light barrier 1507, and luminescent substance 1506. The plasma-disc 1501 is bonded to the dielectric film 1502*a* with bonding material 1505. The plasma-disc 1501 is capacitively coupled through dielectric film 1502*a* and bonding material 1505 to y-electrode 1503. Also shown is substrate 1502. FIG. 15C shows the x-electrode 1504 with half moon shaped x-conductive pad 1504*a* on the substrate 1502 with the location of the plasma-disc 1501 (not shown) indicated with broken lines. FIGS. 16, 16A, 16B, and 16C are several views of an alternate two-electrode configuration and embodiment.

Figure 16B:
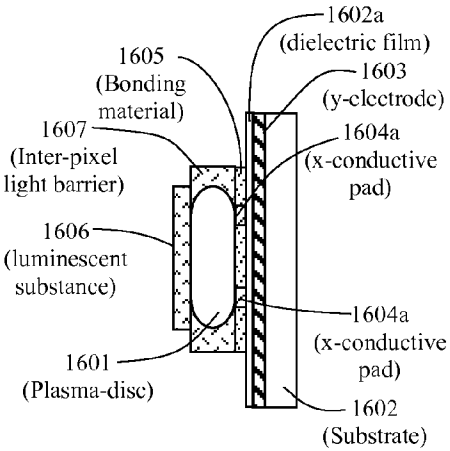
FIG. 16B is a Section View of 16B-16B of FIG. 16.
Figure 16C:
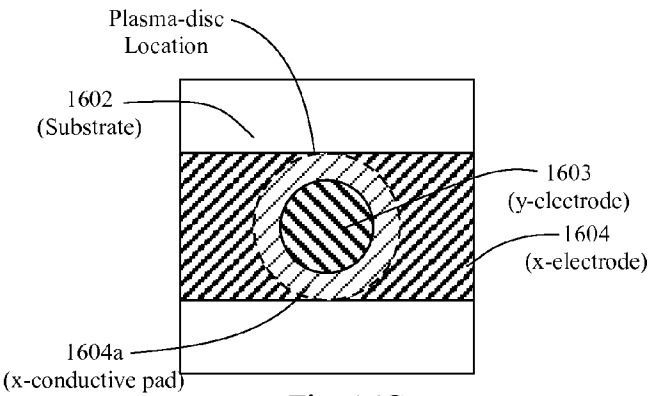
FIG. 16C is a top view of the substrate, electrodes in FIG. 16, and conductive pads in a bulls-eye configuration, with the plasma-disc location shown in broken lines.
Figure 16:
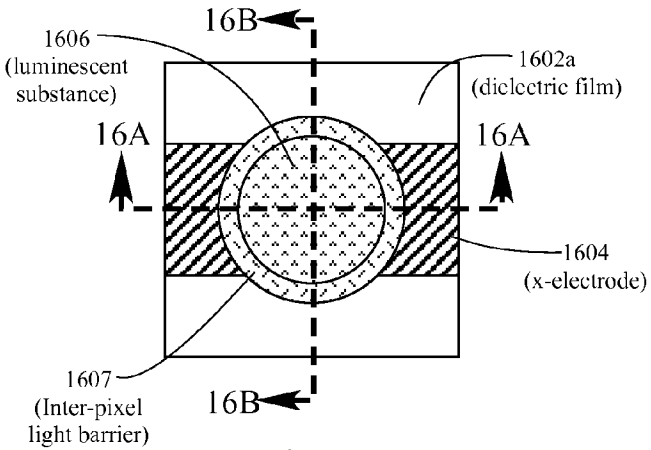
FIG. 16 is a top view of a plasma-disc located on a substrate with one x-electrode.
Figure 16A:
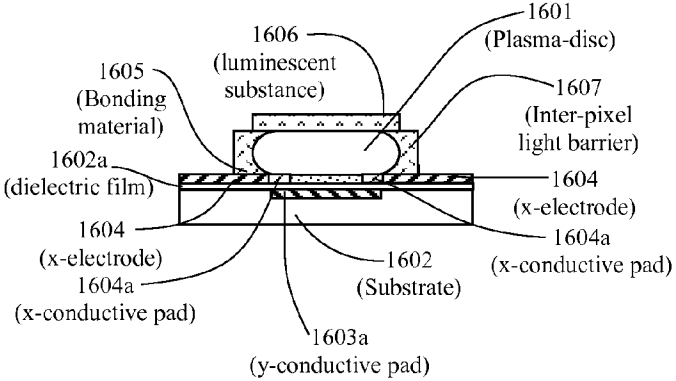
FIG. 16A is a Section View 16A-16A of FIG. 16.

FIG. 16 shows dielectric film or layer 1602*a* on substrate 1602 (not shown) with bottom x-electrode 1604, luminescent substance 1606, and inter-pixel light barrier 1607. The x-electrode 1604 is crosshatched for identification purposes. FIG. 16A is a Section View 16A-16A of FIG. 16 and FIG. 16B is a Section View 16B-16B of FIG. 16, each Section View showing the plasma-disc 1601 located on the surface of dielectric film 1602*a* with bottom y-electrode 1603 and bottom x-conductive pad 1604*a*, inter-pixel light barrier 1607, and luminescent substance 1606. The plasma-disc 1601 is bonded to the dielectric film 1602*a* with bonding material 1605. FIG. 16C shows the x-electrode 1604 with x-conductive pad 1604*a* and y-electrode 1603 in a bulls-eye configuration on the substrate 1602 with the location of the plasma-disc 1601 (not shown) indicated with broken lines. FIG. 16 differs from FIG. 15 in the shape of the x- and y-electrodes. This can be seen in FIG. 16C. The x-electrode 1604 is extended along the top surface of substrate 1602. A spherical hole is cut in x-electrode 1604 to allow capacitive coupling of y-electrode 1603 to the plasma-disc. The y-electrode 1603 is orthogonal to x-electrode 1604.

Figure 17B:
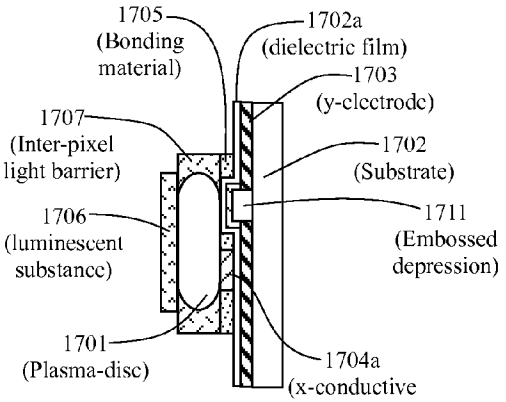
FIG. 17B is a Section View of 17B-17B of FIG. 17.
Figure 17C:
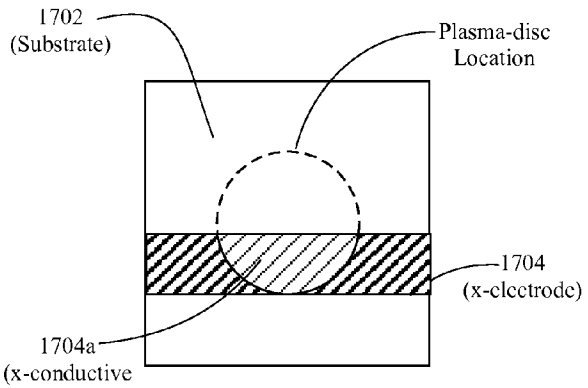
FIG. 17C is a top view of the substrate, electrode in FIG. 17, and conductive pad in a half moon configuration, with the plasma-disc location shown in broken lines.
Figure 17:
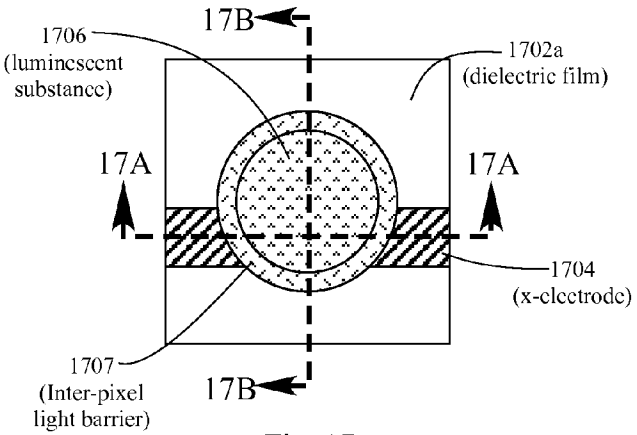
FIG. 17 is a top view of a plasma-disc located on a substrate with one x-electrode.
Figure 17A:
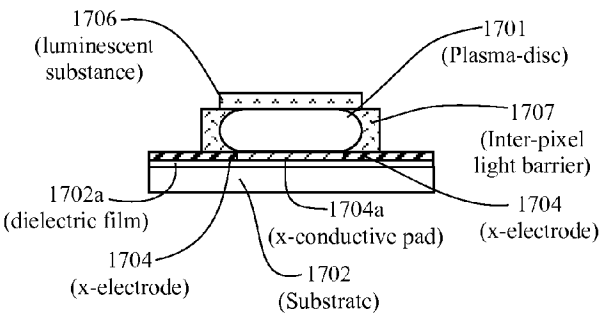
FIG. 17A is a Section View 17A-17A of FIG. 17.

FIGS. 17, 17A, 17B, and 17C are several views of an alternate two-electrode configuration and embodiment. FIG. 17 shows dielectric film or layer 1702*a* on substrate 1702*a* on substrate 1702 (not shown) with bottom x-electrode 1704, luminescent substance 1706, and inter-pixel light barrier 1707. The x-electrode 1704 is crosshatched for identification purposes. FIG. 17A is a Section View 17A-17A of FIG. 17 and FIG. 17B is a Section View 17B-17B of FIG. 17, each Section View showing the plasma-disc 1701 located on the surface of dielectric film or layer 1702*a* with bottom y-electrode 1703, bottom x-electrode 1704 and x-conductive pad 1704*a*, inter-pixel light barrier 1707, and luminescent substance 1706. The plasma-disc 1701 is bonded to the dielectric layer 1702*a* with bonding material 1705. FIG. 17C shows the electrode 1704 with half moon shaped conductive pad 1704*a* on the substrate 1702 with the location of the plasma-disc 1701 (not shown) indicated with broken lines. FIG. 17 serves to illustrate that the y-electrode 1703 may be applied to the top of substrate 1702 as shown in FIG. 17B. Dielectric layer or film 1702*a* is applied over the substrate and the y-electrode. The x-electrode 1704 is applied over the dielectric layer to make direct contact with plasma-disc 1701. In this embodiment substrate 1702 contains embossed depression 1711 to bring y-electrode 1703 closer to the surface of the plasma-disc and in essentially the same plane as x-conductive pad 1704*a*.

Figure 18B:
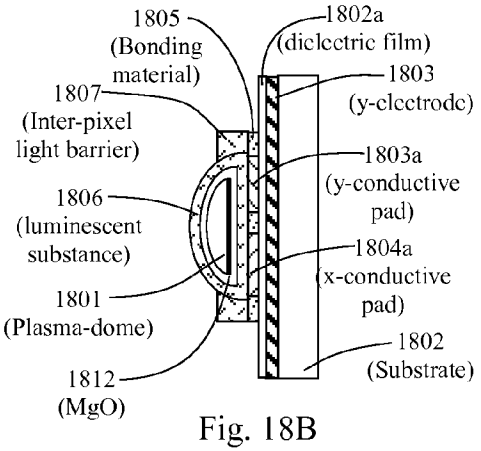
FIG. 18B is a Section View of 18B-18B of FIG. 18.
Figure 18C:
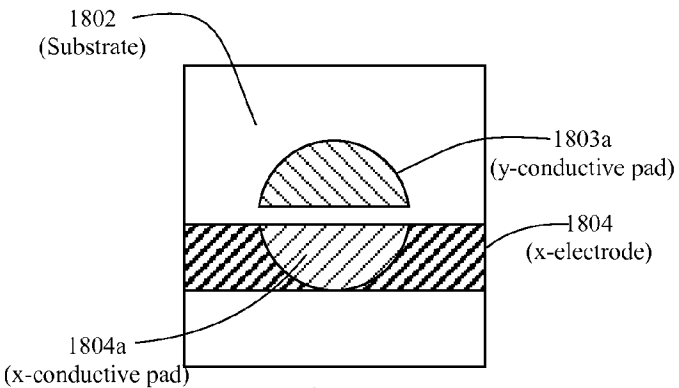
FIG. 18C is a top view of the substrate, electrode in FIG. 17, and conductive pads in a half moon configuration, with the without the plasma-dome.
Figure 18:
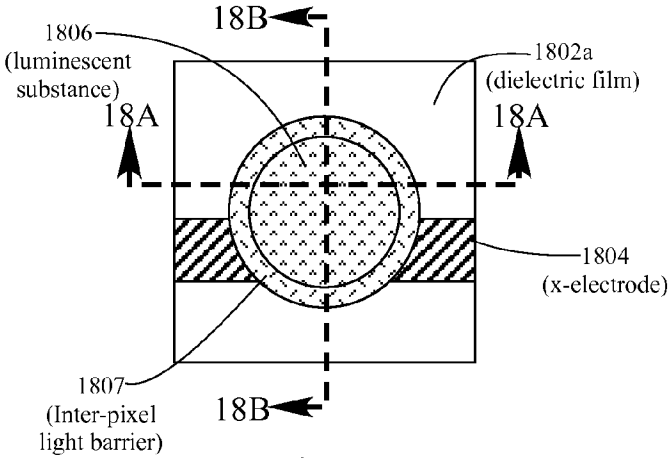
FIG. 18 is a top view of a plasma-dome located on a substrate with one x-electrode.
Figure 18A:
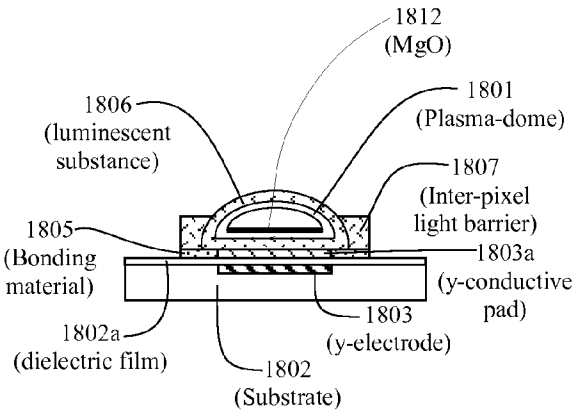
FIG. 18A is a Section View 18A-18A of FIG. 18.

FIG. 18 shows dielectric film or layer 1802*a* substrate 1802 (not shown) with bottom x-electrode 1804, luminescent substance 1806, and inter-pixel light barrier 1807. The x-electrode 1804 is crosshatched for identification purposes. FIG. 18A is a Section View 18A-18A of FIG. 18 and FIG. 18B is a Section View 18B-18B of FIG. 18, each Section View showing a plasma-dome 1801 located on the surface of dielectric 1802*a* with connecting bottom y-electrode 1803, inter-pixel light barrier 1807, and luminescent substance 1806. The plasma-dome 1801 is bonded to the substrate 1802*a* with bonding material 1805. Also shown are substrate 1802, y-conductive pad 1803*a* and x-conductive pad 1804*a*. Magnesium oxide 1812 is shown on the inside of the plasma-dome 1801. FIG. 18C shows the electrode 1804 with half moon shaped x-conductive pad 1804*a* and half moon shaped y-conductive pad 1803*a* on the substrate 1802 with the location of the plasma-dome 1801 (not shown) by semi-circular pads 1804*a* and 1803*a*.

Figure 19:
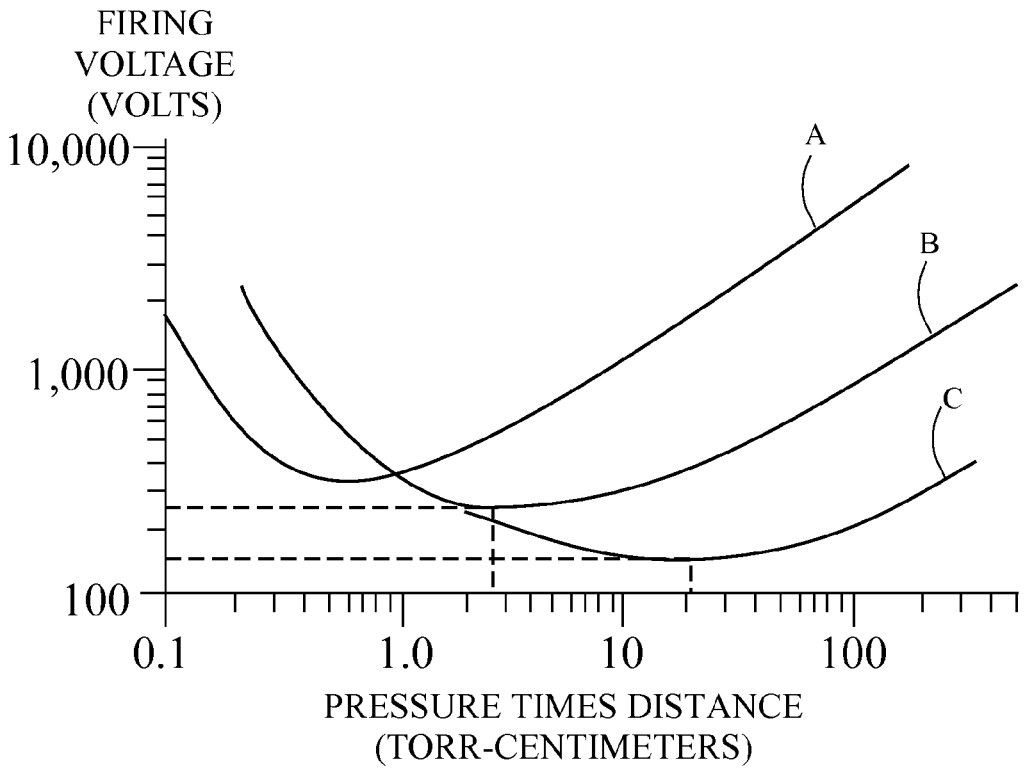
FIG. 19 shows hypothetical Paschen curves for three typical hypothetical gases.

FIG. 19 shows a Paschen curve. The plasma-disc is filled with an ionizable gas. Each gas composition or mixture has a unique curve associated with it, called the Paschen curve as illustrated in FIG. 19. The Paschen curve is a graph of the breakdown voltage verses the product of the pressure times the discharge distance. It is usually given in Torr-centimeters. As can be seen from the illustration in FIG. 19, the gases typically have a saddle region in which the voltage is at a minimum. It is desirable to choose pressure and gas discharge distance in the saddle region to minimize the voltage. In one embodiment of this invention, the inside of the plasma-disc contains a secondary electron emitter. Secondary electron emitters lower the breakdown voltage of the gas and provide a more efficient discharge. Plasma displays traditionally use magnesium oxide for this purpose, although other materials may be used including other Group Ha oxides, rare earth oxides, lead oxides, aluminum oxides, and other materials. Also non-oxides may be used such as rare earth borides. Mixtures of secondary electron emitters may be used. It may also be beneficial to add luminescent substances such as phosphor to the inside or outside of the plasma-disc. In one embodiment and mode hereof, the plasma-disc material is a metal or metalloid oxide with an ionizable gas of 99.99% atoms of neon and 0.01% atoms of argon or xenon for use in a monochrome PDP. Examples of shell materials include glass, silica, aluminum oxides, zirconium oxides, and magnesium oxides. In another embodiment, the plasma-disc contains luminescent substances such as phosphors selected to provide different visible colors including red, blue, and green for use in a full color PDP. The metal or metalloid oxides are typically selected to be transmissive to photons produced by the gas discharge especially in the UV range.

In one embodiment, the ionizable gas is selected from any of several known combinations that produce UV light including pure helium, helium with up to 1% atoms neon, helium with up to 1% atoms of argon and up to 15% atoms nitrogen, and neon with up to 15% atoms of xenon or argon. For a color PDP, red, blue, and/or green light-emitting luminescent substance may be applied to the interior or exterior of the plasma-disc. The luminescent substance may be incorporated into the shell of the plasma-disc. The application of luminescent substance to the exterior of the plasma-disc may comprise a slurry or tumbling process with heat curing, typically at low temperatures. Infrared curing can also be used. The luminescent substance may be applied by other methods or processes such as spraying, brushing, ink jet, dipping, spin coating and so forth. Thick film methods such as screen-printing may be used. Thin film methods such as sputtering and vapor phase deposition may be used. The luminescent substance may be applied externally before or after the plasma-disc is attached to the PDP substrate. The internal or external surface of the plasma-disc may be partially or completely coated with luminescent substance. In one embodiment the external surface is completely coated with luminescent substance. As discussed hereinafter, the luminescent substance may be organic and/or inorganic. The bottom or back of the plasma-disc may be coated with a suitable light reflective material in order to reflect more light toward the top or front viewing direction of the plasma-disc. The light reflective material may be applied by any suitable process such as spraying, brushing, ink jet, dipping, spin coating, and so forth. Thick film methods such as screen-printing may be used. Thin film methods such as sputtering and vapor phase deposition may be used. The light reflective material may be applied over the luminescent substance or the luminescent substance may be applied over the light reflective material. In one embodiment, the electrodes are made of or coated with a light reflective material such that the electrodes also may function as a light reflector.

Plasma-Dome

Figure 20A:
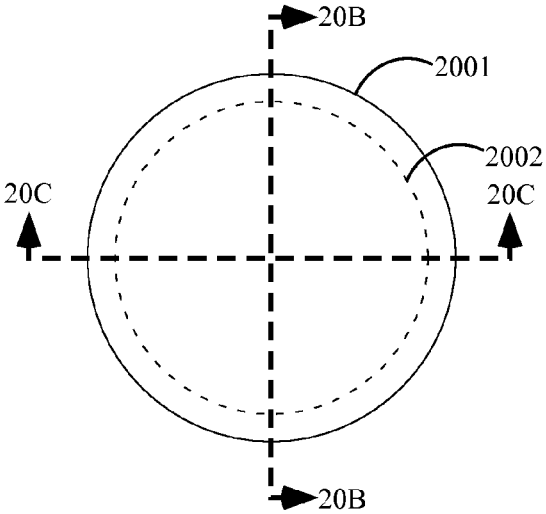
FIG. 20A is a top view of a plasma-dome with one flat side.
Figure 20B:
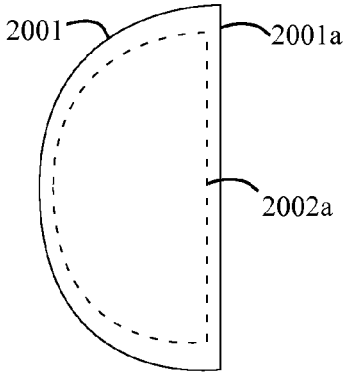
FIG. 20B is a sectional 20B-20B view of FIG. 20.
Figure 20C:
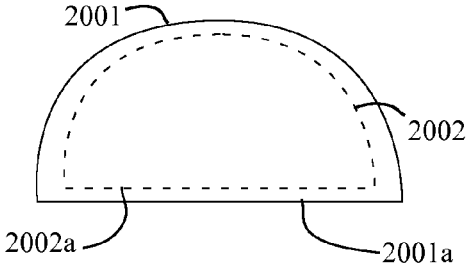
FIG. 20C is a sectional 20C-20C view of FIG. 20.

A plasma-dome is shown in FIGS. 20A, 20B, and 20C. FIG. 20A is a top view of a plasma-dome showing an outer shell wall 2001 and an inner shell wall 2002. FIG. 20B is a section 20B-20B view of FIG. 20A showing a flattened outer wall 2001*a* and flattened inner wall 2002*a*. FIG. 20C is a section 20C-20C view of FIG. 20A.

Figure 21A:
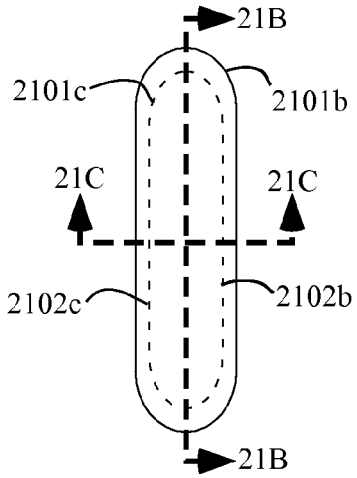
FIG. 21A is a top view of a plasma-dome with multiple flat sides.
Figure 21B:
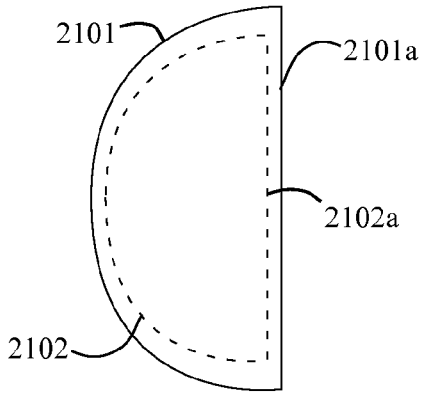
FIG. 21B is a sectional 21B-21B view of FIG. 21
Figure 21C:
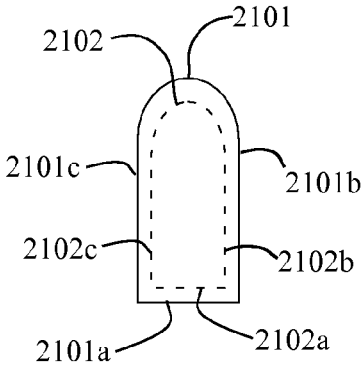
FIG. 21C is a sectional 21C-21C view of FIG. 21.

FIG. 21A is a top view of a plasma-dome with flattened inner shell walls 2102*b* and 2102*c* and flattened outer shell wall 2101*b* and 2101*c*. FIG. 21B is a section 21B-21B view of FIG. 21A showing flattened outer wall 2101*a* and flattened inner wall 2102*a* with a dome having outer wall 2101 and inner wall 2102. FIG. 21C is a section 21C-21C view of FIG. 21A. In forming a PDP, the dome portion may be positioned within the substrate with the flat side up in the viewing direction or with the dome portion up in the viewing direction.

Plasma-Disc

Figure 22A:
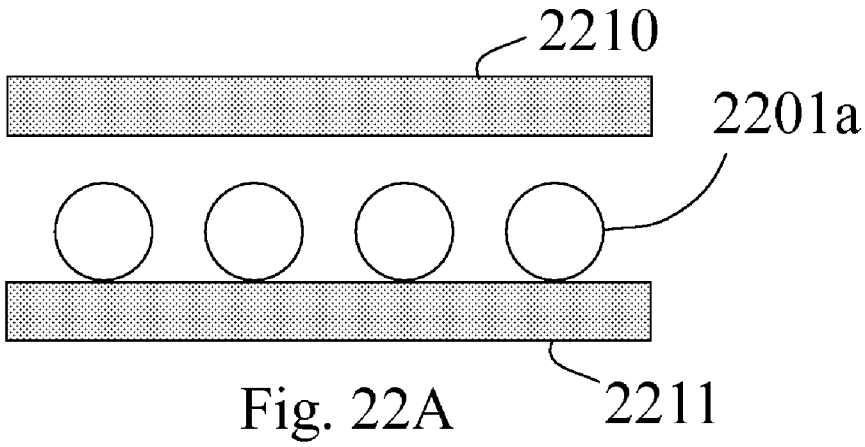
FIGS. 22A, 22B, and 22C show process steps for making plasma-discs.
Figure 22B:
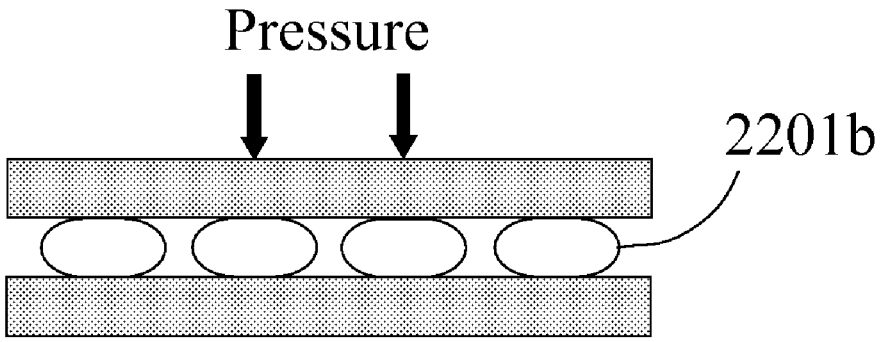
Figure 22C:
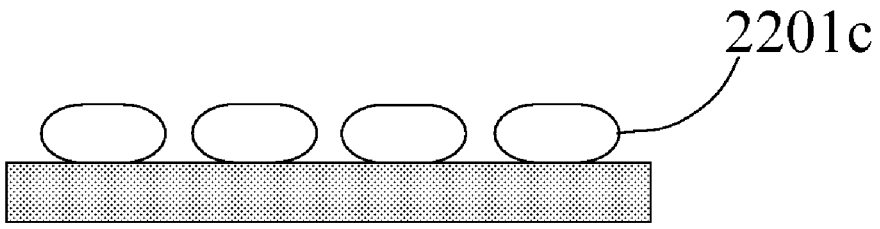

A plasma shell with two substantially flattened opposite sides, i.e., top and bottom is called a plasma-disc. As used herein, a flat side is a side having a flat external surface. A plasma-disc may be formed by flattening a plasma-sphere on one or more pairs of opposing sides such as top and bottom. The flattening of a plasma-sphere to form a plasma-disc may be done while the sphere shell is at an ambient temperature or at elevated softening temperature below the melting temperature. The flat viewing surface in a plasma-disc tends to increase the overall luminous efficiency of a PDP. The opposing flat base is positioned on the PDP substrate typically in contact with electrodes. Plasma-discs may be produced while the plasma-sphere is at an elevated temperature below its melting point. While the plasma-sphere is at the elevated temperature, a sufficient pressure or force is applied with member 2210 to flatten the spheres between members 2210 and 2211 into disc shapes with flat top and bottom as illustrated in FIGS. 22A, 22B, and 22C. FIG. 22A shows a plasma-sphere. FIG. 22B shows uniform pressure applied to the plasma-sphere to form a flattened plasma-disc 2201*b*. Heat can be applied during the flattening process such as by heating members 2210 and 2211. FIG. 22C shows the resultant flat plasma-disc 2201C. One or more luminescent substances can be applied to the plasma-disc. Like a coin that can only land "heads" or "tails", a plasma-disc with a flat top and flat bottom may be applied to a substrate in one of two flat positions. However, in some embodiments, the plasma-disc may be positioned on edge on or within the substrate. The geometry of the plasma-disc may be circular, oval, elliptical, square, rectangular, pentagonal, hexagonal, trapezoidal, rhomboid, triangular, or any other geometric shape. FIGS. 23 to 34 show plasma-discs of various geometric shapes with opposing flat sides. As noted above, a flat side is defined as a side having a flat external surface.

Figure 23A:
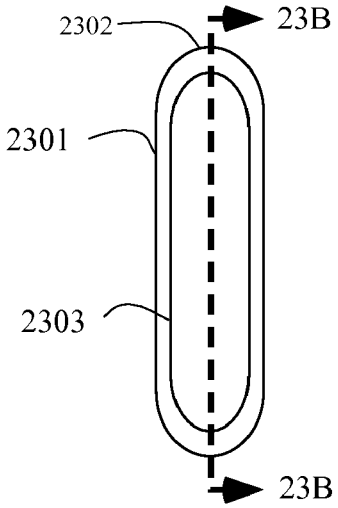
Figure 23B:
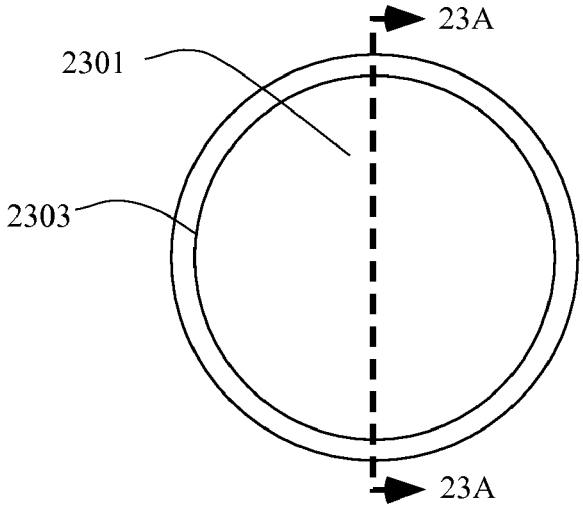

FIGS. 23A and 23B show a plasma-disc with opposing flat circular sides 2301. FIG. 23A is a right section 23B-23B view of FIG. 23B. FIG. 23B is a section 23A-23A view of either flat circular side 2301 of FIG. 23A. As shown in FIG. 23A, the ends 2302 are rounded and do not have corners. The inside wall surface 2303 of the hollow plasma-disc is shown as a broken line in both FIGS. 23A and 23B.

Figure 24A:
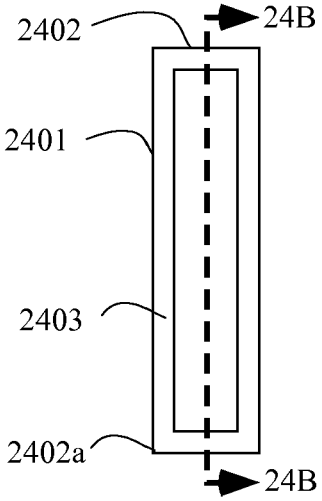
Figure 24B:
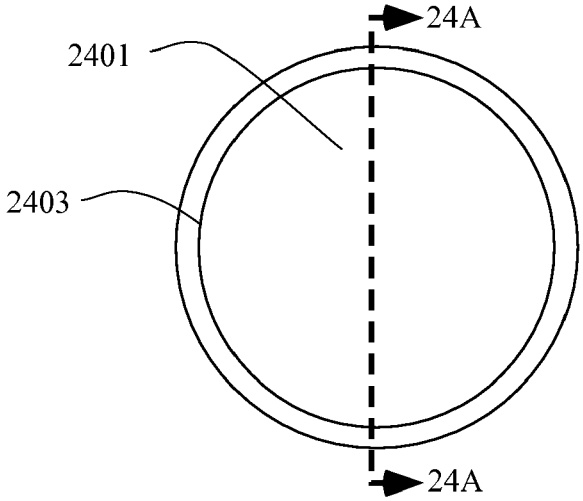

FIGS. 24A and 24B show a plasma-disc with opposing flat circular sides 2401. FIG. 24A is a right section 24B-24B view of FIG. 24B. FIG. 24B is a section 24A-24A view of either flat circular side 2401 of FIG. 24A. As shown in FIG. 24A, the ends 2402 are flat with corners 2402*a*. The inside wall surface 2403 of the hollow plasma-disc is shown as a broken line in both FIGS. 24A and 24B.

Figure 25A:
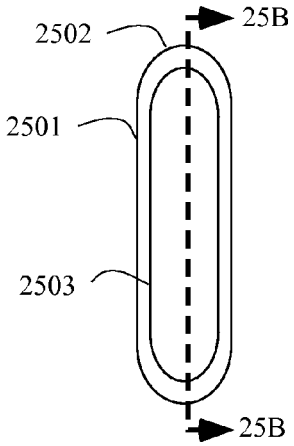
Figure 25B:
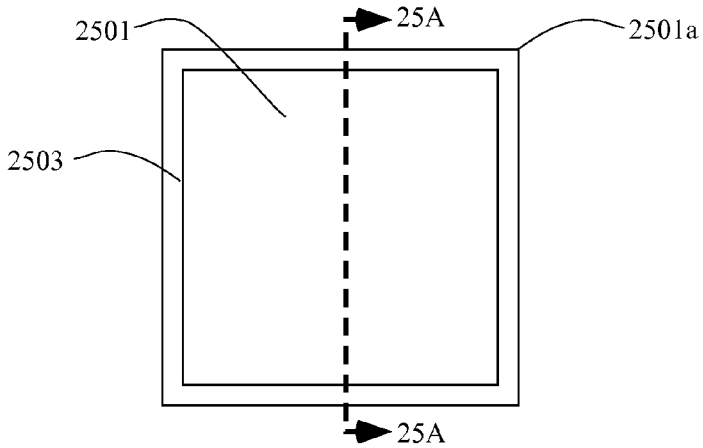

FIGS. 25A and 25B show a plasma-disc with opposing flat square sides 2501. FIG. 25A is a right section 25B-25B view of FIG. 25B. FIG. 25B is a section 25A-25A view of either flat square side 2501 of FIG. 25A. As shown in FIG. 25A, the ends 2502 are rounded and do not have corners. The inside wall surface 2503 of the hollow plasma-disc is shown as a broken line in both FIGS. 25A and 25B. The sides 2501 may be a rectangular shape instead of a square shape.

Figure 26A:
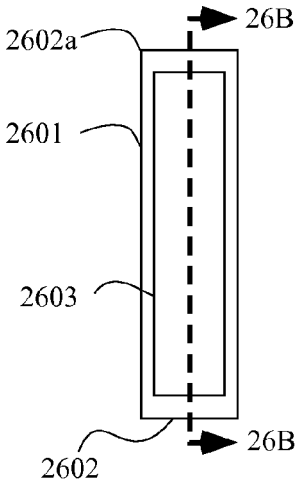
Figure 26B:
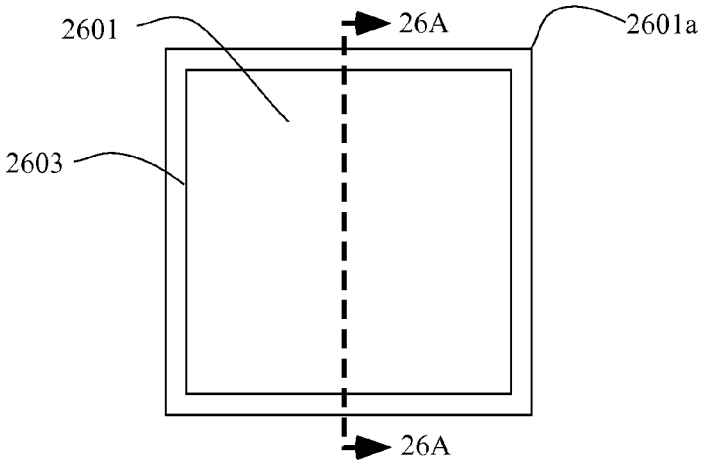

FIGS. 26A and 26B show a plasma-disc with opposing flat square sides 2601. FIG. 26A is a right section 26B-26B view of FIG. 26B. FIG. 26B is a section 26A-26A view of either flat square side 2601 of FIG. 26A. As shown in FIG. 26A, the ends 2602 are flat with corners 2602*a*. The inside wall surface 2603 of the hollow plasma-disc is shown as a broken line in both FIGS. 26A and 26B. The sides 2601 may be a rectangular shape instead of a square shape.

Figure 27A:
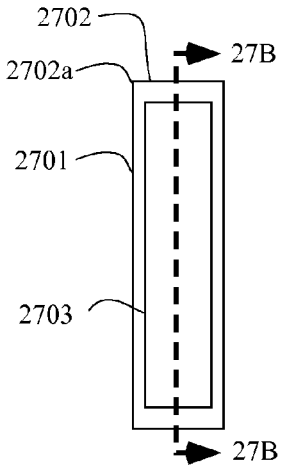
Figure 27B:
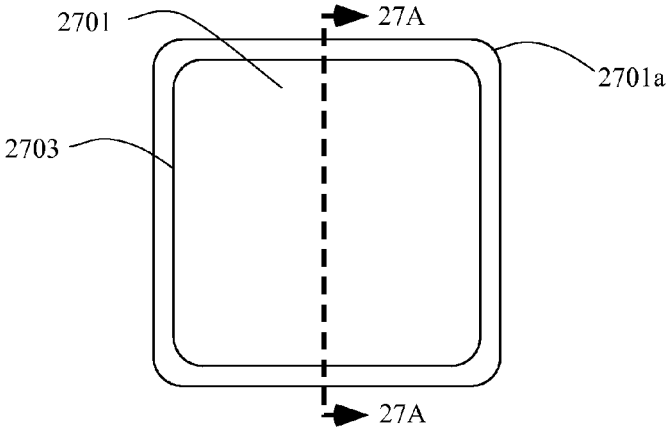

FIGS. 27A and 27B show a plasma-disc with opposing flat square sides 2701 with rounded corners 2701*a*. FIG. 27A is a right section 27B-27B view of FIG. 27B. FIG. 27B is a section 27A-27A view of either flat square side 2701 of FIG. 27A. As shown in FIG. 27A, the ends 2702 are flat and there are corners 2702*a*. The inside wall surface 2703 of the hollow plasma-disc is shown as a broken line in both FIGS. 27A and 27B. The sides 2701 may be rectangular shape instead of a square shape.

Figure 28A:
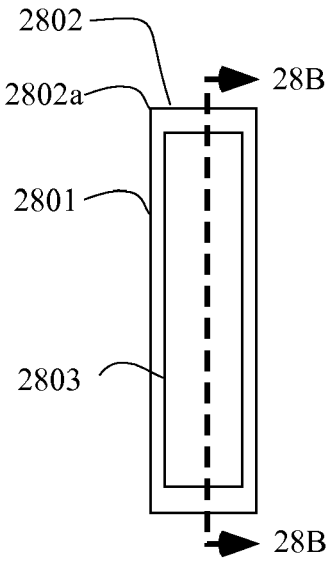
Figure 28B:
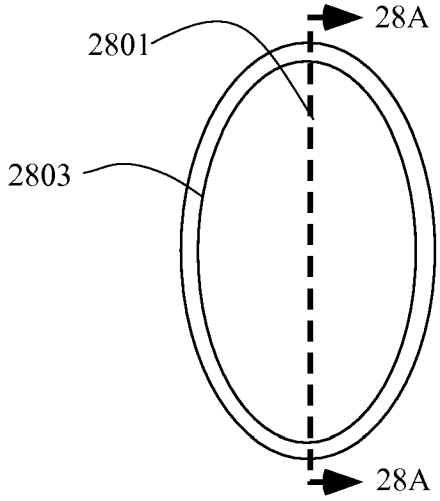

FIGS. 28A and 28B show a plasma-disc with opposing flat oval sides 2801. FIG. 28A is a right section 28B-28B view of FIG. 28B. FIG. 28B is a section 28A-28A view of either flat oval side 2801 of FIG. 28A. As shown in FIG. 28A, the ends 2802 are flat with corners 2802*a*. The inside wall surface 2803 of the hollow plasma-disc is shown as a broken line in both FIGS. 28A and 28B. The sides 2801 may be elliptical instead of oval.

Figure 29A:
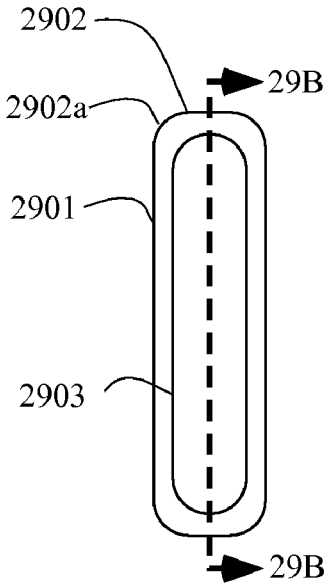
Figure 29B:
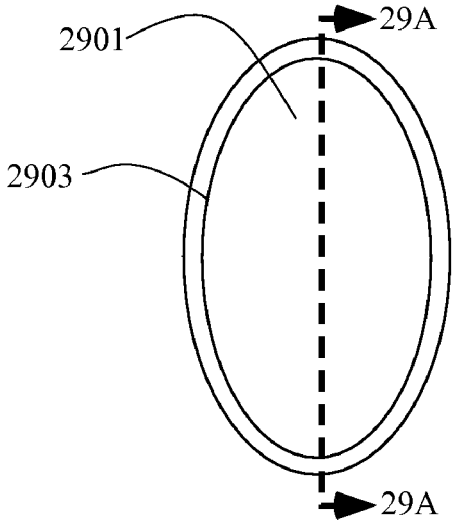

FIGS. 29A and 29B show a plasma-disc with opposing flat oval sides 2901. FIG. 29A is a right section 29B-29B view of FIG. 29B. FIG. 29B is a section 29A-29A view of either flat oval side 2901 of FIG. 29A. As shown in FIG. 29A, the ends 2902 are flat and have rounded corners 2902*a*. The inside wall surface 2903 of the hollow plasma-disc is shown as a broken line in both FIGS. 29A and 29B. The sides 2901 may be elliptical instead of oval.

Figure 30A:
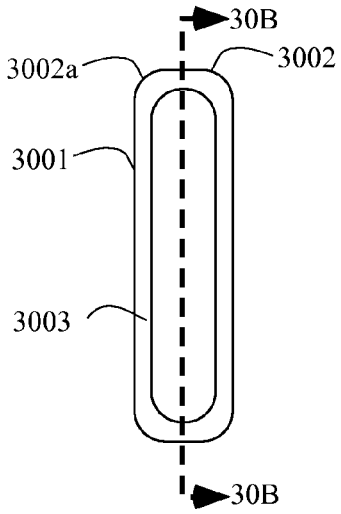
Figure 30B:
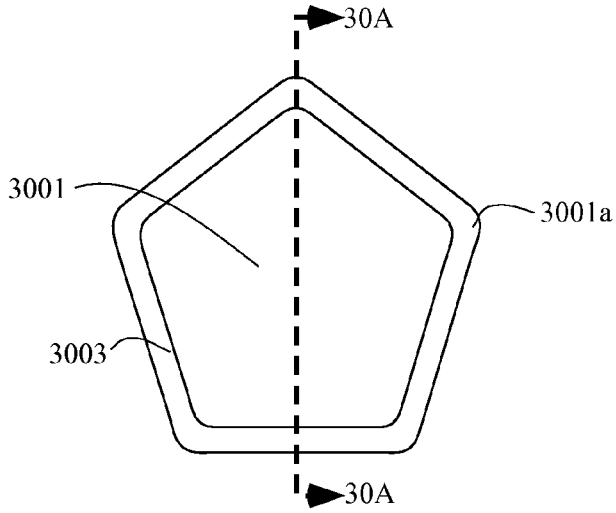

FIGS. 30A and 30B show a plasma-disc with opposing flat pentagonal sides 3001 and rounded corners 3001*a*. FIG. 30A is a right section 30B-30B view of FIG. 30B. FIG. 30B is a section 30A-30A view of either flat pentagonal side 3001 of FIG. 30A. As shown in FIG. 30A, the ends 3002 are flat and have rounded corners 3002*a*. The inside wall surface 3003 of the hollow plasma-disc is shown as a broken line in both FIGS. 30A and 30B.

Figure 31A:
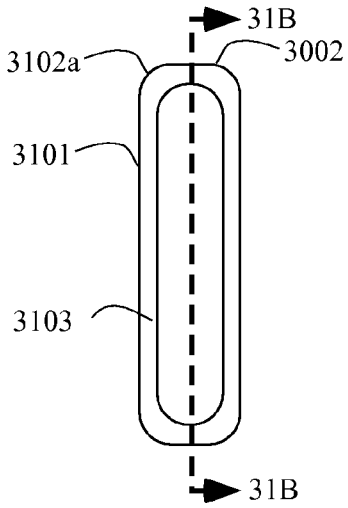
Figure 31B:
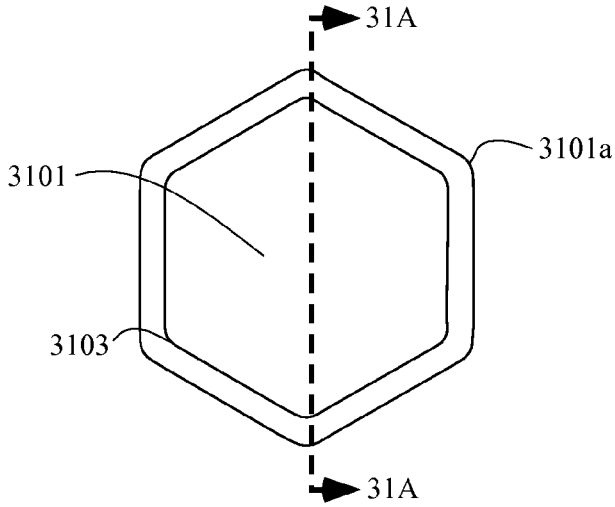

FIGS. 31A and 31B show a plasma-disc with opposing flat hexagonal sides 3101 and rounded corners 3101*a*. FIG. 31A is a right section 31B-31B view of FIG. 31B. FIG. 31B is a section 31A-31A view of either flat hexagonal side 3101 of FIG. 31A. As shown in FIG. 31A, the ends 3102 are flat and have rounded corners 3102*a*. The inside wall surface 3103 of the hollow plasma-disc is shown as a broken line in both FIGS. 31A and 31B.

Figure 32A:
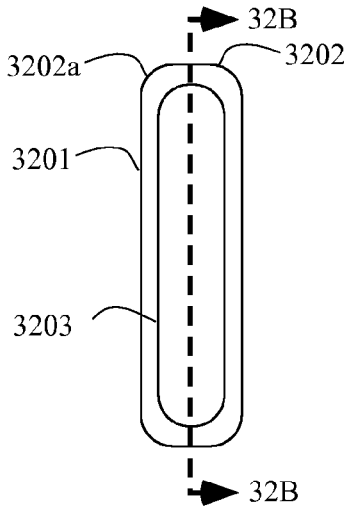
Figure 32B:
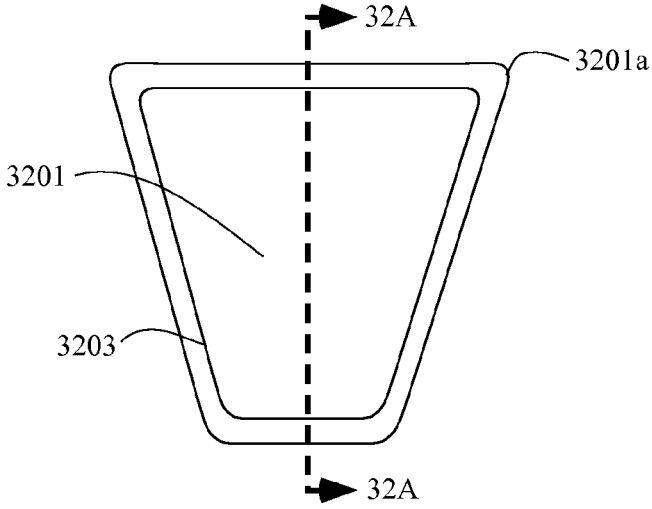

FIGS. 32A and 32B show a plasma-disc with opposing flat trapezoidal sides 3201 and rounded corners 3201*a*. FIG. 32A is a right section 32B-32B view of FIG. 32B. FIG. 32B is a section 32A-32A view of either flat trapezoidal side 3201 of FIG. 32A. As shown in FIG. 32A, the ends 3202 are flat with rounded corners 3202*a*. The inside wall surface 3203 of the hollow plasma-disc is shown as a broken line in both FIGS. 32A and 32B.

Figure 33A:
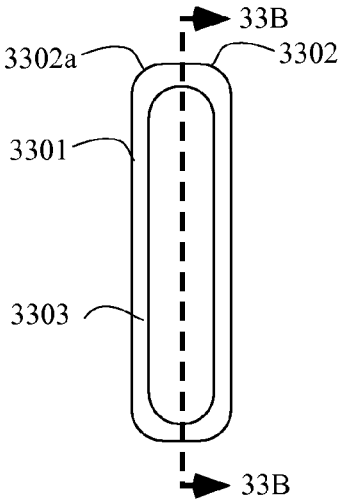
Figure 33B:
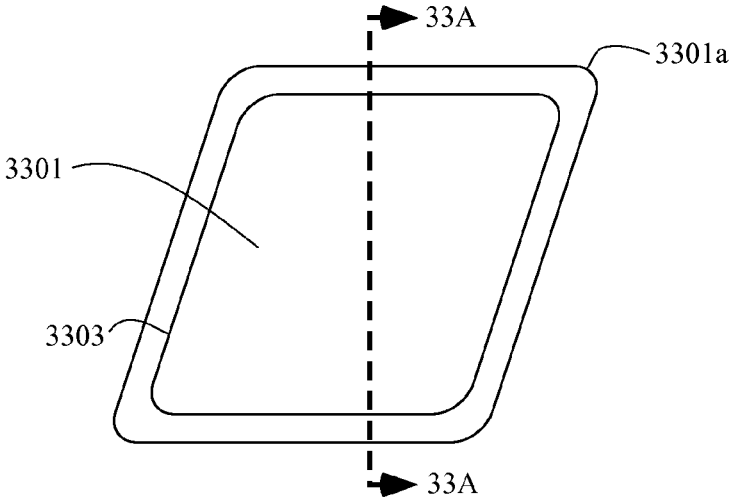

FIGS. 33A and 33B show a plasma-disc with opposing flat rhomboid sides 3301 and rounded corners 3301*a*. FIG. 33A is a right section 33B-33B view of FIG. 33B. FIG. 33B is a section 33A-33A view of either flat rhomboid side 3301 of FIG. 33A. As shown in FIG. 33A, the ends 3302 are flat with rounded corners 3302*a*. The inside wall surface 3303 of the hollow plasma-disc is shown as a broken line in both FIGS. 33A and 33B.

Figure 34A:
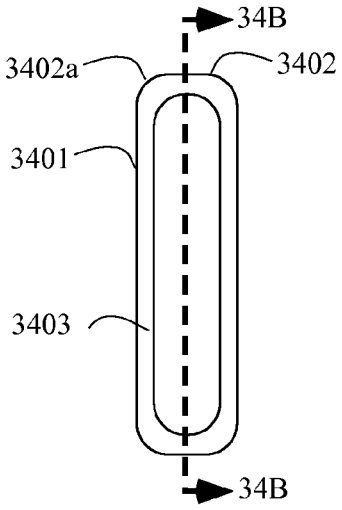
Figure 34B:
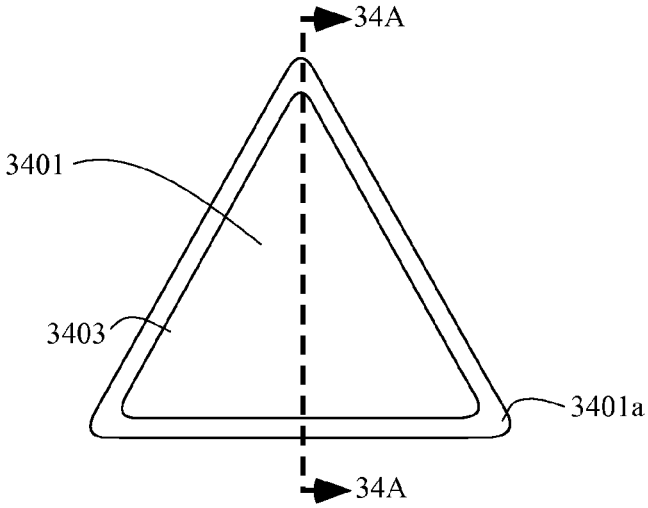

FIGS. 34A and 34B show a plasma-disc with opposing flat triangular sides 3401 and rounded corners 3401*a*. FIG. 34A is a right section 34B-34B view of FIG. 34B. FIG. 34B is a section 34A-34A view of either flat triangular side 3401 of FIG. 34A. As shown in FIG. 34A, the ends 3402 are flat with rounded corners 3402*a*. The inside wall surface 3403 of the hollow plasma-disc is shown as a broken line in both FIGS. 34A and 34B. Although the sides 3401 are shown as an equilateral triangle, other triangular shapes may be used including a right triangle, an isosceles triangle, or an oblique or scalene triangle.

As illustrated herein, for example FIGS. 1 to 18, one flat side of the plasma-disc is positioned as the base on or in the PDP substrate and the opposing flat side is the viewing side. The gas discharge is between the two flat sides, each flat side having a flat external surface for contacting the PDP substrate and connecting to electrodes.

Figure 35:
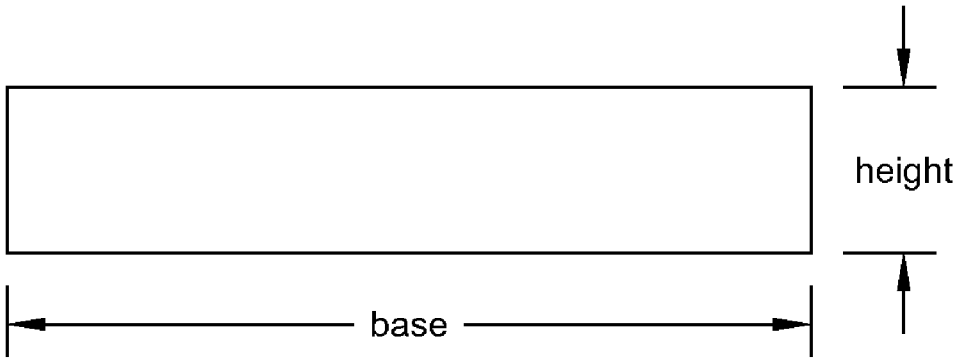
FIG. 35 shows a plasma-disc with a flat base portion in contact with a substrate.

FIG. 35 shows a plasma-disc with a flat base portion in contact with the PDP substrate. The height is the distance between the two flat sides, i.e., the distance between the flat base side and the flat viewing side. In FIG. 35, the length of the flat base side may range from about 10 mils to about 500 mils (one mil equals 0.001 inch) or about 250 microns to about 12,700 microns where 25.4 microns (micrometers) equals 1 mil or 0.001 inch. The height in FIG. 35 is typically about 20 to 80 percent of the length of the flat base, about 2 mils to about 400 mils. In one preferred embodiment, the flat base is about 50 mils to about 400 mils with a height of about 10 mils to about 320 mils. For larger displays, the length of the opposing flat sides can range up to about 1000 mils (25,400 microns) or greater. For smaller displays, the length can be less than 10 mils.

Electrodes

The flat surfaces of the plasma-disc are advantageous for electrically connecting electrodes to the plasma-disc. As illustrated in FIGS. 1 to 18 the electrodes are in contact with one or both flat side(s) of the flat base side and/or the opposite flat side of the plasma-disc. Thus one or both electrodes may contact the flat base side and/or one or both may contact the opposite flat side.

In one embodiment of a plasma-disc with a two-electrode system, one electrode is in contact with one flat side of the plasma-disc such as the flat base in FIG. 35 and one electrode is in contact with the opposite flat side. In another embodiment of two-electrode system, both electrodes are in contact with the same flat side, both electrodes being on the flat base side or on the opposing flat side of the plasma-disc. In either embodiment, the gas discharge is between the two electrodes.

In one embodiment of a plasma-disc with a three-electrode system, two electrodes are in contact with the same flat side and one electrode is in contact with the opposite flat side. Typically in this embodiment, two electrodes are in contact with the flat base side and one is in contact with the opposite flat side. Alternatively, the two electrodes may be in contact with the flat side and one electrode in contact with the opposite base side. In such embodiment, the PDP may be operated as a surface discharge device.

Other electrode configurations are contemplated including PDP electronic systems with 4, 5, 6, or more electrodes per plasma-disc. It is also contemplated there may be multiple discharges within the plasma-disc. Depending upon the electrode configuration, the plasma-disc may be configured to comprise up to six separate pixels.

FIGS. 36 to 46 herein illustrate different electrode configurations that may be used with the plasma-disc.

Figure 36B:
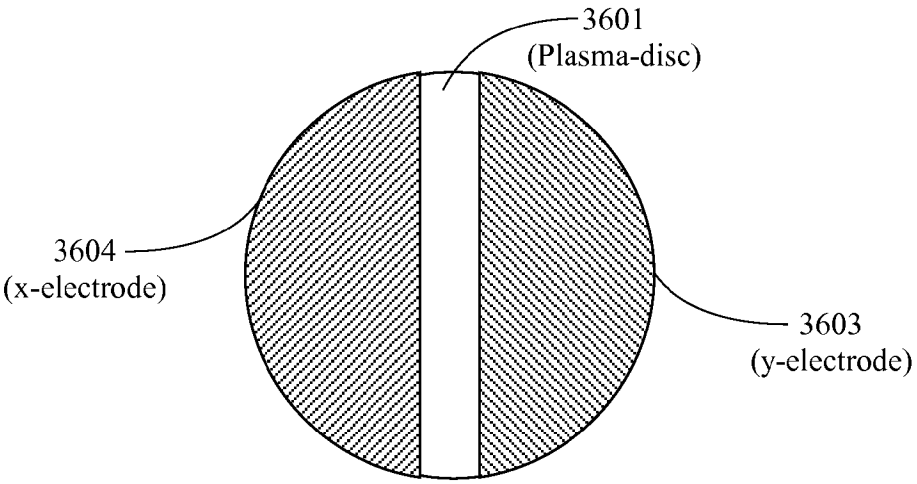
FIGS. 36 to 46 show different electrode configurations.
Figure 36A:
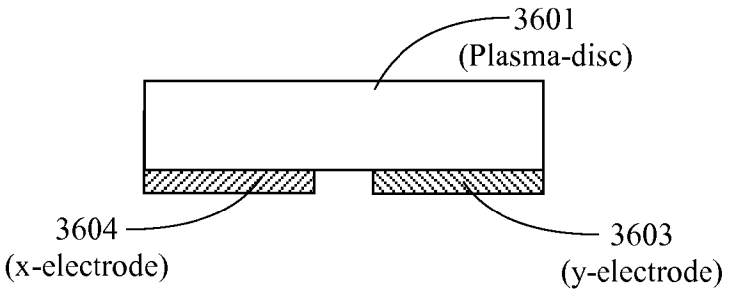

FIGS. 36A and 36B show a plasma-disc 3601 with opposing flat circular sides in a two electrode configuration. FIG. 36A is a side view of the plasma-disc 3601 with x-electrode 3604 and y-electrode 3603 on one flat side. FIG. 36B is a bottom view of the configuration in FIG. 36A showing the location of the x- and y-electrodes. These electrodes may extend to the edge of the plasma-disc 3601.

Figure 37B:
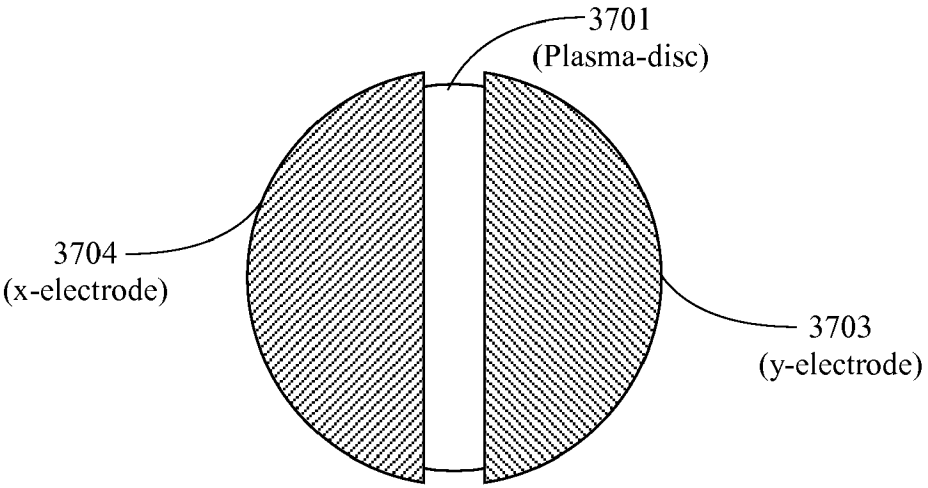
Figure 37A:
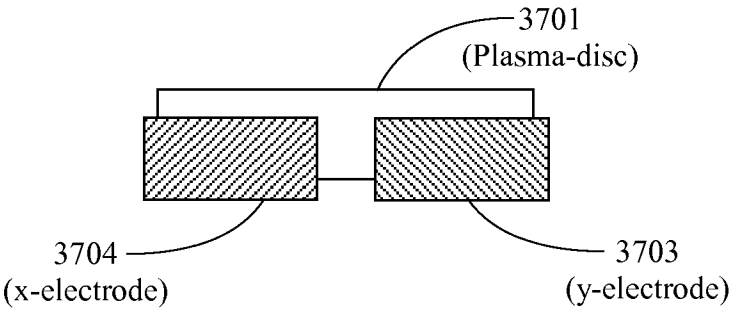

FIGS. 37A and 37B show a plasma-disc 3701 with opposing flat circular sides in a two electrode configuration. FIG. 37A is a side view of the plasma-disc 3701 with x-electrode 3704 and y-electrode 3703 wrapping around the sides of plasma-disc 3701. The x- and y-electrodes 3704 and 3703 may extend up the sides of plasma-disc 3701. FIG. 37B is a bottom view of the configuration in FIG. 37A. This view shows the x-electrode 3704 and y-electrode 3703 extending to and wrapping around the curved side of plasma-disc 3701.

Figure 38B:
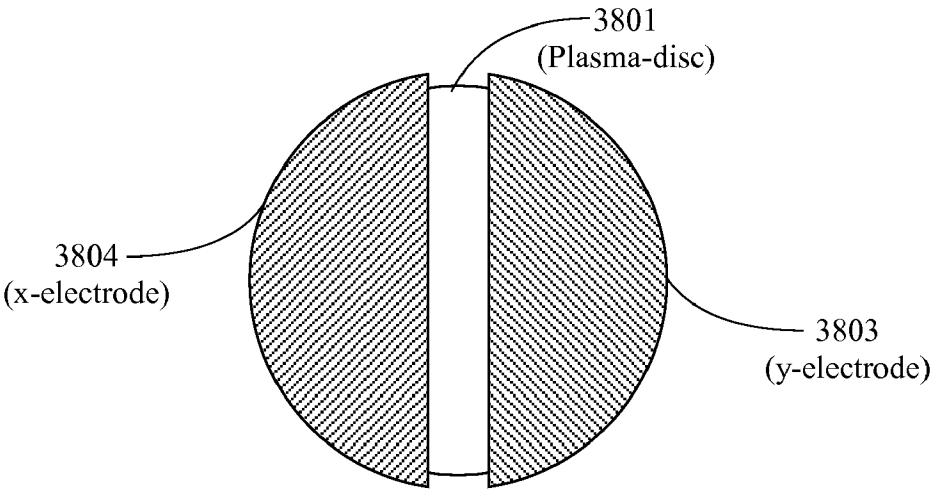
Figure 38A:
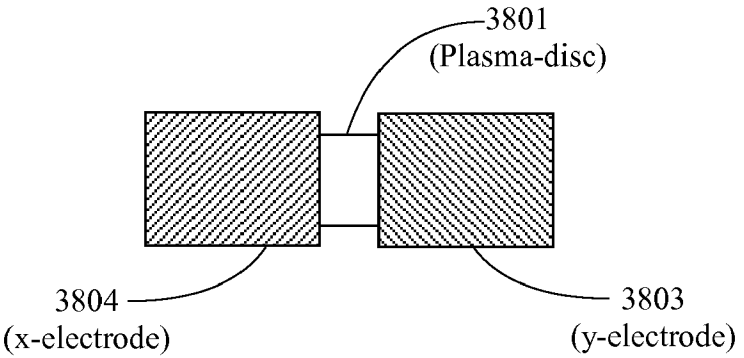

FIGS. 38A and 38B show a plasma-disc 3801 with opposing flat circular sides in a two electrode configuration. FIG. 38A is a side view of the plasma-disc 3801 with x-electrode 3804 and y-electrode 3803 wrapping around the edges of plasma-disc 3801. FIG. 38B is a bottom view of the configuration in FIG. 38A. This view shows the x-electrode 3804 and y-electrode 3803 extending to and wrapping around the curved side of plasma-disc 3801.

Figure 39B:
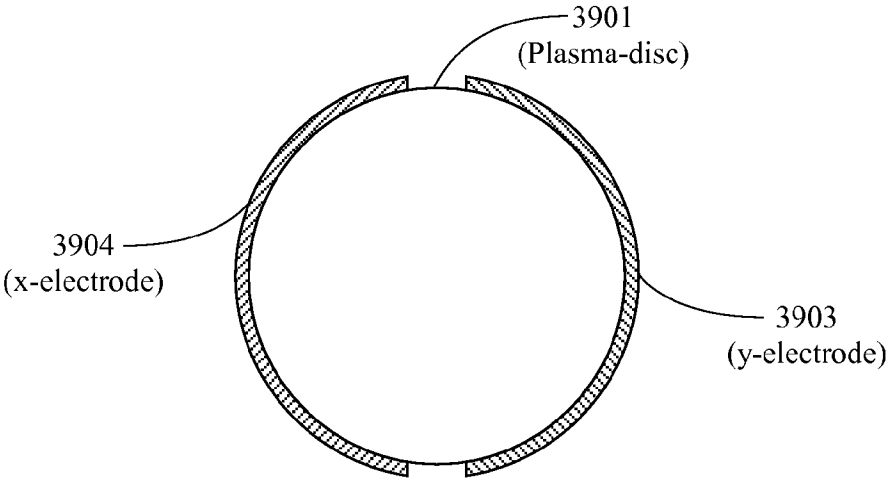
Figure 39A:
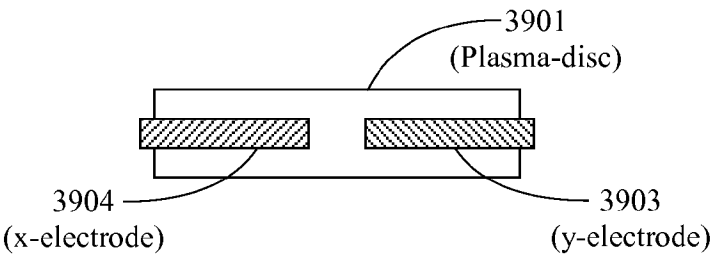

FIGS. 39A and 39B show a plasma-disc 3901 with opposing flat circular sides in a two electrode configuration. FIG. 39A is a side view of the plasma-disc 3901 with x-electrode 3904 and y-electrode 3903 on the curved side of plasma-disc 3901. The height of the electrodes may extend to the full height of plasma-disc 3901. FIG. 39B is a bottom view of the configuration in FIG. 39A. This view shows the curved x-electrode 3904 and curved y-electrode 3903 on plasma-disc 3901.

Figure 40B:
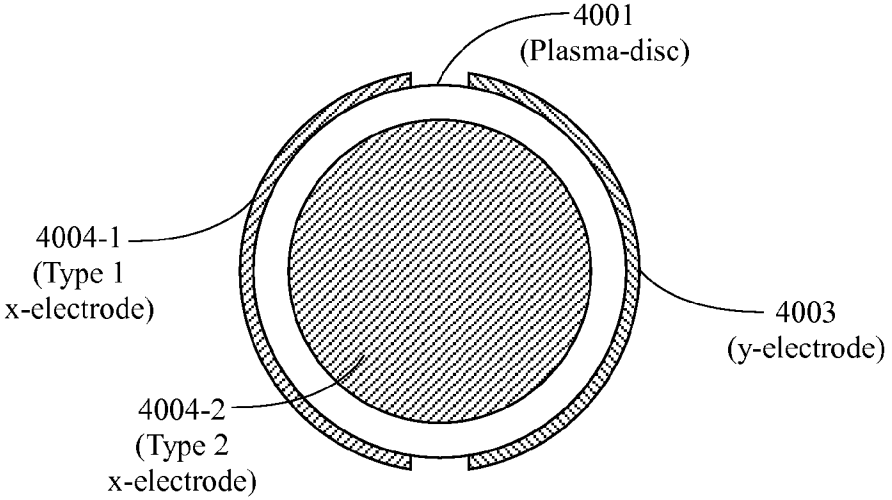
Figure 40A:
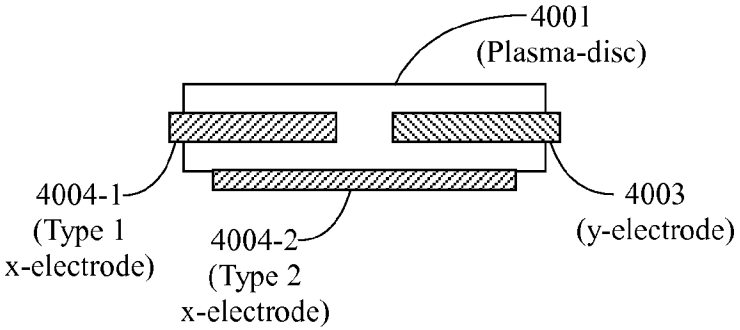

FIGS. 40A and 40B show a plasma-disc 4001 with opposing flat circular sides and a three-electrode configuration. FIG. 40A is a side view of the plasma-disc 4001 with type 1 x-electrode 4004-1 and y-electrode 4003 on the curved side of plasma-disc 4001. The height of the electrodes may extend the full height of plasma-disc 4001. Type 2 x-electrode 4004-2 is on one opposing flat circular side of plasma-disc 4001. FIG. 40B is a bottom view of the configuration in FIG. 40A. This view shows the curved type 1 x-electrode 4004 and curved y-electrode 4003 on plasma-disc 4001 and type 2 x-electrode 4004-2 on one opposing flat side of plasma-disc 4001. The type 2 x-electrode 4004-2 may extend to the edge of plasma-disc 4001, but may not make electrical contact with electrodes 4004-1 and/or 4003.

Figure 41B:
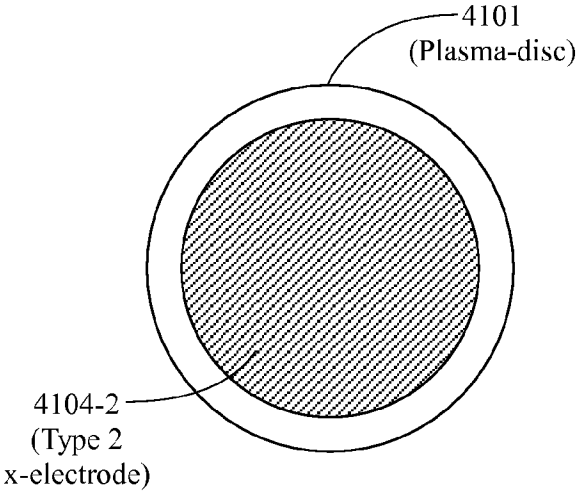
Figure 41A:
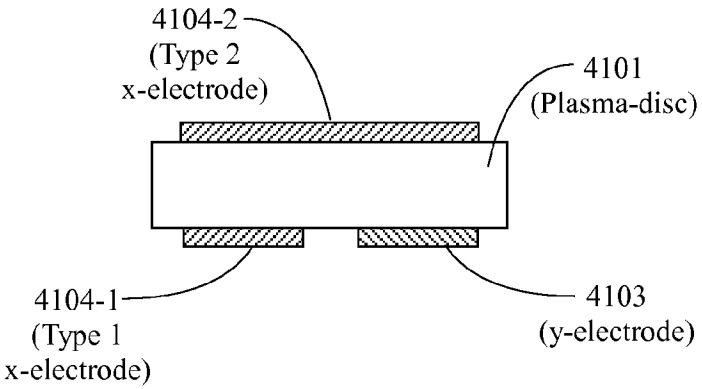
Figure 41C:
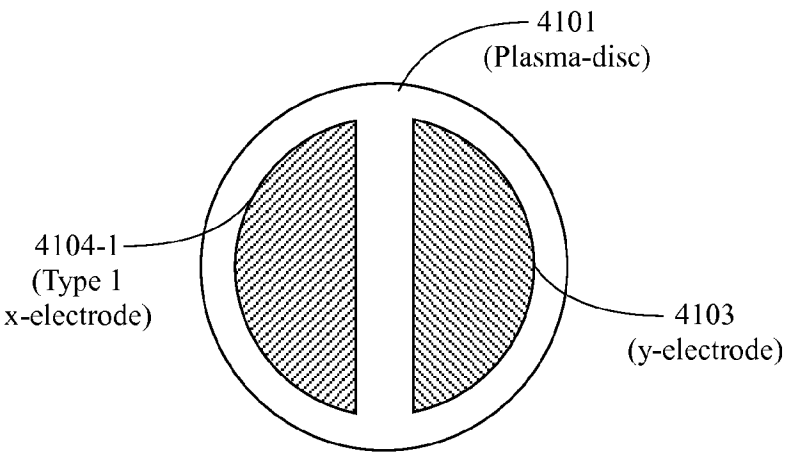

FIGS. 41A and 41B show a plasma-disc 4101 with opposing flat circular sides and a three-electrode configuration. FIG. 41A is a side view of the plasma-disc 4101 with type 1 x-electrode 4104-1 and y-electrode 4103 on one flat circular side of plasma-disc 4101. Type 2 x-electrode 4104-2 is on the opposing flat circular side of plasma-disc 4101. FIG. 41B is a top view of the configuration in FIG. 41A, showing the type 2 x-electrode 4104-2, which may extend to the edge of the plasma-disc 4101. FIG. 41C is a bottom view of FIG. 41A, showing type 1 x-electrode 4104-1 and y-electrode 4103. Type 1 x-electrode 4104-1 and y-electrode 4103 may extend to the edge of the plasma-disc 4101 and may also extend and wrap around the curved side of the plasma-disc 4101.

Figure 42A:
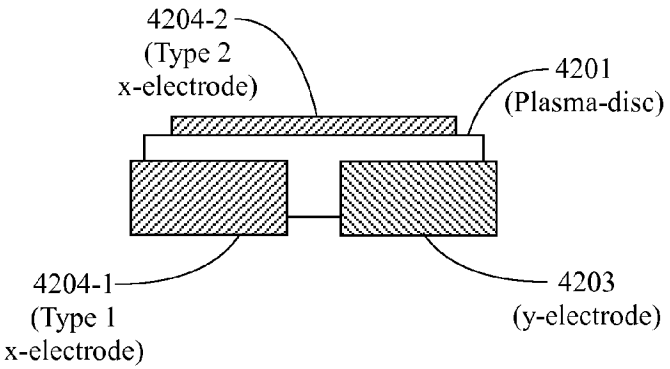
Figure 42B:
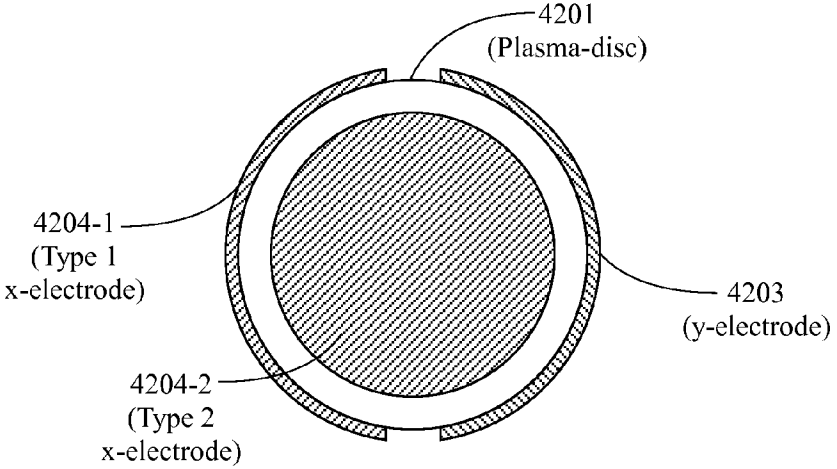
Figure 42C:
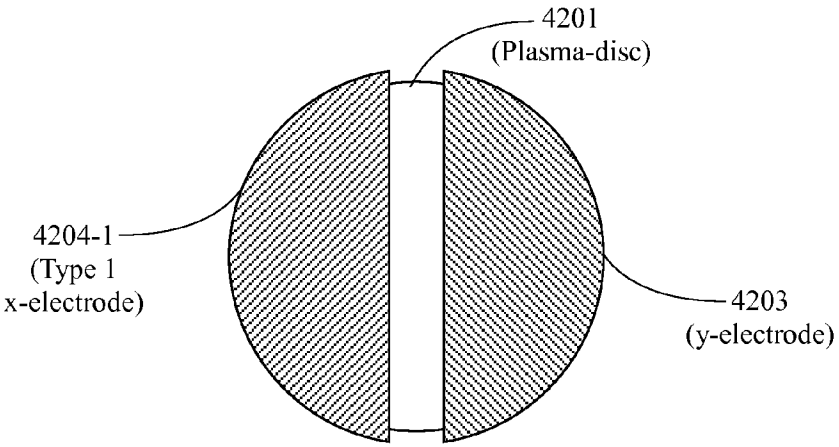

FIGS. 42A and 42B show a plasma-disc 4201 with opposing flat circular sides in a three-electrode configuration. FIG. 42A is a side view of the plasma-disc 4201 with type 1 x-electrode 4204-1 and y-electrode 4203 wrapping around the sides of plasma-disc 4201. The type 1 x- and y-electrodes 4204-1 and 4203 may extend up the sides of plasma-disc 4201. Type 2 x-electrode 4204-2 is on the opposing flat circular side of plasma-disc 4201. FIG. 42B is a top view of the configuration in FIG. 42A, showing the type 2 x-electrode 4204-2, which may extend to the edge of the plasma-disc 4201, but may not make electrical contact electrodes 4204-1 and/or 4203. FIG. 42C is a bottom view of the configuration seen in FIG. 42A, This view shows the type 1 x-electrode 4204-1 and y-electrode 4203 wrapping around to the curved side of plasma-disc 4201.

Figure 43B:
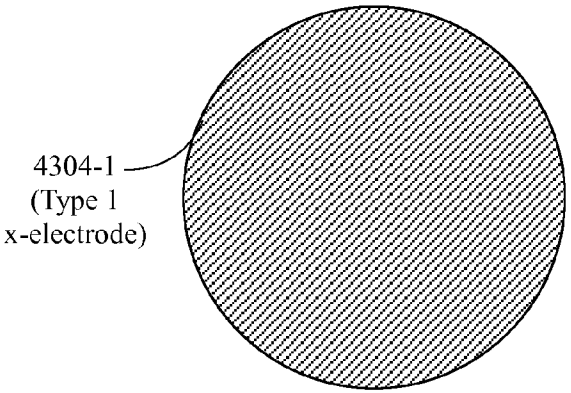
Figure 43A:
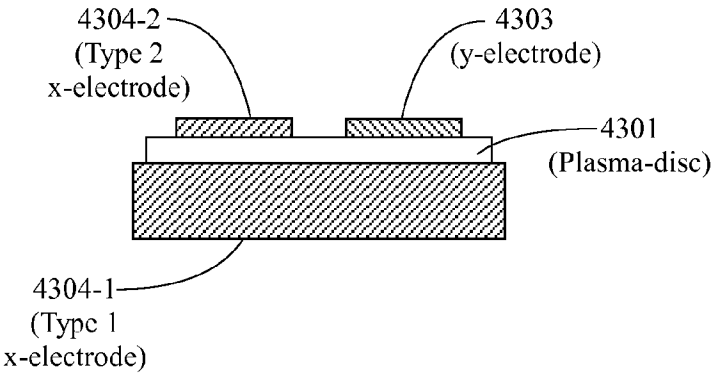
Figure 43C:
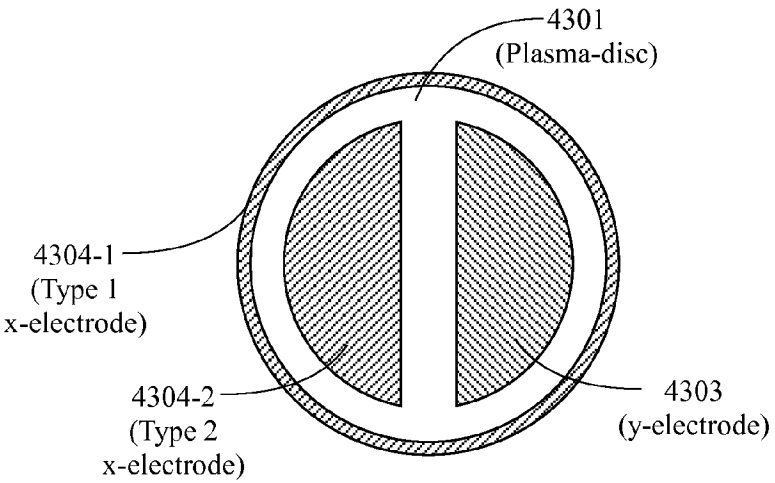

FIGS. 43A, 43B, and 43C show a plasma-disc 4301 with opposing flat circular sides in a three-electrode configuration. FIG. 43A is a side view of the plasma-disc 4301 with type 1 x-electrode 4304-1 wrapping around the sides of plasma-disc 4301. This electrode may extend up the sides of the plasma-disc 4301. Type 2 x-electrode 4304-2 and y-electrode 4303 are located on the opposing flat circular side of plasma-disc 4301. FIG. 43B is a bottom view of the configuration in FIG. 43A, showing type 1 x-electrode wrapping around the curved side of plasma-disc 4301. FIG. 43C is a top view of the configuration in FIG. 43A, showing type 2 x-electrode 4304-2 and y-electrode 4303 on the other opposing flat circular side and type 1 x-electrode 4304-1 wrapped around the curved side of plasma-disc 4301. Type 2 x-electrode 4304-2 and y-electrode 4303 may extend to the edge of the plasma-disc 4301, but may not make electrical contact to electrode 4304-1.

Figure 44B:
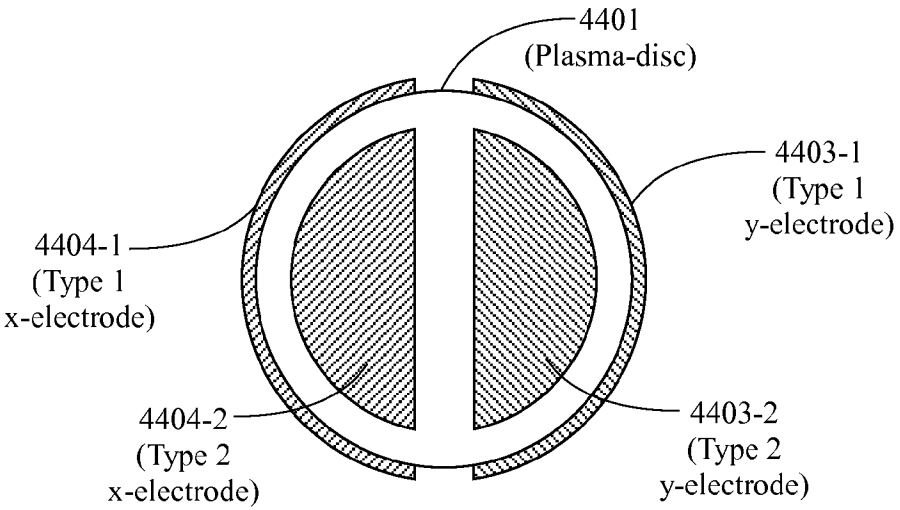
Figure 44A:
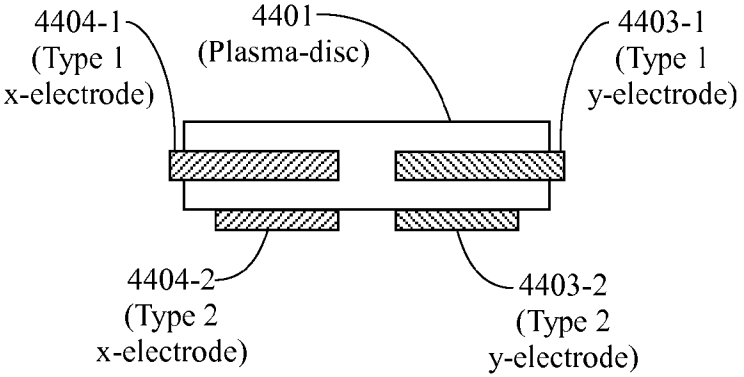

FIGS. 44A and 44B show a plasma-disc 4401 with opposing flat circular sides in a four-electrode configuration. FIG. 44A is a side view of the plasma-disc 4401 with type 1 x-electrode 4404-1 and type 1 y-electrode 4403-1 on the curved side of plasma-disc 4401. The height of the electrodes may extend to the full height of plasma-disc 4401, but may not make electrical contact to the type 2 electrodes 4404-2 and/or 4403-2. FIG. 44B is a bottom view of the configuration in FIG. 44A. This view shows the curved type 1 x-electrode 4404-1 and curved type 1 y-electrode 4403-1 on plasma-disc 4401. Type 2 x-electrode 4404-2 and type 2 y-electrode 4403-2 may extend to the edge of the plasma-disc 4301, but may not make electrical contact to electrodes 4404-1 and/or 4403-1.

Figure 45A:
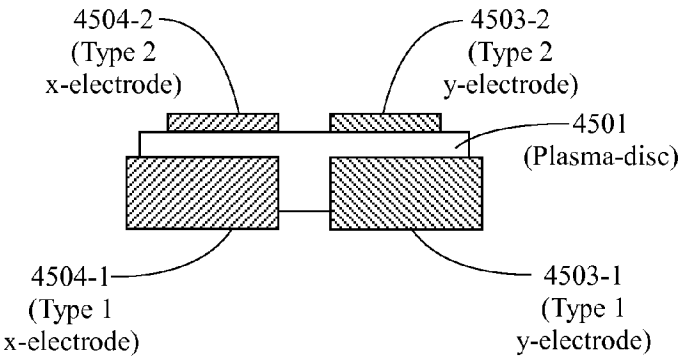
Figure 45B:
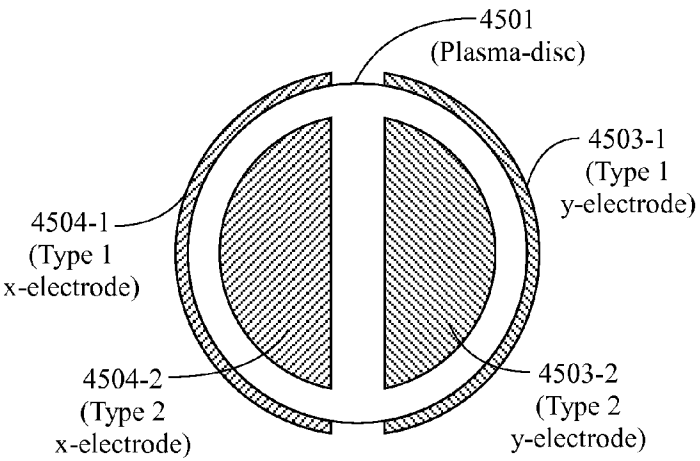
Figure 45C:
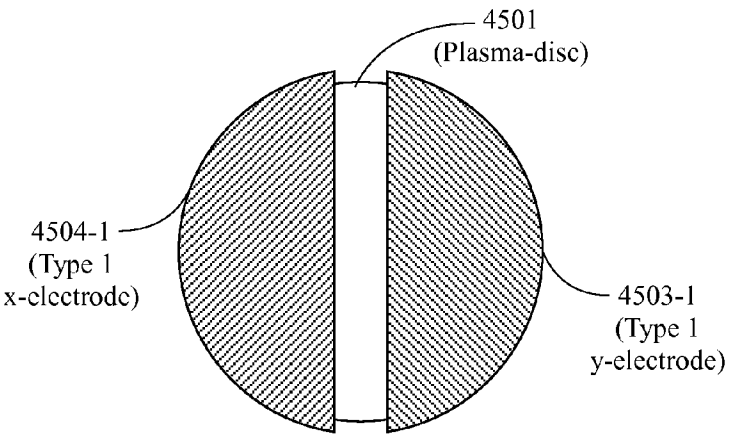
Figure 45D:
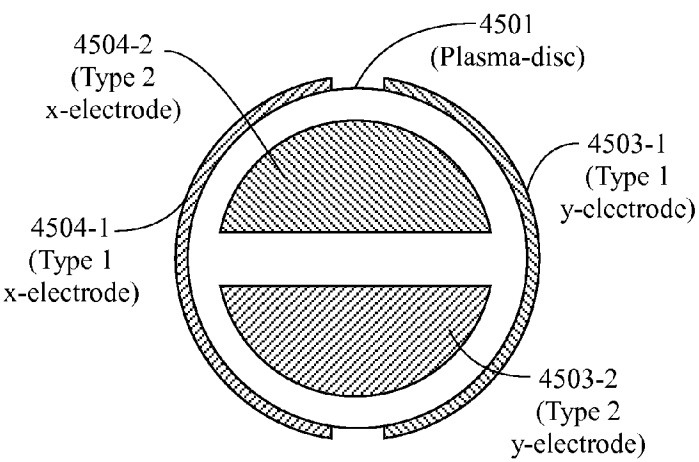

FIGS. 45A, 45B, 45C, and 45D show a plasma-disc 4501 with opposing flat circular sides in a four-electrode configuration. FIG. 45A is a side view of the plasma-disc 4501 with type 1 x-electrode 4504-1 and type 1 y-electrode 4503-1 wrapping around the curved side of plasma-disc 4501. The height of the electrodes may extend to the full height of plasma-disc 4501, but may not make electrical contact to the type 2 electrodes 4504-2 and/or 4503-2. FIG. 45B is a top view of the configuration in FIG. 45A, showing type 1 x-electrode 4504-1 and type 1 y-electrode 4503-1 wrapped around the curved side of plasma-disc 4501 and type 2 x-electrode 4504-2 and type 2 y-electrode 4503-2 on one opposing flat side. These type 2 electrodes 4504-2 and 4503-2 may extend to the edge of plasma-disc 4501, but may not make electrical contact with the type 1 electrodes 4504-1 and/or 4503-1. FIG. 45C is a bottom view of the configuration in FIG. 45A, showing the type 1 x-electrode 4504-1 and type 1 y-electrode 4503-1 wrapping around the curved side of plasma-disc 4501. FIG. 45D is an alternate top view of FIG. 45B. The type 2 electrodes 4504-2 and 4503-2 may be at any angle with respect to the type 1 electrodes 4504-1 and 4503-1.

Figure 46B:
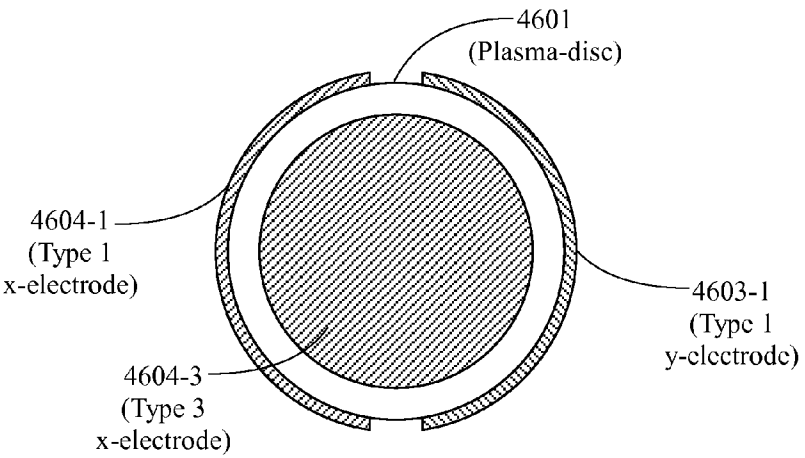
Figure 46A:
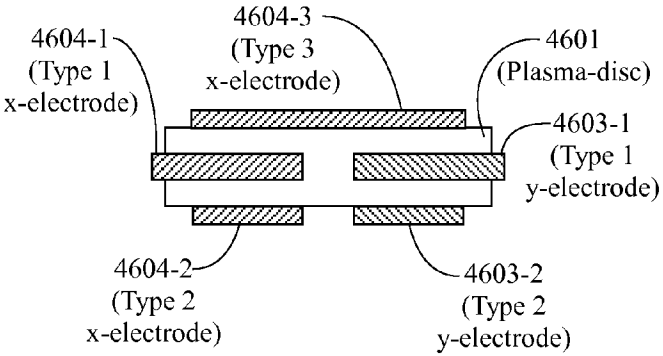
Figure 46C:
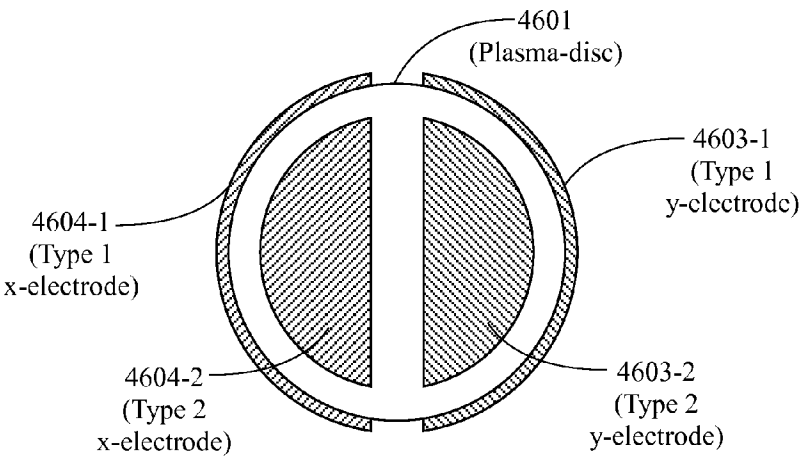

FIGS. 46A, 46B, and 46C, show a plasma-disc 4601 with opposing flat circular sides in a five-electrode configuration. FIG. 46A is a side view of the plasma-disc 4601 with type 3 x-electrode 4604-3 on the top flat side, type 1 electrodes 4604-1 and 4603-1 on the curved side of plasma-disc 4601, and type 2 electrodes 4604-2 and 4603-2 on the bottom flat side of plasma-disc 4601. The height of the type 1 electrodes 4604-1 and 4603-1 may extend to the full height of the plasma-disc 4601 but may not make electrical contact with type 2 electrodes 4604-2 and/or 4603-2 and/or 4604-3. FIG. 46B is a top view of the configuration in FIG. 46A, showing type 1 x-electrode 4604-1 and type 1 y-electrode 4603-1 on the curved side of plasma-disc 4601, and type 3 x-electrode 4604-3 on one flat circular side of plasma-disc 4601. The type 3 x-electrode 4604-3 may extend to the edge of plasma-disc 4601, but may not make electrical contact with type 1 electrodes 4604-1 and/or 4603-1. FIG. 46C is a bottom view of the configuration in FIG. 46A, showing type 1 electrodes 4604-1 and 4603-1 on the curved side of plasma-disc 4601, and type 2 x-electrode 4604-2 and type 2 y-electrode 4603-2 on one flat circular side. The type 2 electrodes 4604-2 and 4603-2 may extend to the edge of plasma-disc 4601 but may not make electrical contact to type 1 electrodes 4604-1 and/or 4603-1.

Plasma-Sphere

Figure 47:
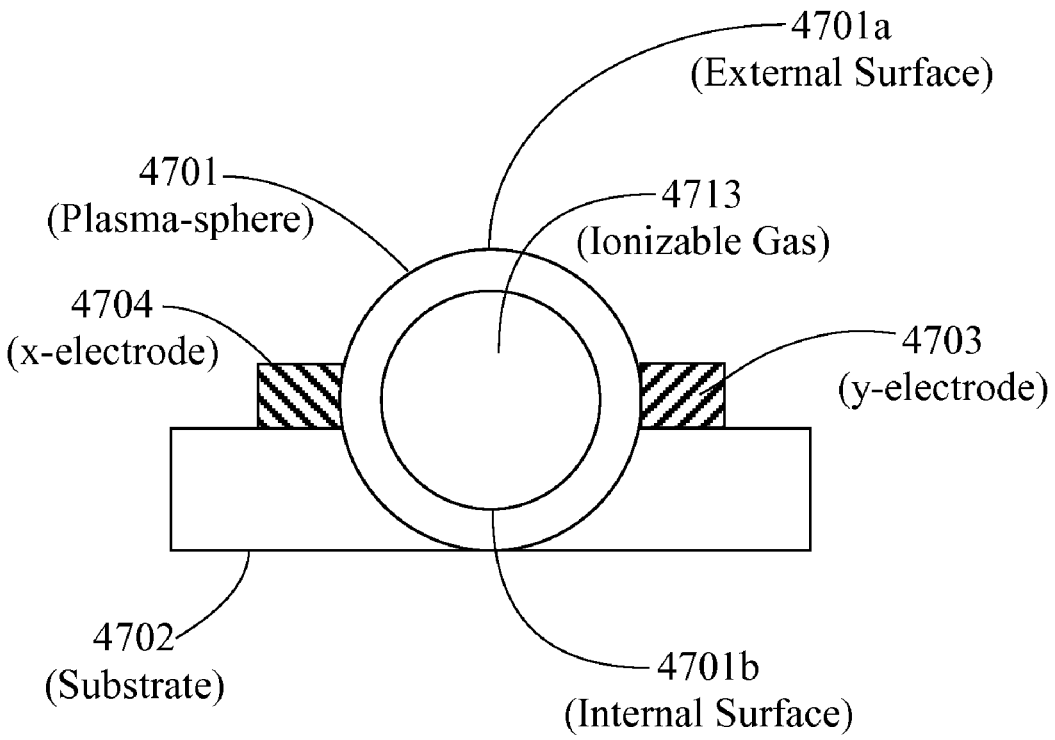
FIG. 47 shows a plasma-sphere located on a substrate with a x-electrode and y-electrode.

FIG. 47 shows a hollow plasma-sphere 4701 with external surface 4701*a* and internal surface 4701*b* located within a substrate 4702 with x-electrode 4704 and y-electrode 4703. The plasma-sphere 4701 contains ionizable gas 4713.

PDP Electronics

Figure 48:
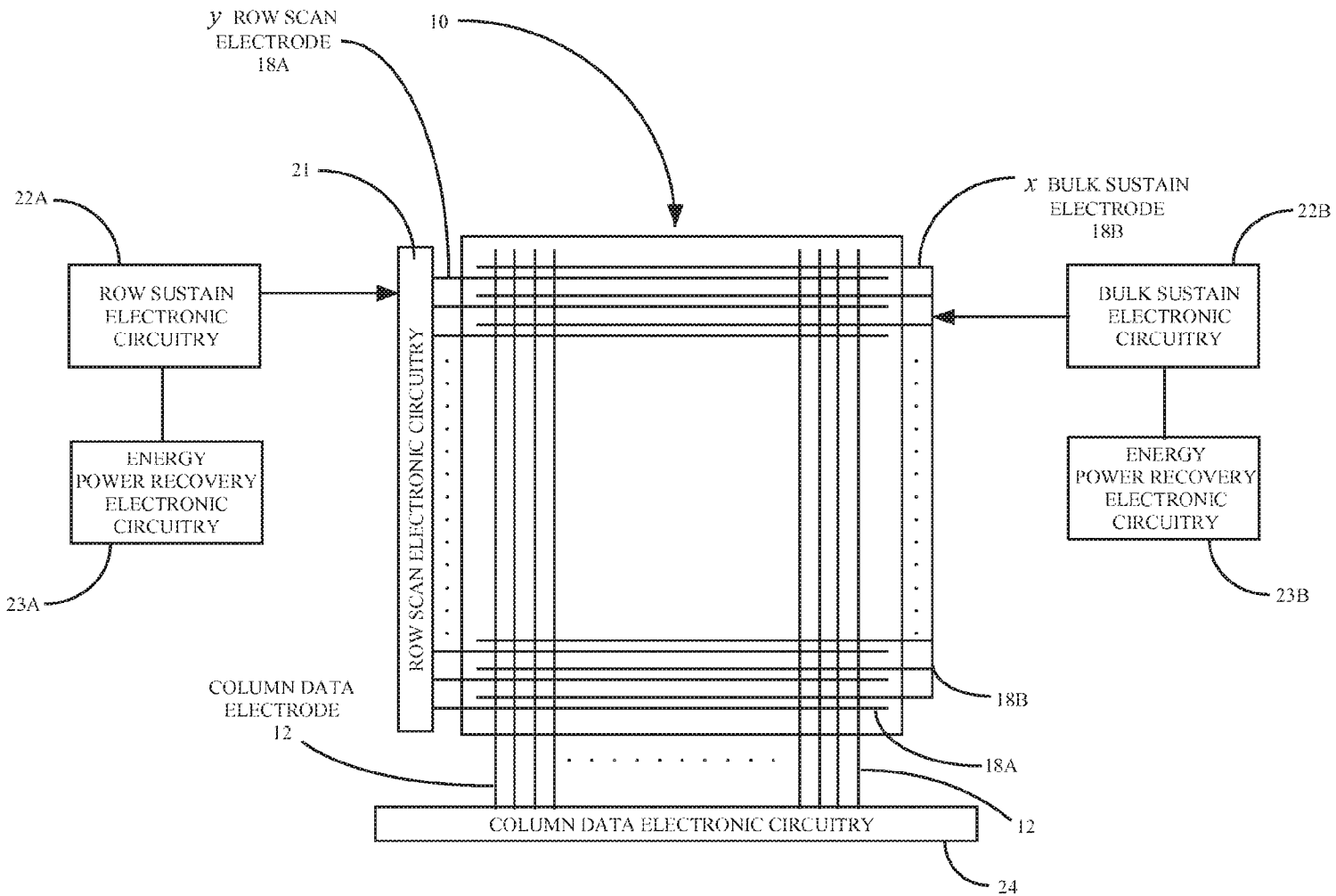
FIG. 48 shows a block diagram of electronics for driving an AC gas discharge plasma display with plasma-discs as pixels.

FIG. 48 is a block diagram of a plasma display panel (PDP) 10 with electronic circuitry 21 for y row scan electrodes 18A, bulk sustain electronic circuitry 22B for x bulk sustain electrode 18B and column data electronic circuitry 24 for the column data electrodes 12. The pixels or sub-pixels of the PDP comprise plasma-discs not shown in FIG. 48. There is also shown row sustain electronic circuitry 22A with an energy power recovery electronic circuit 23A. There is also shown energy power recovery electronic circuitry 23B for the bulk sustain electronic circuitry 22B. The electronics architecture used in FIG. 48 is ADS as described in the Shinoda and other patents cited herein including Shinoda et al. '500. In addition, other architectures as described herein and known in the prior art may be utilized. These architectures including Shinoda ADS may be used to address plasma-discs in a PDP.

The plasma-shell is filled with an ionizable gas. Each gas composition or mixture has a unique curve associated with it, called the Paschen curve. The Paschen curve is a graph of the breakdown voltage versus the product of the pressure times the discharge distance. It is usually given in Torr-centimeters. The gases typically have a saddle region in which the voltage is at a minimum. Often it is desirable to choose pressure and gas discharge distance in the saddle region to minimize the voltage. In one embodiment, the inside of the plasma-shell or plasma-tube contains a secondary electron emitter. Secondary electron emitters lower the breakdown voltage of the gas and provide a more efficient discharge. Plasma displays traditionally use magnesium oxide for this purpose. Other materials may be used including other Group Ha oxides, rare earth oxides, lead oxides, aluminum oxides, and other materials. Mixtures of secondary electron emitters may be used. It may also be beneficial to add luminescent substances such as phosphor to the inside or outside of the sphere. In another embodiment and mode hereof, the plasma-shell or plasma-tube material is a metal or metalloid oxide with an ionizable gas of 99.9% atoms of neon and 0.1% atoms of argon or xenon for use in a monochrome PDP. Examples of shell materials include glass, silica, aluminum oxides, zirconium oxides, and magnesium oxides. In another embodiment, the plasma-shell or plasma-tube contains luminescent substances such as phosphors selected to provide different visible colors including red, blue, and green for use in a full color PDP. The metal or metalloid oxides are typically selected to be highly transmissive to photons produced by the gas discharge especially in the UV range. In one embodiment, the ionizable gas is selected from any of several known combinations that produce UV light including pure helium, helium with up to 1% atoms neon, helium with up to 1% atoms of argon and up to 15% atoms nitrogen, and neon with up to 15% atoms of xenon or argon. For a color PDP, red, blue, and/or green light-emitting luminescent substance may be applied to the interior or exterior of the plasma-sphere or plasma-tube shell. The exterior application may comprise a slurry or tumbling process with curing, typically at low temperatures. Infrared curing can also be used. The luminescent substance may be applied by other methods or processes, which include spraying, ink jet, dipping, and so forth. Thick film methods such as screen-printing may be used. Thin film methods such as sputtering and vapor phase deposition may be used. The luminescent substance may be applied externally before or after the plasma-shell or plasma-tube is attached to the PDP substrate. As discussed hereinafter, the luminescent substance may be organic and/or inorganic.

The internal or external surface of the plasma-shell or plasma-tube may be partially or completely coated with luminescent material. In another embodiment, the external surface is partially or completely coated with luminescent material. The bottom or rear of the plasma-shell or plasma-tube may be coated with a suitable light reflective material in order to reflect more light toward the top or front viewing direction of the plasma-shell or plasma-tube. The light reflective material may be applied by any suitable process such as spraying, ink jet, dipping, and so forth. Thick film methods such as screen-printing may be used. Thin film methods such as sputtering and vapor phase deposition may be used. The light reflective material may be applied over the luminescent material or the luminescent material may be applied over the light reflective material. In one embodiment, the electrodes are made of or coated with a light reflective material such that the electrodes also may function as a light reflector.

In one embodiment hereof, there is used a plasma-disc. A plasma-shell with two substantially flattened opposite sides, i.e., top and bottom is called a plasma-disc. A plasma-disc may be formed by flattening a plasma-sphere on one or more pairs of opposing sides such as top and bottom. The flattening of the plasma-sphere to form a plasma-disc is typically done while the sphere shell is at an ambient temperature or at elevated softening temperature below the melting temperature. The flat viewing surface in a plasma-disc tends to increase the overall luminous efficiency of a PDP. Plasma-discs may be typically produced while the plasma-sphere is at an elevated temperature below its melting point. While the plasma-sphere is at the elevated temperature, a sufficient pressure or force is applied to flatten the spheres into disc shapes with flat top and bottom. Like a coin that can only land "heads" or "tails," a plasma-disc with a flat top and flat bottom may be applied to a substrate in one of two flat positions. However, in some embodiments, the plasma-disc may be positioned on edge on or within the substrate.

In one embodiment hereof, there is used a plasma-dome. A plasma-dome has at least one flat side with an opposing dome or half sphere portion. In forming a PDP, the dome portion may be positioned within the substrate with the flat side up in the viewing direction or with the dome portion up in the viewing direction.

PDP Electronics

ADS

A basic electronics architecture for addressing and sustaining a surface discharge AC plasma display is called Address Display Separately (ADS). The ADS architecture may be used for a monochrome or multi-color display. The ADS architecture is disclosed in a number of Fujitsu patents including U.S. Pat. Nos. 5,541,618 (Shinoda) and 5,724,054 (Shinoda), incorporated herein by reference. Also see U.S. Pat. Nos. 5,446,344 (Kanazawa) and U.S. Pat. No. 5,661,500 (Shinoda et al.), incorporated herein by reference. ADS has become a basic electronic architecture widely used in the AC plasma display industry for the manufacture of PDP monitors and television.

Fujitsu ADS architecture is commercially used by Fujitsu and is also widely used by competing manufacturers including Matsushita and others. ADS is disclosed in U.S. Pat. No. 5,745,086 (Weber), incorporated herein by reference. See FIGS. 2, 3, 11 of Weber 086. The ADS method of addressing and sustaining a surface discharge display as disclosed in U.S. Pat. Nos. 5,541,618 (Shinoda) and 5,724,054 (Shinoda), incorporated herein by reference, sustains the entire panel (all rows) after the addressing of the entire panel. The addressing and sustaining are done separately and are not done simultaneously. ADS may be used to address plasma-shells including plasma-spheres, plasma-discs, or plasma-domes and/or plasma-tubes in a PDP.

ALIS

This invention may also use the so-called shared electrode or electronic ALIS drive system disclosed in U.S. Pat. Nos. 6,489,939 (Asso et al.), 6,498,593 (Fujimoto et al.), 6,531,819 (Nakahara et al.), 6,559,814 (Kanazawa et al.), 6,577,062 (Itokawa et al.), 6,603,446 (Kanazawa et al.), 6,630,790 (Kanazawa et al.), 6,636,188 (Kanazawa et al.), 6,667,579 (Kanazawa et al.), 6,667,728 (Kanazawa et al.), 6,703,792 (Kawada et al.), U.S. Patent Application Publication, 2004/0046509 (Sakita), all of which are incorporated herein by reference. In accordance with this invention, ALIS may be used to address plasma-shells including plasma-spheres, plasma-discs, and plasma-domes and/or plasma-tubes in a PDP.

AWD

Another electronic architecture is called Address While Display (AWD). The AWD electronics architecture was first used during the 1970s and 1980s for addressing and sustaining monochrome PDP. In AWD architecture, the addressing (write and/or erase pulses) are interspersed with the sustain waveform and may include the incorporation of address pulses onto the sustain waveform. Such address pulses may be on top of the sustain and/or on a sustain notch or pedestal. See for example U.S. Pat. No. 3,801,861 (Petty et al.) and U.S. Pat. No. 3,803,449 (Schmersal), both incorporated herein by reference. FIGS. 1 and 3 of the Shinoda 054 ADS patent disclose AWD architecture as prior art. The AWD electronics architecture for addressing and sustaining monochrome PDP has also been adopted for addressing and sustaining multi-color PDP. For example, Samsung Display Devices Co., Ltd., has disclosed AWD and the superimpose of address pulses with the sustain pulse. Samsung specifically labels this as Address While Display (AWD). See High-Luminance and High-Contrast HDTV PDP with Overlapping Driving Scheme, J. Ryeom et al., pages 743 to 746, *Proceedings of the Sixth International Display Workshops*, IDW 99, Dec. 1-3, 1999, Sendai, Japan and AWD as disclosed in U.S. Pat. No. 6,208,081 issued to Yoon-Phil Eo and Jeong-duk Ryeom of Samsung, incorporated herein by reference. LG Electronics Inc. has disclosed a variation of AWD with a Multiple Addressing in a Single Sustain (MASS) in U.S. Pat. No. 6,198,476 (Hong et al.), incorporated herein by reference. Also see U.S. Pat. No. 5,914,563 (Lee et al.), incorporated herein by reference. AWD may be used to address plasma-shells including plasma-spheres, plasma-discs, and plasma-domes in a PDP. An AC voltage refresh technique or architecture is disclosed by U.S. Pat. No. 3,958,151 (Yano et al.), incorporated herein by reference. In one embodiment of this invention the plasma-shells and/or plasma-tubes are filled with pure neon and operated with the architecture of Yano '151.

Energy Recovery

Energy recovery is used for the efficient operation of a PDP. Examples of energy recovery architecture and circuits are well known in the prior art. These include U.S. Pat. Nos. 4,772,884 (Weber et al.), 4,866,349 (Weber et al.), 5,081,400 (Weber et al.), 5,438,290 (Tanaka), 5,642,018 (Marcotte), 5,670,974 (Ohba et al.), 5,808,420 (Rilly et al.) and 5,828,353 (Kishi et al.), all incorporated herein by reference.

Slow Ramp Reset

Slow rise slopes or ramps may be used in the practice of this invention. The prior art discloses slow rise slopes or ramps for the addressing of AC plasma displays. The early patents include U.S. Pat. Nos. 4,063,131 (Miller), 4,087,805 (Miller), 4,087,807 (Miavecz), 4,611,203 (Criscimagna et al.), and 4,683,470 (Criscimagna et al.), all incorporated herein by reference. Architecture for a slow ramp reset voltage is disclosed in U.S. Pat. No. 5,745,086 (Weber), incorporated herein by reference. Weber '086 discloses positive and/or negative ramp voltages that exhibit a slope that is set to assure that current flow through each display pixel site remains in a positive resistance region of the gas discharge. The slow ramp architecture may be used in combination with ADS as disclosed in FIG. 11 of Weber '086. PCT Patent Application WO 00/30065 and U.S. Pat. No. 6,738,033 (Hibino et al.) also disclose architecture for a slow ramp reset voltage and are incorporated herein by reference.

Artifact Reduction

Artifact reduction techniques may be used in the practice of this invention. The PDP industry has used various techniques to reduce motion and visual artifacts in a PDP display. Pioneer of Tokyo, Japan has disclosed a technique called CLEAR for the reduction of false contour and related problems. See Tokunaga et al. "Development of New Driving Method for AC-PDPs."*Proceedings of the Sixth International Display Workshops, IDW* 99, Sendai, Japan (Dec. 1-3, 1999): 787-790. Also see European Patent Applications EP 1 020 838 A1 by Tokunaga et al. of Pioneer. The CLEAR techniques disclosed in the above Pioneer IDW publication and Pioneer EP 1020838 A1, are incorporated herein by reference. In the practice of this invention, it is contemplated that the ADS architecture may be combined with a CLEAR or like technique as required for the reduction of motion and visual artifacts. The CLEAR and ADS may also be used with the slow ramp address.

SAS

In one embodiment of this invention it is contemplated using SAS electronic architecture to address a PDP panel constructed of plasma-shells and/or plasma-tubes. SAS architecture comprises addressing one display section of a surface discharge PDP while another section of the PDP is being simultaneously sustained. This architecture is called Simultaneous Address and Sustain (SAS). See U.S. Pat. No. 6,985,125, incorporated herein by reference. SAS offers a unique electronic architecture, which is different from prior art columnar discharge, and surface discharge electronics architectures including ADS, AWD, and MASS. It offers important advantages as discussed herein. In accordance with the practice of SAS with a surface discharge PDP, addressing voltage waveforms are applied to a surface discharge PDP having an array of data electrodes on a bottom or rear substrate and an array of at least two electrodes on a top or front viewing substrate, one top electrode being a bulk sustain electrode x and the other top electrode being a row scan electrode y. The row scan electrode y may also be called a row sustain electrode because it performs the dual functions of both addressing and sustaining. An important feature and advantage of SAS is that it allows selectively addressing of one section of a surface discharge PDP with selective write and/or selective erase voltages while another section of the panel is being simultaneously sustained. A section is defined as a predetermined number of bulk sustain electrodes x and row scan electrodes y. In a surface discharge PDP, a single row is comprised of one pair of parallel top electrodes x and y. In one embodiment of SAS, there is provided the simultaneous addressing and sustaining of at least two sections $S_1$ and $S_2$ of a surface discharge PDP having a row scan, bulk sustain, and data electrodes, which comprises addressing one section $S_1$ of the PDP while a sustaining voltage is being simultaneously applied to at least one other section $S_2$ of the PDP. In another embodiment, the simultaneous addressing and sustaining is interlaced whereby one pair of electrodes y and x is addressed without being sustained and an adjacent pair of electrodes y and x is simultaneously sustained without being addressed. This interlacing can be repeated throughout the display. In this embodiment, a section S is defined as one or more pairs of interlaced y and x electrodes. In the practice of SAS, the row scan and bulk sustain electrodes of one section that is being sustained may have a reference voltage which is offset from the voltages applied to the data electrodes for the addressing of another section such that the addressing does not electrically interact with the row scan and bulk sustain electrodes of the section which is being sustained.

In a plasma display in which gray scale is realized through time multiplexing, a frame or a field of picture data is divided into subfields. Each subfield is typically composed of a reset period, an addressing period, and a number of sustains. The number of sustains in a subfield corresponds to a specific gray scale weight. Pixels that are selected to be "on" in a given subfield will be illuminated proportionally to the number of sustains in the subfield. In the course of one frame, pixels may be selected to be "on" or "off" for the various subfields. A gray scale image is realized by integrating in time the various "on" and "off" pixels of each of the subfields. Addressing is the selective application of data to individual pixels. It includes the writing or erasing of individual pixels. Reset is a voltage pulse, which forms wall charges to enhance the addressing of a pixel. It can be of various waveform shapes and voltage amplitudes including fast or slow rise time voltage ramps and exponential voltage pulses. A reset is typically used at the start of a frame before the addressing of a section. A reset may also be used before the addressing period of a subsequent subfield. In accordance with another embodiment of the SAS architecture, there is applied a slow rise time or slow ramp reset voltage as disclosed in U.S. Pat. No. 5,745,086 (Weber) cited above and incorporated herein by reference. As used herein "slow rise time or slow ramp voltage" is a bulk address commonly called a reset pulse with a positive or negative slope so as to provide a uniform wall charge at all pixels in the PDP. The slower the rise time of the reset ramp, the less visible the light or background glow from those off-pixels (not in the on-state) during the slow ramp bulk address.

Less background glow is particularly desirable for increasing the contrast ratio, which is inversely proportional to the light-output from the off pixels during the reset pulse. Those off-pixels, which are not in the on-state, will give a background glow during the reset. The slower the ramp, the less light output with a resulting higher contrast ratio. Typically the slow ramp reset voltages disclosed in the prior art have a slope of about 3.5 volts per microsecond with a range of about 2 to about 9 volts per microsecond. In the SAS architecture, it is possible to use "slow ramp reset voltages" below 2 volts per microsecond, for example about 1 to 1.5 volts per microsecond without decreasing the number of PDP rows, without decreasing the number of sustain pulses or without decreasing the number of subfields.

Positive Column Gas Discharge

In one embodiment of this invention, it is contemplated that the PDP may be operating using positive column discharge. The use of plasma-tubes and/or plasma-shells, including plasma-spheres, plasma-discs, and plasma-domes allow the PDP to be operated with Positive column Gas Discharge, for example as disclosed by Weber, Rutherford, and other prior art cited hereinafter and incorporated herein by reference. The discharge length inside the plasma-shell must be sufficient to accommodate the length of the Positive Column Gas discharge, generally up to about 1400 micrometers. The plasma-discs or plasma-domes may comprise flattened or partially flattened microspheres. In some embodiments, elongated tubes called plasma-tubes may be used. The flattened tubes may be of any geometric shape and of any predetermined length, typically up to about 1400 micrometers to accommodate positive column discharge. A plasma-tube differs from a plasma-shell by containing multiple gas discharge cells or pixels, i.e. 100 or more pixels. The following prior art references relate to positive column discharge and are incorporated herein by reference.

U.S. Pat. No. 6,184,848 (Weber) discloses the generation of a "positive column" plasma discharge wherein the plasma discharge evidences a balance of positively charged ions and electrons. The PDP discharge operates using the same fundamental principal as a fluorescent lamp, i.e., a PDP employs ultraviolet light generated by a gas discharge to excite visible light emitting phosphors. Weber discloses an inactive isolation bar. Rutherford, James. "PDP With Improved Drive Performance at Reduced Cost.," *Proceedings of the Ninth International Display Workshops*, Hiroshima, Japan (Dec. 4-6, 2002): 837-840 discloses an electrode structure and electronics for a "positive column" plasma display. Rutherford discloses the use of the isolation bar as an active electrode. Additional positive column gas discharge prior art incorporated herein by reference include, Weber, Larry F. "Positive Column AC Plasma Display," 23rd *International Display Research Conference Proceedings*, Phoenix Ariz. IDRC 03, (Sep. 16-18, 2003): 119-124; Nagomy et al. "Dielectric Properties and Efficiency of Positive Column AC PDP," 23rd *International Display Research Conference*, IDRC 03, Phoenix, Ariz. (Sep. 16-18, 2003) P-45: 300-303; Drallos et al. "Simulations of AC PDP Positive Column and Cathode Fall Efficiencies." 23rd *International Display Research Conference Proceedings*, IDRC 03, Phoenix, Ariz. (Sep. 16-18, 2003) P-48: 304-306; U.S. Pat. Nos. 6,376,995 (Kato et al.), 6,528,952 (Kato et al.), 6,693,389 (Marcotte et al.), 6,768,478 (Wani et al.), 7,122,961 (Wedding), 7,157,854 (Wedding), 7,176,628 (Wedding), and U.S. Patent Application 2003/0102812 (Marcotte et al.).

Radio Frequency

The plasma-shells or plasma-tubes used in the PDP may be operated with radio frequency (RF). The RF is used to sustain the plasma discharge. RF may also be used to operate the plasma-shells or plasma-tubes with a positive column discharge. The use of RF in a PDP is disclosed in U.S. Pat. Nos. 6,271,810 (Yoo et al.), 6,340,866 (Yoo), 6,473,061 (Lim et al.), 6,476,562 (Yoo et al.), 6,483,489 (Yoo et al.), 6,501,447 (Kang et al.), 6,605,897 (Yoo), 6,624,799 (Kang et al.), 6,661,394 (Choi), and 6,794,820 (Kang et al.), all incorporated herein by reference.

Shell Materials

The plasma-shell or plasma-tube may be constructed of any suitable material such as glass or plastic as disclosed in the prior art. In the practice of this invention, it is contemplated that the plasma-shell or plasma-tube may be made of any suitable inorganic compounds of metals and/or metalloids, including mixtures or combinations thereof. Contemplated inorganic compounds include the oxides, carbides, nitrides, nitrates, silicates, aluminates, phosphates, sulfides, sulfates, and/or borates. The metals and/or metalloids are selected from magnesium, calcium, strontium, barium, yttrium, lanthanum, cerium, neodymium, gadolinium, terbium, erbium, thorium, titanium, zirconium, hafnium, vanadium, niobium, tantalum, chromium, molybdenum, tungsten, manganese, rhenium, iron, ruthenium, osmium, cobalt, rhodium, iridium, nickel, copper, silver, zinc, cadmium, boron, aluminum, gallium, indium, thallium, carbon, silicon, germanium, tin, lead, phosphorus, and bismuth. Inorganic materials suitable for use are magnesium oxide(s), aluminum oxide(s), zirconium oxide(s), and silicon carbide(s) such as MgO, $Al_2O_3$, $ZrO_2$, $SiO_2$, and/or SiC.

In one embodiment of this invention, the plasma-shell or plasma-tube is made of fused particles of glass, ceramic, glass ceramic, refractory, fused silica, quartz, or like amorphous and/or crystalline materials including mixtures of such. In one preferred embodiment, a ceramic material is selected based on its transmissivity to light after firing. This may include selecting ceramics material with various optical cut-off frequencies to produce various colors. One preferred material contemplated for this application is aluminum oxide. Aluminum oxide is transmissive from the UV range to the IR range. Because it is transmissive in the UV range, phosphors excited by UV may be applied to the exterior of the plasma-shell or plasma-tube to produce various colors. The application of the phosphor to the exterior of the plasma-shell or plasma-tube may be done by any suitable means before or after the plasma-shell or plasma-tube is positioned in the PDP, i.e., on a flexible or rigid substrate. There may be applied several layers or coatings of phosphors, each of a different composition.

In one specific embodiment of this invention, the plasma-shell or plasma-tube is made of an aluminate silicate or contains a layer of aluminate silicate. When the ionizable gas mixture contains helium, the aluminate silicate is especially beneficial in preventing the escaping of helium. It is also contemplated that the plasma-shell or plasma-tube may be made of lead silicates, lead phosphates, lead oxides, borosilicates, alkali silicates, aluminum oxides, and pure vitreous silica.

For secondary electron emission, the plasma-shell or plasma-tube may be made in whole or in part from one or more materials such as magnesium oxide having a sufficient Townsend coefficient. These include inorganic compounds of magnesium, calcium, strontium, barium, gallium, lead, aluminum, boron, and the rare earths especially lanthanum, cerium, actinium, and thorium. The contemplated inorganic compounds include oxides, carbides, nitrides, nitrates, silicates, aluminates, phosphates, borates, and other inorganic compounds of the above and other elements.

The plasma-shell or plasma-tube may also contain or be partially or wholly constructed of luminescent materials such as inorganic phosphor(s). The phosphor may be a continuous or discontinuous layer or coating on the interior or exterior of the shell. Phosphor particles may also be introduced inside the plasma-shell or plasma-tube or embedded within the shell. Luminescent quantum dots may also be incorporated into the shell.

Secondary Electron Emission

The use of secondary electron emission (Townsend coefficient) materials in a plasma display is well known in the prior art and is disclosed in U.S. Pat. No. 3,716,742 (Nakayama et al.) The use of Group IIA compounds including magnesium oxide is disclosed in U.S. Pat. Nos. 3,836,393 and 3,846,171. The use of rare earth compounds in an AC plasma display is disclosed in U.S. Pat. Nos. 4,126,807, 4,126,809, and 4,494,038, all issued to Wedding et al., and incorporated herein by reference. Lead oxide may also be used as a secondary electron material. Mixtures of secondary electron emission materials may be used. In one embodiment and mode contemplated for the practice of this invention, the secondary electron emission material is magnesium oxide on part or all of the internal surface of a plasma-shell or plasma-tube. The secondary electron emission material may also be on the external surface. The thickness of the magnesium oxide may range from about 250 Angstrom Units to about 10,000 Angstrom Units (Å). The entire plasma-shell or plasma-tube may be made of a secondary electronic material such as magnesium oxide. A secondary electron material may also be dispersed or suspended as particles within the ionizable gas such as with a fluidized bed. Phosphor particles may also be dispersed or suspended in the gas such as with a fluidized bed, and may also be added to the inner or external surface of the plasma-shell or plasma-tube. Magnesium oxide increases the ionization level through secondary electron emission that in turn leads to reduced gas discharge voltages. In one embodiment, the magnesium oxide is on the inner surface of the plasma-shell or plasma-tube and the phosphor is located on external surface of the plasma-shell or plasma-tube. Magnesium oxide is susceptible to contamination. To avoid contamination, gas discharge (plasma) displays are assembled in clean rooms that are expensive to construct and maintain. In traditional plasma panel production, magnesium oxide is applied to an entire open substrate surface and is vulnerable to contamination. The adding of the magnesium oxide layer to the inside of a plasma-shell or plasma-tube minimizes exposure of the magnesium oxide to contamination. The magnesium oxide may be applied to the inside of the plasma-shell or plasma-tube by incorporating magnesium vapor as part of the ionizable gases introduced into the plasma-shell or plasma-tube while the plasma-shell or plasma-tube is at an elevated temperature. The magnesium may be oxidized while at an elevated temperature. In some embodiments, the magnesium oxide may be added as particles to the gas. Other secondary electron materials may be used in place of or in combination with magnesium oxide. In one embodiment hereof, the secondary electron material such as magnesium oxide or any other selected material such as magnesium to be oxidized in situ is introduced into the gas by means of a fluidized bed. Other materials such as phosphor particles or vapor may also be introduced into the gas with a fluid bed or other means.

Ionizable Gas

The hollow plasma-shell or plasma-tube as used in the practice of this invention contain(s) one or more ionizable gas components. In the practice of this invention, the gas is selected to emit photons in the visible, IR, and/or UV spectrum. The UV spectrum is divided into regions. The near UV region is a spectrum ranging from about 340 to 450 nm (nanometers). The mid or deep UV region is a spectrum ranging from about 225 to 340 nm. The vacuum UV region is a spectrum ranging from about 100 to 225 nm. The PDP prior art has used vacuum UV to excite photoluminescent phosphors. In the practice of this invention, it is contemplated using a gas, which provides UV over the entire spectrum ranging from about 100 to about 450 nm. The PDP operates with greater efficiency at the higher range of the UV spectrum, such as in the mid UV and/or near UV spectrum. In one preferred embodiment, there is selected a gas which emits gas discharge photons in the near UV range. In another embodiment, there is selected a gas which emits gas discharge photons in the mid UV range. In one embodiment, the selected gas emits photons from the upper part of the mid UV range through the near UV range, about 275 nm to 450 nm.

As used herein, ionizable gas or gas means one or more gas components. In the practice of this invention, the gas is typically selected from a mixture of the noble or rare gases of neon, argon, xenon, krypton, helium, and/or radon. The rare gas may be a Penning gas mixture. Other contemplated gases include nitrogen, $CO_2$, CO, mercury, halogens, excimers, oxygen, hydrogen, and mixtures thereof. Isotopes of the above and other gases are contemplated. These include isotopes of helium such as helium-3, isotopes of hydrogen such as deuterium (heavy hydrogen), tritium ($T^3$) and DT, isotopes of the rare gases such as xenon-129 and isotopes of oxygen such as oxygen-18. Other isotopes include deuterated gases such as deuterated ammonia ($ND_3$) and deuterated silane ($SiD_4$).

In one embodiment, a two-component gas mixture (or composition) is used such as a mixture of argon and xenon, argon and helium, xenon and helium, neon and argon, neon and xenon, neon and helium, and neon and krypton. Specific two-component gas mixtures (compositions) include about 5% to 90% atoms of argon with the balance xenon. Another two-component gas mixture is a mother gas of neon containing 0.05% to 15% atoms of xenon, argon, or krypton.

This can also be a three-component gas, four-component gas, or five-component gas by using small quantities of an additional gas or gases selected from xenon, argon, krypton, and/or helium. In one embodiment, a three-component ionizable gas mixture is used such as a mixture of argon, xenon, and neon wherein the mixture contains at least 5% to 80% atoms of argon, up to 15% xenon, and the balance neon. The xenon is present in a minimum amount sufficient to maintain the Penning effect. Such a mixture is disclosed in U.S. Pat. No. 4,926,095 (Shinoda et al.), incorporated herein by reference. Other three-component gas mixtures include argon-helium-xenon; krypton-neon-xenon; and krypton-helium-xenon.

U.S. Pat. No. 4,081,712 (Bode et al.), incorporated herein by reference, discloses the addition of helium to a gaseous medium of 90% to 99.99% atoms of neon and 10 to 0.01% atoms of argon, xenon, and/or krypton. In one embodiment there is used a high concentration of helium with the balance selected from one or more gases of neon, argon, xenon, and nitrogen as disclosed in U.S. Pat. No. 6,285,129 (Park) and incorporated herein by reference. A high concentration of xenon may also be used with one or more other gases as disclosed in U.S. Pat. No. 5,770,921 (Aoki et al.), incorporated herein by reference. Pure neon may be used and the plasma-shell or plasma-tubes operated without memory margin using the architecture disclosed by U.S. Pat. No. 3,958,151 (Yano) discussed above and incorporated herein by reference.

Excimers

Excimer gases may also be used as disclosed in U.S. Pat. Nos. 4,549,109 and 4,703,229 issued to Nighan et al., both incorporated herein by reference. Nighan et al. 109 and 229 disclose the use of excimer gases formed by the combination of halogens with rare gases. The halogens include fluorine, chlorine, bromine, and iodine. The rare gases include helium, xenon, argon, neon, krypton, and radon. Excimer gases may emit red, blue, green, or other color light in the visible range or light in the invisible range. The excimer gases may be used alone or in combination with phosphors. U.S. Pat. No. 6,628,088 (Kim et al.), incorporated herein by reference, also discloses excimer gases for a PDP.

Other Gases

Depending upon the application, a wide variety of gases are contemplated for the practice of this invention. Such other applications include gas-sensing devices for detecting radiation and radar transmissions. Such other gases include $C_2H_2$—$CF_4$—Ar mixtures as disclosed in U.S. Pat. Nos. 4,201,692 and 4,309,307 (Christophorou et al.), both incorporated herein by reference. Also contemplated are gases disclosed in U.S. Pat. No. 4,553,062 (Ballon et al.), incorporated herein by reference. Other gases include sulfur hexafluoride, HF, $H_2S$, $SO_2$, SO, $H_2O_2$, and so forth.

Gas Pressure

This invention allows the construction and operation of a gas discharge (plasma) display with gas pressures at or above 1 atmosphere. In the prior art, gas discharge (plasma) displays are operated with the ionizable gas at a pressure below atmospheric. Gas pressures above atmospheric are not used in the prior art because of structural problems. Higher gas pressures above atmospheric may cause the display substrates to separate, especially at elevations of 4000 feet or more above sea level. Such separation may also occur between the substrate and a viewing envelope or dome in a single substrate or monolithic plasma panel structure. In the practice of this invention, the gas pressure inside of the hollow plasma-shell or plasma-tube may be equal to or less than atmospheric pressure or may be equal to or greater than atmospheric pressure. The typical sub-atmospheric pressure is about 150 to 760 Torr. However, pressures above atmospheric may be used depending upon the structural integrity of the plasma-shell or plasma-tube. In one embodiment of this invention, the gas pressure inside of the plasma-shell or plasma-tube is equal to or less than atmospheric, about 150 to 760 Torr, typically about 350 to about 650 Torr. In another embodiment of this invention, the gas pressure inside of the plasma-shell or plasma-tube is equal to or greater than atmospheric. Depending upon the structural strength of the plasma-shell or plasma-tube, the pressure above atmospheric may be about 1 to 250 atmospheres (760 to 190,000 Torr) or greater. Higher gas pressures increase the luminous efficiency of the plasma display.

Gas Processing

This invention avoids the costly prior art gas filling techniques used in the manufacture of gas discharge (plasma) display devices. The prior art introduces gas through one or more apertures into the device requiring a gas injection hole and tube. The prior art manufacture steps typically include heating and baking out the assembled device (before gas fill) at a high-elevated temperature under vacuum for 2 to 12 hours. The vacuum is obtained via external suction through a tube inserted in an aperture. The bake out is followed by back fill of the entire panel with an ionizable gas introduced through the tube and aperture. The tube is then sealed-off. This bake out and gas fill process is a major production bottleneck and yield loss in the manufacture of gas discharge (plasma) display devices, requiring substantial capital equipment and a large amount of process time. For color AC plasma display panels of 40 to 50 inches in diameter, the bake out and vacuum cycle may be 10 to 30 hours per panel or 10 to 30 million hours per year for a manufacture facility producing over 1 million plasma display panels per year. The gas-filled plasma-shells or plasma-tubes used in this invention can be produced in large economical volumes and added to the gas discharge (plasma) display device without the necessity of costly bake out and gas process capital equipment. The savings in capital equipment cost and operations costs are substantial. Also the entire PDP does not have to be gas processed with potential yield loss at the end of the PDP manufacture.

PDP Structure

In one embodiment, each plasma-shell and/or plasma-tube is positioned or located on or in a single substrate or monolithic PDP structure. Single substrate PDP structures are disclosed in U.S. Pat. Nos. 3,646,384 (Lay), 3,652,891 (Janning), 3,666,981 (Lay), 3,811,061 (Nakayama et al.), 3,860,846 (Mayer), 3,885,195 (Amano), 3,935,494 (Dick et al.), 3,964,050 (Mayer), 4,106,009 (Dick), 4,164,678 (Biazzo et al.), and 4,638,218 (Shinoda), all cited above and incorporated herein by reference. Each plasma-shell or plasma-tube may be positioned on the surface of the substrate and/or positioned within the substrate such as in channels, trenches, grooves, wells, cavities, hollows, and so forth. These channels, trenches, grooves, wells, cavities, hollows, etc., may extend through the substrate so that the plasma-shell or plasma-tube positioned therein may be viewed from either side of the substrate.

Each plasma-shell and/or plasma-tube may also be positioned or located on or in a substrate within a dual substrate plasma display structure. These may be placed inside of a gas discharge (plasma) display device, for example, on the substrate along the channels, trenches or grooves between the barrier walls of a plasma display barrier structure such as disclosed in U.S. Pat. Nos. 5,661,500 (Shinoda et al.), 5,674,553 (Shinoda et al.) and U.S. Pat. No. 5,793,158 (Wedding), cited above and incorporated herein by reference. The plasma-shell or plasma-tube may also be positioned within a cavity, well, hollow, concavity, or saddle of a plasma display substrate, for example as disclosed by U.S. Pat. No. 4,827,186 (Knauer et al.), incorporated herein by reference. In a device as disclosed by Wedding 158 or Shinoda et al. 500, the plasma-shell or plasma-tube may be conveniently added to the substrate cavities and the space between opposing electrodes before the device is sealed. An aperture and tube can be used for vacuum bake out if needed of the space between the two opposing substrates, but the costly gas fill operation is eliminated. AC plasma displays of 40 inches or larger are fragile with risk of breakage during shipment and handling. The presence of the plasma-shell or plasma-tube inside of the display device adds structural support and integrity to the device. The plasma-shell or plasma-tube may be sprayed, stamped, pressed, poured, screen-printed, or otherwise applied to the substrate. The substrate surface may contain an adhesive or sticky surface to bind the plasma-shell or plasma-tube to the substrate. The practice of this invention is not limited to a flat surface display. The plasma-shell or plasma-tube may be positioned or located on a conformal surface or substrate so as to conform to a predetermined shape such as a curved or irregular surface. In one embodiment of this invention, each plasma-shell or plasma-tube is positioned within a cavity on a single-substrate or monolithic gas discharge structure that has a flexible or bendable substrate. In another embodiment, the substrate is rigid. The substrate may also be partially or semi-flexible.

Substrate

In accordance with various embodiments of this invention, the PDP may be comprised of a single substrate or dual substrate device with flexible, semi-flexible, or rigid substrates. The substrate may be opaque, transparent, translucent, or non-light transmitting. In some embodiments, there may be used multiple substrates of three or more. Substrates may be flexible films, such as a polymeric film substrate. The flexible substrate may also be made of metallic materials alone or incorporated into a polymeric substrate. Alternatively or in addition, one or both substrates may be made of an optically transparent thermoplastic polymeric material. Examples of such materials are polycarbonate, polyvinyl chloride, polystyrene, polymethyl methacrylate, polyurethane polyimide, polyester, and cyclic polyolefin polymers. More broadly, the substrates may include a flexible plastic such as a material selected from the group consisting of polyether sulfone (PES), polyester terephihalate, polyethylene terephihalate (PET), polyethylene naphtholate, polycarbonate, polybutylene terephihalate, polyphenylene sulfide (PPS), polypropylene, polyester, aramid, polyamide-imide (PAI), polyimide, aromatic polyimides, polyetherimide, acrylonitrile butadiene styrene, and polyvinyl chloride, as disclosed in U.S. Patent Application 2004/0179145 (Jacobsen et al.), incorporated herein by reference. Alternatively, one or both of the substrates may be made of a rigid material. For example, one or both of the substrates may be a glass substrate. The glass may be a conventionally available glass, for example having a thickness of approximately 0.2-1 mm. Alternatively, other suitable transparent materials may be used, such as a rigid plastic or a plastic film. The plastic film may have a high glass transition temperature, for example above 65° C., and may have a transparency greater than 85% at 530 nm. Further details regarding substrates and substrate materials may be found in International Publications Nos. WO 00/46854, WO 00/49421, WO 00/49658, WO 00/55915, and WO 00/55916, the entire disclosures of which are herein incorporated herein by reference. Apparatus, methods, and compositions for producing flexible substrates are disclosed in U.S. Pat. No. 5,469,020 (Herrick), 6,274,508 (Jacobsen et al.), 6,281,038 (Jacobsen et al.), 6,316,278 (Jacobsen et al.), 6,468,638 (Jacobsen et al.), 6,555,408 (Jacobsen et al.), 6,590,346 (Hadley et al.), 6,606,247 (Credelle et al.), 6,665,044 (Jacobsen et al.), and 6,683,663 (Hadley et al.), all of which are incorporated herein by reference.

Positioning of Plasma-Shell or Plasma-Tube on Substrate

The plasma-shell or plasma-tube may be positioned or located on the substrate by any appropriate means. In one embodiment of this invention, the plasma-shell or plasma-tube is bonded to the surface of a monolithic or dual-substrate display such as a PDP. The plasma-shell or plasma-tube may be bonded to the substrate surface with a non-conductive, adhesive material, which can also serve as an insulating barrier to prevent electrically shorting between the conductors or electrodes connected to the plasma-shell or plasma-tube. The plasma-shell or plasma-tube may be mounted or positioned within a substrate well, cavity, hollow, or like depression. The well, cavity, hollow or depression is of suitable dimensions with a mean or average diameter and depth for receiving and retaining the plasma-shell or plasma-tube. As used herein, well includes cavity, hollow, depression, hole, or any similar configuration. In U.S. Pat. No. 4,827,186 (Knauer et al.), there is shown a cavity referred to as a concavity or saddle. The depression, well or cavity may extend partly through the substrate, embedded within or extend entirely through the substrate. The cavity may comprise an elongated channel, trench, or groove extending partially or completely across the substrate. The electrodes must be in direct contact with each plasma-shell or plasma-tube. An air gap between an electrode and the plasma-shell or plasma-tube will cause high operating voltages. A material such as conductive adhesive, and/or conductive filler may be used to bridge or connect the electrode to the plasma-shell or plasma-tube. Such conductive material must be carefully applied so as to not electrically short the electrode to other nearby electrodes. A dielectric material may also be applied to fill any air gap. This also may be an adhesive, etc.

Insulating Barrier

The insulating barrier may comprise any suitable non-conductive material, which bonds the plasma-shell or plasma-tube to the substrate. In one embodiment, there is used an epoxy resin that is the reaction product of epichlorohydrin and bisphenol-A. One such epoxy resin is a liquid epoxy resin, D.E.R. 383, produced by the Dow Plastics group of the Dow Chemical Company.

Light Barriers

Light barriers of opaque, translucent, or non-transparent material may be located between plasma-shells and/or plasma-tubes to prevent optical cross-talk between plasma-shells and/or plasma-tubes, particularly between adjacent plasma-shells and/or plasma-tubes. A black material such as carbon filler is typically used.

Electrically-Conductive Bonding Substance

In the practice of this invention, the conductors or electrodes are electrically connected to each plasma-shell or plasma-tube with an electrically conductive bonding substance. The electrically conductive bonding substance can be any suitable inorganic or organic material including compounds, mixtures, dispersions, pastes, liquids, cements, and adhesives. In one embodiment, the electrically conductive bonding substance is an organic substance with conductive filler material. Contemplated organic substances include adhesive monomers, dimers, trimers, polymers and copolymers of materials such as polyurethanes, polysulfides, silicones, and epoxies. A wide range of other organic or polymeric materials may be used. Contemplated conductive filler materials include conductive metals or metalloids such as silver, gold, platinum, copper, chromium, nickel, aluminum, and carbon. The conductive filler may be of any suitable size and form such as particles, powder, agglomerates, or flakes of any suitable size and shape. It is contemplated that the particles, powder, agglomerates, or flakes may comprise a non-metal, metal, or metalloid core with an outer layer, coating, or film of conductive metal. Some specific embodiments of conductive filler materials include silver-plated copper beads, silver-plated glass beads, silver particles, silver flakes, gold-plated copper beads, gold-plated glass beads, gold particles, gold flakes, and so forth. In one particular embodiment of this invention there is used an epoxy filled with 60% to 80% by weight silver. Examples of electrically conductive bonding substances are well known in the art. The disclosures including the compositions of the following references are incorporated herein by reference. U.S. Pat. No. 3,412,043 (Gilliland) discloses an electrically conductive composition of silver flakes and resinous binder. U.S. Pat. No. 3,983,075 (Marshall et al.) discloses a copper filled electrically conductive epoxy. U.S. Pat. No. 4,247,594 (Shea et al.) discloses an electrically conductive resinous composition of copper flakes in a resinous binder. U.S. Pat. Nos. 4,552,607 and 4,670,339 (Frey) disclose a method of forming an electrically conductive bond using copper microspheres in an epoxy. U.S. Pat. No. 4,880,570 (Sanborn et al.) discloses an electrically-conductive epoxy-based adhesive selected from the amine curing modified epoxy family with a filler of silver flakes. U.S. Pat. No. 5,183,593 (Durand et al.) discloses an electrically conductive cement comprising a polymeric carrier such as a mixture of two epoxy resins and filler particles selected from silver agglomerates, particles, flakes, and powders. The filler may be silver-plated particles such as inorganic spheroids plated with silver. Other noble metals and non-noble metals such as nickel are disclosed. U.S. Pat. No. 5,298,194 (Carter et al.) discloses an electrically conductive adhesive composition comprising a polymer or copolymer of polyolefins or polyesters filled with silver particles. U.S. Pat. No. 5,575,956 (Hermansen et al.) discloses electrically-conductive, flexible epoxy adhesives comprising a polymeric mixture of a polyepoxide resin and an epoxy resin filled with conductive metal powder, flakes, or non-metal particles having a metal outer coating. The conductive metal is a noble metal such as gold, silver, or platinum. Silver-plated copper beads and silver-plated glass beads are also disclosed. U.S. Pat. No. 5,891,367 (Basheer et al.) discloses a conductive epoxy adhesive comprising an epoxy resin cured or reacted with selected primary amines and filled with silver flakes. The primary amines provide improved impact resistance. U.S. Pat. No. 5,918,364 (Kulesza et al.) discloses substrate bumps or pads formed of electrically conductive polymers filled with gold or silver. U.S. Pat. No. 6,184,280 (Shibuta) discloses an organic polymer containing hollow carbon microfibers and an electrically conductive metal oxide powder. In another embodiment, the electrically conductive bonding substance is an organic substance without a conductive filler material. Examples of electrically conductive bonding substances are well known in the art. The disclosures including the compositions of the following references are incorporated herein by reference. U.S. Pat. No. 5,645,764 (Angelopoulos et al.) discloses electrically conductive pressure sensitive polymers without conductive fillers. Examples of such polymers include electrically-conductive substituted and unsubstituted polyanilines, substituted and unsubstituted polyparaphenylenes, substituted and unsubstituted polyparaphenylene vinylenes, substituted and unsubstituted polythiophenes, substituted and unsubstituted polyazines, substituted and unsubstituted polyfuranes, substituted and unsubstituted polypyrroles, substituted and unsubstituted polyselenophenes, substituted and unsubstituted polyphenylene sulfides and substituted and unsubstituted polyacetylenes formed from soluble precursors. Blends of these polymers are suitable for use as are copolymers made from the monomers, dimers, or trimers, used to form these polymers. Electrically conductive polymer compositions are also disclosed in U.S. Pat. Nos. 5,917,693 (Kono et al.), 6,096,825 (Garnier), and 6,358,438 (Isozaki et al.), all incorporated herein by reference.

The electrically conductive polymers disclosed above may also be used with conductive fillers. In some embodiments, organic ionic materials such as calcium stearate may be added to increase electrical conductivity. See U.S. Pat. No. 6,599,446 (Todt et al.), incorporated herein by reference. In one embodiment hereof, the electrically conductive bonding substance is luminescent, for example as disclosed in U.S. Pat. No. 6,558,576 (Brielmann et al.), incorporated herein by reference.

EMI/RFI Shielding

In some embodiments, electroconductive bonding substances may be used for EMI (electromagnetic interference) and/or RFI (radio-frequency interference) shielding. Examples of such EMI/RFI shielding are disclosed in U.S. Pat. Nos. 5,087,314 (Sandborn et al.) and 5,700,398 (Angelopoulos et al.), both incorporated herein by reference.

Electrodes

One or more hollow plasma-shells or plasma-tubes containing the ionizable gas are located within the display panel structure, each plasma-shell, or plasma-tube being in contact with at least two electrodes. In accordance with this invention, the contact is made by an electrically conductive bonding substance applied to each shell so as to form an electrically conductive pad for connection to the electrodes. A dielectric substance may also be used in lieu of or in addition to the conductive substance. Each electrode pad may partially cover the outside shell surface of the plasma-shell or plasma-tube. The electrodes and pads may be of any geometric shape or configuration. In one embodiment the electrodes are opposing arrays of electrodes, one array of electrodes being transverse or orthogonal to an opposing array of electrodes. The electrode arrays can be parallel, zigzag, serpentine, or like pattern as typically used in dot-matrix gas discharge (plasma)

displays. The use of split or divided electrodes is contemplated as disclosed in U.S. Pat. Nos. 3,603,836 (Grier) and 3,701,184 (Grier), incorporated herein by reference. Apertured electrodes may be used as disclosed in U.S. Pat. Nos. 6,118,214 and 5,411,035 (Marcotte) and U.S. Patent Application 2004/0001034 (Marcotte), all incorporated herein by reference. The electrodes are of any suitable conductive metal or alloy including gold, silver, aluminum, or chrome-copper-chrome. If a transparent electrode is used on the viewing surface, this is typically indium tin oxide (ITO) or tin oxide with a conductive side or edge bus bar of silver. Other conductive bus bar materials may be used such as gold, aluminum, or chrome-copper-chrome. The electrodes may partially cover the external surface of the plasma-shell or plasma-tube. The electrode array may be divided into two portions and driven from both sides with a so-called dual scan architecture as disclosed in U.S. Pat. Nos. 4,233,623 (Pavliscak) and 4,320,418 (Pavliscak), both incorporated herein by reference. A flat plasma-shell surface is particularly suitable for connecting electrodes to the plasma-shell. If one or more electrodes connect to the bottom of plasma-shell, a flat bottom surface is desirable. Likewise, if one or more electrodes connect to the top or sides of the plasma-shell, it is desirable for the connecting surface of such top or sides to be flat. The electrodes may be applied to the substrate or to the plasma-shell or plasma-tube by thin film methods such as vapor phase deposition, E-beam evaporation, sputtering, conductive doping, etc. or by thick film methods such as screen printing, ink jet printing, etc. In a matrix display, the electrodes in each opposing transverse array are transverse to the electrodes in the opposing array so that each electrode in each array forms a crossover with an electrode in the opposing array, thereby forming a multiplicity of crossovers. Each crossover of two opposing electrodes forms a discharge point or cell. At least one hollow plasma-shell or plasma-tube containing ionizable gas is positioned in the gas discharge (plasma) display device at the intersection of at least two opposing electrodes. When an appropriate voltage potential is applied to an opposing pair of electrodes, the ionizable gas inside of the plasma-shell or plasma-tube at the crossover is energized and a gas discharge occurs. Photons of light in the visible and/or invisible range are emitted by the gas discharge.

Shell Geometry

The shell of the plasma-shell may be of any suitable volumetric shape or geometric configuration to encapsulate the ionizable gas independently of the PDP or PDP substrate. As used herein, plasma-shell includes plasma-sphere, plasma-disc, and/or plasma-dome. The volumetric and geometric shapes include but are not limited to spherical, oblate, spheroid, prolate spheroid, capsular, elliptical, ovoid, egg shape, bullet shape, pear, and/or tear drop. In an oblate spheroid, the diameter at the polar axis is flattened and is less than the diameter at the equator. In a prolate spheroid, the diameter at the equator is less than the diameter at the polar axis such that the overall shape is elongated. Likewise, the shell cross-section may be of any geometric design. The size of the plasma-shell or plasma-tube used in the practice of this invention and/or the discharge distance between electrodes may vary over a wide range. In a gas discharge display, the average diameter and/or discharge distance between electrodes for a plasma-shell or plasma-tube is about 1 mil to 20 mils (where one mil equals 0.001 inch) or about 25 microns to 500 microns where 25.4 microns (micrometers) equals 1 mil or 0.001 inch. Plasma-shells or plasma-tubes can be manufactured up to 200 mils or about 5000 microns or more in diameter. The thickness of the wall of each hollow plasma-shell or plasma-tube must be sufficient to retain the gas inside, but thin enough to allow passage of photons emitted by the gas discharge. The wall thickness of the plasma-shell or plasma-tube should be kept as thin as practical to minimize photon absorption, but thick enough to retain sufficient strength so that the plasma-shells or plasma-tubes can be easily handled and pressurized. The average diameter or discharge distance between electrodes for the plasma-shells or plasma-tubes may be varied for different phosphors to achieve color balance. Thus for a gas discharge display having phosphors which emit red, green, and blue light in the visible range, the plasma-shells or plasma-tubes for the red phosphor may have an average diameter or discharge distance between electrodes less than that of the plasma-shells or plasma-tubes for the green or blue phosphor. Typically the average diameter or discharge distance for the red phosphor plasma-shells or plasma-tubes is about 80% to 95% of that for the green phosphor plasma-shells or plasma-tubes. The average diameter discharge distance of the blue phosphor plasma-shells or plasma-tubes may be greater than the average diameter or discharge distance for the red or green phosphor plasma-shells or plasma-tubes. Typically the average plasma-shell or plasma-tube diameter or discharge distance for the blue phosphor is about 105% to 125% of that for the green phosphor and about 110% to 155% of that for the red phosphor. In another embodiment using a high brightness green phosphor, the red and green plasma-shell or plasma-tube may be reversed such that the average diameter or discharge distance of the green phosphor plasma-shell or plasma-tube is about 80% to 95% of that for the red phosphor plasma-shell or plasma-tube. In this embodiment, the average diameter or discharge distance of the blue plasma-shell or plasma-tube is 105% to 125% of that for the red phosphor and about 110% to 155% of that for the green phosphor. The red, green, and blue plasma-shells or plasma-tubes may also have different size diameters so as to enlarge voltage margin and improve luminance uniformity as disclosed in U.S. Patent Application Publication 2002/0041157 A1 (Heo), incorporated herein by reference. The widths of the corresponding electrodes for each RBG plasma-shell or plasma-tube may be of different dimensions such that an electrode is wider or narrower for a selected phosphor as disclosed in U.S. Pat. No. 6,034,657 (Tokunaga et al.), incorporated herein by reference. There also may be used combinations of different geometric shapes for different colors. Thus there may be used a square cross section plasma-shell or plasma-tube for one color, a circular cross-section for another color, and another geometric cross section for a third color. A combination of plasma-shell or plasma-tubes of different geometric shape as different pixels in a PDP may be used.

Organic Luminescent Substance

To provide or enhance light output from a plasma-shell or plasma-tube, luminescent material may be positioned in close proximity near and/or on each plasma-shell or plasma-tube. Both organic and inorganic luminescent materials are contemplated and may be located on or within the plasma-shell and/or plasma-tube. The plasma-shell and/or plasma-tube may be made in whole or in part of a luminescent material. Organic luminescent substances may be used alone or in combination with inorganic luminescent substances. Contemplated combinations include mixtures and/or selective layers of organic and inorganic luminescent substances. In accordance with one embodiment of this invention, an organic luminescent substance is located in close proximity to the enclosed gas discharge within a plasma-shell or plasma-tube, so as to be excited by photons from the enclosed gas discharge. In accordance with one embodiment of this invention, an organic photoluminescent substance is positioned on at least a portion of the external surface of a plasma-shell or plasma-tube, so as to be excited by photons from the gas discharge within the plasma-shell or plasma-tube, such that the excited photoluminescent substance emits visible and/or invisible light. As used herein organic luminescent substance comprises one or more organic compounds, monomers, dimers, trimers, polymers, copolymers, or like organic materials, which emit visible and/or invisible light when excited by photons from the gas discharge inside of the plasma-shell or plasma-tube. Such organic luminescent substance may include one or more organic photoluminescent phosphors selected from organic photoluminescent compounds, organic photoluminescent monomers, dimers, trimers, polymers, copolymers, organic photoluminescent dyes, organic photoluminescent dopants, and/or any other organic photoluminescent material. All are collectively referred to herein as organic photoluminescent phosphor. Organic photoluminescent phosphor substances contemplated herein include those organic light emitting diodes or devices (OLED) and organic electroluminescent (EL) materials, which emit light when excited by photons from the gas discharge of a gas plasma discharge. OLED and organic EL substances include the small molecule organic EL and the large molecule or polymeric OLED. Small molecule organic EL substances are disclosed in U.S. Pat. Nos. 4,720,432 (VanSlyke et al.), 4,769,292 (Tang et al.), 5,151,629 (VanSlyke), 5,409,783 (Tang et al.), 5,645,948 (Shi et al.), 5,683,823 (Shi et al.), 5,755,999 (Shi et al.), 5,908,581 (Chen et al.), 5,935,720 (Chen et al.), 6,020,078 (Chen et al.), and 6,069,442 (Hung et al.), 6,348,359 (VanSlyke), and 6,720,090 (Young et al.), all incorporated herein by reference. The small molecule organic light emitting devices may be called SMOLED. Large molecule or polymeric OLED substances are disclosed in U.S. Pat. Nos. 5,247,190 (Friend et al.), 5,399,502 (Friend et al.), 5,540,999 (Yamamoto et al.), 5,900,327 (Pei et al.), 5,804,836 (Heegar et al.), 5,807,627 (Friend et al.), 6,361,885 (Chou), and 6,670,645 (Grushin et al.), all incorporated herein by reference. The polymer light emitting devices may be called PLED. Organic luminescent substances also include OLEDs doped with phosphorescent compounds as disclosed in U.S. Pat. No. 6,303,238 (Thompson et al.), incorporated herein by reference. Organic photoluminescent substances are also disclosed in U.S. Patent Application 2002/0101151 (Choi et al.), U.S. 2002/0063525 (Choi et al.), U.S. 2003/0003225 (Choi et al.), U.S. 2003/0052595 (Yi et al.), U.S. Pat. Nos. 6,610,554 (Yi et al.), and 6,692,326 (Choi et al.), International Publications WO 02/104077 and WO 03/046649, all incorporated herein by reference. In one preferred embodiment of this invention, the organic luminescent phosphorous substance is a color-conversion-media (CCM) that converts light (photons) emitted by the gas discharge to visible or invisible light. Examples of CCM substances include the fluorescent organic dye compounds. In one preferred embodiment, the organic luminescent substance is selected from a condensed or fused ring system such as a perylene compound, a perylene based compound, a perylene derivative, a perylene based monomer, dimer or trimer, a perylene based polymer, and/or a substance doped with a perylene. Photoluminescent perylene phosphor substances are widely known in the prior art. U.S. Pat. No. 4,968,571 (Gruenbaum et al.), incorporated herein by reference, discloses photoconductive perylene materials, which may be used as photoluminescent phosphorous substances. U.S. Pat. No. 5,693,808 (Langhals), incorporated herein by reference, discloses the preparation of luminescent perylene dyes. U.S. Patent Application 2004/0009367 (Hatwar), incorporated herein by reference, discloses the preparation of luminescent materials doped with fluorescent perylene dyes. U.S. Pat. No. 6,528,188 (Suzuki et al.), incorporated herein by reference, discloses the preparation and use of luminescent perylene compounds. These condensed or fused ring compounds are conjugated with multiple double bonds and include monomers, dimers, trimers, polymers, and copolymers. In addition, conjugated aromatic and aliphatic organic compounds are contemplated including monomers, dimers, trimers, polymers, and copolymers. Conjugation as used herein also includes extended conjugation. A material with conjugation or extended conjugation absorbs light and then transmits the light to the various conjugated bonds. Typically the number of conjugate-double bonds ranges from about 4 to about 15. Further examples of conjugate-bonded or condensed/fused benzene rings are disclosed in U.S. Pat. No. 6,614,175 (Aziz et al.) and U.S. 6,479,179 (Hu et al.), both incorporated herein by reference. U.S. Patent Application 2004/0023010 (Bulovic et al.) discloses luminescent nanocrystals with organic polymers including conjugated organic polymers. Cumulene is conjugated only with carbon and hydrogen atoms. Cumulene becomes more deeply colored as the conjugation is extended. Other condensed or fused ring luminescent compounds may also be used including naphthalimides, substituted naphthalimides, naphthalimide monomers, dimers, trimers, polymers, copolymers and derivatives thereof including naphthalimide diester dyes such as disclosed in U.S. Pat. No. 6,348,890 (Likavec et al.), incorporated herein by reference. The organic luminescent substance may be an organic lumophor, for example as disclosed in U.S. Pat. Nos. 5,354,825 (Klainer et al.), 5,480,723 (Klainer et al.), 5,700,897 (Klainer et al.), and 6,538,263 (Park et al.), all incorporated herein by reference. Also lumophores are disclosed in S. E. Shaheen et al., *Journal of Applied Physics*, Vol. 84, Number 4, pages 2324 to 2327, Aug. 15, 1998; J. D. Anderson et al., *Journal American Chemical Society* 1998, Vol. 120, pages 9646 to 9655; and Gyu Hyun Lee et al., *Bulletin of Korean Chemical Society*, 2002, Vol. 23, No. 3, pages 528 to 530, all incorporated herein by reference. The organic luminescent substance may be applied by any suitable method to the external surface of the plasma-shell or plasma-tube and/or to the substrate or to any location in close proximity to the gas discharge contained within the plasma-shell or plasma-tube. Such methods include thin film deposition methods such as vapor phase deposition, sputtering and E-beam evaporation. Also thick film or application methods may be used such as screen-printing, ink jet printing, and/or slurry techniques. Small size molecule OLED materials are typically deposited upon the external surface of the plasma-shell or plasma-tube by thin film deposition methods such as vapor phase deposition or sputtering. Large size molecule or polymeric OLED materials are deposited by so called thick film or application methods such as screen-printing, ink jet, and/or slurry techniques. If the organic luminescent substance such as a photoluminescent phosphor is applied to the external surface of the plasma-shell or plasma-tube, it may be applied as a continuous or discontinuous layer or coating such that the plasma-shell or plasma-tube is completely or partially covered with the luminescent substance.

Inorganic Luminescent Substances

Inorganic luminescent substances may be used alone or in combination with organic luminescent substances. Contemplated combinations include mixtures and/or selective layers of organic and/or inorganic substances. The inorganic luminescent material may be dispersed within organic luminescent material or vice versa. The shell may be made of inorganic luminescent substance. In one embodiment the inorganic luminescent substance is incorporated into the particles forming the shell structure. Typical inorganic luminescent substances are discussed below.

Green Phosphor

A green light-emitting phosphor may be used alone or in combination with other light-emitting phosphors such as blue or red. Phosphor materials which emit green light include $Zn_2SiO_4$:Mn, ZnS:Cu, ZnS:Au, ZnS:Al, ZnO:Zn, CdS:Cu, CdS:$Al_2$, $Cd_2O_2S$:Tb, and $Y_2O_2S$:Tb. In one mode and embodiment of this invention using a green light-emitting phosphor, there is used a green light-emitting phosphor selected from the zinc orthosilicate phosphors such as $ZnSiO_4:Mn^{2+}$. Green light-emitting zinc orthosilicates including the method of preparation are disclosed in U.S. Pat. No. 5,985,176 (Rao), which is incorporated herein by reference. These phosphors have a broad emission in the green region when excited by 147 nm and 173 nm (nanometers) radiation from the discharge of a xenon gas mixture. In another mode and embodiment of this invention there is used a green light-emitting phosphor which is a terbium activated yttrium gadolinium borate phosphor such as (Gd, Y) $BO_3$:$Tb^{3+}$. Green light-emitting borate phosphors including the method of preparation are disclosed in U.S. Pat. No. 6,004,481 (Rao), which is incorporated herein by reference. In another mode and embodiment there is used a manganese activated alkaline earth aluminate green phosphor as disclosed in U.S. Pat. No. 6,423,248 (Rao), peaking at 516 nm when excited by 147 and 173 nm radiation from xenon. The particle size ranges from 0.05 to 5 microns. Rao 248 is incorporated herein by reference. Terbium doped phosphors may emit in the blue region especially in lower concentrations of terbium. For some display applications such as television, it is desirable to have a single peak in the green region at 543 nm. By incorporating a blue absorption dye in a filter, any blue peak can be eliminated. Green light-emitting terbium-activated lanthanum cerium orthophosphate phosphors are disclosed in U.S. Pat. No. 4,423,349 (Nakajima et al.), which is incorporated herein by reference. Green light-emitting lanthanum cerium terbium phosphate phosphors are disclosed in U.S. Pat. No. 5,651,920, which is incorporated herein by reference. Green light-emitting phosphors may also be selected from the trivalent rare earth ion-containing aluminate phosphors as disclosed in U.S. Pat. No. 6,290,875 (Oshio et al.).

Blue Phosphor

A blue light-emitting phosphor may be used alone or in combination with other light-emitting phosphors such as green or red. Phosphor materials which emit blue light include ZnS:Ag, ZnS:Cl, and CsI:Na. In one preferred mode and embodiment of this invention, there is used a blue light-emitting aluminate phosphor. An aluminate phosphor which emits blue visible light is divalent europium ($Eu^{2+}$) activated Barium Magnesium Aluminate (BAM) represented by $BaMgAl_{10}O_{17}:Eu^{2+}$. BAM is widely used as a blue phosphor in the PDP industry. BAM and other aluminate phosphors, which emit blue visible light, are disclosed in U.S. Pat. No. 5,611,959 (Kijima et al.) and U.S. Pat. No. 5,998,047 (Bechtel et al.), both incorporated herein by reference. The aluminate phosphors may also be selectively coated as disclosed by Bechtel et al. 047. Blue light-emitting phosphors may be selected from a number of divalent europium-activated aluminates such as disclosed in U.S. Pat. No. 6,096,243 (Oshio et al.) incorporated herein by reference. The preparation of BAM phosphors for a PDP is also disclosed in U.S. Pat. No. 6,045,721 (Zachau et al.), incorporated herein by reference. In another mode and embodiment of this invention, the blue light-emitting phosphor is thulium activated lanthanum phosphate with trace amounts of $Sr^{2+}$ and/or $Li^{+}$. This exhibits a narrow band emission in the blue region peaking at 453 nm when excited by 147 nm and 173 nm radiation from the discharge of a xenon gas mixture. Blue light-emitting phosphate phosphors including the method of preparation are disclosed in U.S. Pat. No. 5,989,454 (Rao), which is incorporated herein by reference. In one mode and embodiment of this invention using a blue-emitting phosphor, a mixture or blend of blue emitting phosphors is used such as a blend or complex of about 70% to 85% by weight of a lanthanum phosphate phosphor activated by trivalent thulium ($Tm^{3+}$), $Li^{+}$, and an optional amount of an alkaline earth element ($AE^{2+}$) as a coactivator and about 15% to 30% by weight of divalent europium-activated BAM phosphor or divalent europium-activated Barium Magnesium, Lanthanum Aluminated (BLAMA) phosphor. Such a mixture is disclosed in U.S. Pat. No. 6,187,225 (Rao), incorporated herein by reference. Blue light-emitting phosphors also include $ZnO.Ga_2O_3$ doped with Na or Bi. The preparation of these phosphors is disclosed in U.S. Pat. Nos. 6,217,795 (Yu et al.) and 6,322,725 (Yu et al.), both incorporated herein by reference. Other blue light-emitting phosphors include europium activated strontium chloroapatite and europium-activated strontium calcium chloroapatite.

Red Phosphor

A red light-emitting phosphor may be used alone or in combination with other light-emitting phosphors such as green or blue. Phosphor materials which emit red light include $Y_2O_2S$:Eu and $Y_2O_3S$:Eu. In a best mode and embodiment of this invention using a red-emitting phosphor, there is used a red light-emitting phosphor which is an europium activated yttrium, gadolinium borate phosphor such as (Y,Gd)$BO_3:Eu^{3+}$. The composition and preparation of red-emitting borate phosphors is disclosed in U.S. Pat. No. 6,042,747 (Rao) and U.S. Pat. No. 6,284,155 (Rao), both incorporated herein by reference. These europium activated yttrium, gadolinium borate phosphors emit an orange line at 593 nm and red emission lines at 611 and 627 nm when excited by 147 nm and 173 nm UV radiation from the discharge of a xenon gas mixture. For television (TV) applications, it is preferred to have only the red emission lines (611 and 627 nm). The orange line (593 nm) may be minimized or eliminated with an external optical filter. A wide range of red-emitting phosphors is used in the PDP industry and is contemplated in the practice of this invention including europium-activated yttrium oxide.

Other Phosphors

There also may be used phosphors other than red, blue, green such as a white light-emitting phosphor, pink light-emitting phosphor or yellow light-emitting phosphor. These may be used with an optical filter. Phosphor materials which emit white light include calcium compounds such as $3Ca_3(PO_4)_2$.CaF:Sb, $3Ca_3(PO_4)_2$.CaF:Mn, $3Ca_3(PO_4)_2$.CaCl:Sb, and $3Ca_3(PO_4)_2$.CaCl:Mn. White-emitting phosphors are disclosed in U.S. Pat. No. 6,200,496 (Park et al.) incorporated herein by reference. Pink-emitting phosphors are disclosed in U.S. Pat. No. 6,200,497 (Park et al.) incorporated herein by reference. Phosphor material which emits yellow light include ZnS.Au.

Organic and Inorganic Luminescent Materials

Inorganic and organic luminescent materials may be used in any suitable selected combinations. Inorganic luminescent material may be mixed or dispersed within an organic luminescent material. Organic luminescent material may be mixed or dispersed within an inorganic luminescent material. In one embodiment, multiple layers of luminescent materials are applied to the plasma-shell or plasma-tube with at least one layer being organic and at least one layer being inorganic. An inorganic layer may serve as a protective overcoat for an organic layer. In another embodiment, the shell of the plasma-shell or plasma-tube comprises or contains inorganic luminescent material. In another embodiment, organic and inorganic luminescent materials are mixed together and applied as a layer inside or outside the shell. The shell may also be made of or contain a mixture of organic and inorganic luminescent materials. In one preferred embodiment, a mixture of organic and inorganic material is applied outside the shell.

Photon Exciting of Luminescent Substance

In the best embodiment contemplated in the practice of this invention, a layer, coating, or particles of inorganic and/or organic luminescent substances such as phosphor is located on the exterior wall of the plasma-shell or plasma-tube. The photons of light pass through the shell or wall(s) of the plasma-shell or plasma-tube and excite the organic or inorganic photoluminescent phosphor located outside of the plasma-shell or plasma-tube. The phosphor may be located on the side wall(s) of a channel, trench, barrier, groove, cavity, well, hollow or like structure of the discharge space. In one embodiment, the gas discharge within the channel, trench, barrier, groove, cavity, well or hollow produces photons that excite the inorganic and/or organic phosphor such that the phosphor emits light in a range visible to the human eye. Typically this is red, blue, or green light. However, phosphors may be used which emit other light such as white, pink, or yellow light. In some embodiments of this invention, the emitted light may not be visible to the human eye. In prior art AC plasma display structures as disclosed in U.S. Pat. Nos. 5,793,158 (Wedding) and 5,661,500 (Shinoda et al.), inorganic and/or organic phosphor is located on the wall(s) or side(s) of the barriers that form the channel, trench, groove, cavity, well, or hollow. Phosphor may also be located on the bottom of the channel, trench, or groove as disclosed by Shinoda et al. 500 or the bottom cavity, well, or hollow as disclosed by U.S. Pat. No. 4,827,186 (Knauer et al.). The plasma-shell or plasma-tubes are positioned within or along the walls of a channel, barrier, trench, groove, cavity, well or hollow so as to be in close proximity to the phosphor. Thus in one embodiment of this invention, plasma-shell or plasma-tubes are positioned within the channels, barriers, trenches, grooves, cavities, wells, or hollows, such that photons from the gas discharge within the plasma-shell or plasma-tube cause the phosphor along the wall(s), side(s) or at the bottom of the channel, barrier, trenches groove, cavity, well, or hollow, to emit light. In another embodiment of this invention, phosphor is located on the outside surface of each plasma-shell or plasma-tube. In this embodiment, the outside surface is at least partially covered with phosphor that emits light in the visible or invisible range when excited by photons from the gas discharge within the plasma-shell or plasma-tube. The phosphor may emit light in the UV, IR, and/or visible range. In one embodiment, phosphor is dispersed and/or suspended within the ionizable gas inside each plasma-shell or plasma-tube. In such embodiment, the phosphor particles are sufficiently small such that most of the phosphor particles remain suspended within the gas and do not precipitate or otherwise substantially collect on the inside wall of the plasma-shell or plasma-tube. The average diameter of the dispersed and/or suspended phosphor particles is less than about 1 micron, typically less than 0.1 microns. Larger particles can be used depending on the size of the plasma-shell or plasma-tube. The phosphor particles may be introduced by means of a fluidized bed. The luminescent substance such as an inorganic and/or organic photoluminescent phosphor may be located on all or part of the external surface of the plasma-shell or plasma-tubes on all or part of the internal surface of the plasma-shell or plasma-tubes. The phosphor may comprise particles dispersed or floating within the gas. In one best embodiment contemplated for the practice of this invention, an inorganic and/or organic luminescent phosphor is located on the external surface of the plasma-shell or plasma-tube. In one embodiment, an inorganic and/or organic luminescent substance is located on the external surface and excited by ultraviolet (UV) photons from the gas discharge inside the plasma-shell or plasma-tube. The phosphor emits light in the visible range such as red, blue, or green light. Phosphors may be selected to emit light of other colors such as white, pink, or yellow. The phosphor may also be selected to emit light in non-visible ranges of the spectrum. Optical filters may be selected and matched with different phosphors. The phosphor thickness is sufficient to absorb the UV, but thin enough to emit light with minimum attenuation. Typically the phosphor thickness is about 2 to 40 microns, preferably about 5 to 15 microns. In one embodiment, dispersed or floating particles within the gas are typically spherical or needle shaped having an average size of about 0.01 to 5 microns. A UV photoluminescent phosphor is excited by UV in the range of 50 to 400 nanometers. The phosphor may have a protective layer or coating which is transmissive to the excitation UV and the emitted visible light. Such include organic films such as perylene or inorganic films such as aluminum oxide or silica. Protective coatings are disclosed and discussed below. Because the ionizable gas is contained within a multiplicity of plasma-shell or plasma-tubes, it is possible to provide a custom gas mixture or composition at a custom pressure in each plasma-shell or plasma-tube for each phosphor. In the prior art, it is necessary to select an ionizable gas mixture and a gas pressure that is optimum for all phosphors used in the device such as red, blue, and green phosphors. However, this requires trade-offs because a particular gas mixture may be optimum for a particular green phosphor, but less desirable for red or blue phosphors. In addition, trade-offs are required for the gas pressure. In the practice of this invention, an optimum gas mixture and an optimum gas pressure may be provided for each of the selected phosphors. Thus the gas mixture and gas pressure inside the plasma-shell or plasma-tubes may be optimized with a custom gas mixture and a custom gas pressure, each or both optimized for each phosphor emitting red, blue, green, white, pink, or yellow light in the visible range or light in the invisible range. The diameter and the wall thickness of the plasma-shell or plasma-tube can also be adjusted and optimized for each phosphor. Depending upon the Paschen Curve (pd v. voltage) for the particular ionizable gas mixture, the operating voltage may be decreased by optimizing the gas mixture, gas pressure, and the diameter of the plasma-shell or plasma-tube.

Up-Conversion

In another embodiment of this invention it is contemplated using an inorganic and/or organic luminescent substance such as a Stokes phosphor for up-conversion, for example to convert infrared radiation to visible light. Up-conversion or Stokes materials include phosphors are disclosed in U.S. Pat. Nos. 3,623,907 (Watts), 3,634,614 (Geusic), 5,541,012

(Ohwaki et al.), 6,265,825 (Asano), and 6,624,414 (Glesener), all incorporated herein by reference. Up-conversion may also be obtained with shell compositions such as thulium doped silicate glass containing oxides of Si, Al, and La, as disclosed in U.S. Patent Application 2004/0037538 (Schardt et al.), incorporated herein by reference. The glasses of Schardt et al. emit visible or UV light when excited by IR. Glasses for up-conversion are also disclosed in Japanese Patents 9054562 and 9086958 (Akira et al.), both incorporated herein by reference. U.S. Pat. No. 5,166,948 (Gavrilovic) discloses an up-conversion crystalline structure. U.S. Pat. No. 6,726,992 (Yadav et al.) discloses nano-engineered luminescent materials including both Stokes and Anti-Stokes down-conversion phosphors. It is contemplated that the plasma-shell and/or plasma-tube may be constructed wholly or in part from an up-conversion, down-conversion material or a combination of both.

Down-Conversion

The luminescent material may also include down-conversion (Anti-Stokes) materials such as phosphors as disclosed in U.S. Pat. No. 3,838,307 (Masi), incorporated herein by reference. Down-conversion luminescent materials are also disclosed in U.S. Pat. Nos. 6,013,538 (Burrows et al.), 6,091,195 (Forrest et al.), 6,208,791 (Bischel et al.), 6,566,156 (Sturm et al.) and 6,650,045 (Forrest et al.). Down-conversion luminescent materials are also disclosed in U.S. Patent applications 2004/0159903 (Burgener, II et al.), 2004/0196538 (Burgener, II et al.), 2005/0093001 (Liu et al.), and 2005/0094109 (Sun et al.). Phosphors are also disclosed in European Patent 0143034 (Maestro et al.), which is also incorporated herein by reference. As noted above, the plasma-shell and/or plasma-tube may be constructed wholly or in part from a down-conversion material, up-conversion material or a combination of both.

Quantum Dots

In one embodiment of this invention, the luminescent substance is a quantum dot material. Examples of luminescent quantum dots are disclosed in International Publication Numbers WO 03/038011, WO 00/029617, WO 03/038011, WO 03/100833, and WO 03/037788, all incorporated herein by reference. Luminescent quantum dots are also disclosed in U.S. Pat. Nos. 6,468,808 (Nie et al.), 6,501,091 (Bawendi et al.), 6,698,313 (Park et al.), and U.S. Patent Application 2003/0042850 (Bertram et al.), all incorporated herein by reference. The quantum dots may be added or incorporated into the shell during shell formation or after the shell is formed.

Protective Overcoat

In a preferred embodiment, the luminescent substance is located on an external surface of the plasma-shell or plasma-tube. Organic luminescent phosphors are particularly suitable for placing on the exterior shell surface, but may require a protective overcoat. The protective overcoat may be inorganic, organic, or a combination of inorganic and organic. This protective overcoat may be an inorganic and/or organic luminescent material. The luminescent substance may have a protective overcoat such as a clear or transparent acrylic compound including acrylic solvents, monomers, dimers, trimers, polymers, copolymers, and derivatives thereof to protect the luminescent substance from direct or indirect contact or exposure with environmental conditions such as air, moisture, sunlight, handling, or abuse. The selected acrylic compound is of a viscosity such that it can be conveniently applied by spraying, screen printing, ink jet, or other convenient methods so as to form a clear film or coating of the acrylic compound over the luminescent substance. Other organic compounds may also be suitable as protective overcoats including silanes such as glass resins. Also the polyesters such as Mylar® may be applied as a spray or a sheet fused under vacuum to make it wrinkle free. Polycarbonates may be used but may be subject to UV absorption and detachment. In one embodiment hereof the luminescent substance is coated with a film or layer of a perylene compound including monomers, dimers, trimers, polymers, copolymers, and derivatives thereof. The perylene compounds are widely used as protective films. Parylene polymer films are also disclosed in U.S. Pat. Nos. 5,879,808 (Wary et al.) and 6,586,048 (Welch et al.), both incorporated herein by reference. The parylene compounds may be applied by ink jet printing, screen printing, spraying, and so forth as disclosed in U.S. Patent Application 2004/0032466 (Deguchi et al.), incorporated herein by reference. Parylene conformal coatings are covered by Mil-I-46058C and ISO 9002. Specific compounds include poly-monochloro-para-xylyene (Parylene C) and poly-para-xylylene (Parylene N). Parylene films may also be induced into fluorescence by an active plasma as disclosed in U.S. Pat. No. 5,139,813 (Yira et al.), incorporated herein by reference. Phosphor overcoats are also disclosed in U.S. Pat. Nos. 4,048,533 (Hinson et al.), 4,315,192 (Skwirut et al.), 5,592,052 (Maya et al.), 5,604,396 (Watanabe et al.), 5,793,158 (Wedding), and 6,099,753 (Yoshimura et al.), all incorporated herein by reference. In some embodiments, the luminescent substance is selected from materials that do not degrade when exposed to oxygen, moisture, sunlight, etc. and that may not require a protective overcoat. Such include various organic luminescent substances such as the perylene compounds disclosed above. For example, perylene compounds may be used as protective overcoats and thus do not require a protective overcoat.

Selected Specific Organic Phosphor Embodiments and Applications

In this invention, plasma-shells or plasma-tubes of any gas encapsulating geometric shape may be used as the pixel elements of a gas plasma display. A full color display is achieved using red, green, and blue pixels. The following are some specific embodiments using an organic luminescent substance such as a luminescent phosphor.

Color Plasma Displays Using UV 300 nm to 380 nm Excitation with Organic Phosphors The organic luminescent substance such as an organic phosphor may be excited by UV ranging from about 300 nm to about 380 nm to produce red, blue, or green emission in the visible range. The encapsulated gas is chosen to excite in this range.

To improve life, the organic phosphor must be separated from the plasma discharge. This may be done by applying the organic phosphor to the exterior of the shell. In this case, it is important that the shell material be selected such that it is transmissive to UV in the range of about 300 nm to about 380 nm. Suitable materials include aluminum oxides, silicon oxides, and other such materials. In the case where helium is used in the gas mixture, aluminum oxide is a desirable shell material, as it does not allow the helium to permeate.

Color Plasma Displays Using UV Excitation Below 300 nm with Organic Phosphors.

Organic phosphors may be excited by UV below 300 nm. In this case, a xenon neon mixture of gases may produce excitation at 147 nm and 172 nm. The plasma-shell or plasma-tube material must be transmissive below 300 nm. Shell materials that are transmissive to frequencies below 300 nm include silicon oxide. The thickness of the shell material must be minimized in order to maximize transmissivity.

Color Plasma Displays Using Visible Blue Above 380 nm with Organic Phosphors.

Organic phosphors may be excited by excitation above 380 nm. The plasma-shell or plasma-tube material is composed completely or partially of an inorganic blue phosphor such as BAM. The shell material fluoresces blue and may be up-converted to red or green with organic phosphors on the outside of the shell.

Infrared Plasma Displays

In some applications it may be desirable to have PDP displays with plasma-shells or plasma-tubes that produce emission in the infrared range for use in night vision applications. This may be done with filters and/or up-conversion phosphors as described above.

Application of Organic Phosphors

Organic phosphors may be added to a UV curable medium and applied to the plasma-shell or plasma-tube with a variety of methods including jetting, spraying, sheet transfer methods, or screen printing. This may be done before or after the plasma-shell or plasma-tube is added to a substrate or back plate.

- Application of Phosphor before plasma-shells or plasma-tubes are added to substrate If organic phosphors are applied to the plasma-shell or plasma-tubes before such are applied to the substrate, additional steps may be necessary to place each plasma-shell or plasma-tube in the correct position on the back substrate.
- Application of Phosphor after plasma-shells or plasma-tubes are added to substrate If the organic phosphor is applied to the plasma-shell or plasma-tubes after such are placed on a substrate, care must be taken to align the appropriate phosphor color with the appropriate plasma-shell or plasma-tube.
- Application of Phosphor after plasma-shells or plasma-tubes are added to substrate-self aligning In one embodiment, the plasma-shells or plasma-tubes may be used to cure the phosphor. A single color organic phosphor is completely applied to the entire substrate containing the plasma-shells or plasma-tubes. Next, the plasma-shells or plasma-tubes are selectively activated to produce UV to cure the organic phosphor. The phosphor will cure on the plasma-shells or plasma-tubes that are activated and may be rinsed away from the plasma-shells or plasma-tubes that were not activated. Additional applications of phosphor of different colors may be applied using this method to coat the remaining shells. In this way the process is completely self-aligning.

Tinted Plasma-Shells or Plasma-Tubes

In the practice of this invention, the plasma-shell or plasma-tube may be color tinted or constructed of materials that are color tinted with red, blue, green, yellow, or like pigments. This is disclosed in U.S. Pat. No. 4,035,690 (Roeber) cited above and incorporated herein by reference. The gas discharge may also emit color light of different wavelengths as disclosed in Roeber '690. The use of tinted materials and/or gas discharges emitting light of different wavelengths may be used in combination with the above described phosphors and the light emitted from such phosphors. Optical filters may also be used.

Filters

This invention may be practiced in combination with an optical and/or electromagnetic (EMI) filter, screen, and/or shield. It is contemplated that the filter, screen, and/or shield may be positioned on a PDP constructed of plasma-shells or plasma-tubes, for example on the front or top-viewing surface. The plasma-shells or plasma-tubes may be tinted. Examples of optical filters, screens, and/or shields are disclosed in U.S. Pat. Nos. 3,960,754 (Woodcock), 4,106,857 (Snitzer), 4,303,298 (Yamashita), 5,036,025 (Lin), 5,804,102 (Oi), and 6,333,592 (Sasa et al.), all incorporated herein by reference. Examples of EMI filters, screens, and/or shields are disclosed in U.S. Pat. Nos. 6,188,174 (Marutsuka) and U.S. Pat. No. 6,316,110 (Anzaki et al.), incorporated herein by reference. Color filters may also be used. Examples are disclosed in U.S. Pat. Nos. 3,923,527 (Matsuura et al.), 4,105,577 (Yamashita), 4,110,245 (Yamashita), and 4,615,989 (Ritze), all incorporated herein by reference.

IR Filters

The plasma-shell PDP may contain an infrared (IR) filter. An IR filter may be selectively used with one or more plasma-shells to absorb or reflect IR emissions from the display. Such IR emissions may come from the gas discharge inside a plasma-shell and/or from a luminescent substance inside and/or outside of a plasma-shell. An IR filter is necessary if the display is used in a night vision application such as with night vision goggles. With night vision goggles, it is typically necessary to filter near IR from about 650 nm (nanometers) or higher, generally about 650 nm to about 900 nm. In some embodiments the plasma-shell may comprise an IR filter material. The plasma-shell may be made from an IR filter material. Examples of IR filter materials include cyanine compounds such as phthalocyanine and naphthalocyanine compounds as disclosed in U.S. Pat. Nos. 5,804,102 (Oi et al.), 5,811,923 (Zieba et al.), and 6,297,582 (Hirota et al.), all incorporated herein by reference. The IR compound may also be an organic dye compound such as anthraquinone as disclosed in Hirota et al. '582 and tetrahedrally coordinated transition metal ions of cobalt and nickel as disclosed in U.S. Pat. No. 7,081,991 (Jones et al.), incorporated herein by reference.

Optical Interference Filter

The filter may comprise an optical interference filter comprising a layer of low refractive index material and a layer of high refractive index material, as disclosed in U.S. Pat. Nos. 4,647,812 (Vriens et al.) and 4,940,636 (Brock et al.), both incorporated herein by reference. In one embodiment, each plasma-shell is composed of a low refraction index material and a high refraction index material. Examples of low refractive index materials include magnesium fluoride and silicon dioxide such as amorphous $SiO_2$. Examples of high refractive index materials include tantalum oxide and titanium oxide. In one embodiment, the high refractive index material is titanium oxide and at least one metal oxide selected from zirconium oxide, hafnium oxide, tantalum oxide, magnesium oxide, and calcium oxide.

Mixtures of Luminescent Materials

It is contemplated that mixtures of luminescent materials may be used including inorganic and inorganic, organic and organic, and inorganic and organic. The brightness of the luminescent material may be increased by dispersing inorganic materials into organic luminescent materials or vice versa.

Layers of Luminescent Materials

Two or more layers of the same or different luminescent materials may be selectively applied to the plasma-shells and/or plasma-tubes. Such layers may comprise combinations of organic and organic, inorganic and inorganic, and/or inorganic and organic.

Combinations of Plasma-Shells

In the practice of this invention, plasma-shells of a single geometry may be used alone or in combination with other plasma-shells of different geometry. Thus the plasma-discs may be used with selected organic and/or inorganic luminescent materials to provide one color with other plasma-shells such as plasma-spheres or plasma-domes used with selected organic and/or or inorganic luminescent materials to provide other colors.

High Resolution Color Display

In a multi-color display such as RGB PDP, plasma-shells with flat sides such as plasma-discs may be stacked on top of each other or arranged in parallel side-by-side positions on the substrate. This configuration requires less area of the display surface compared to conventional RGB displays that require red, green and blue pixels adjacent to each other on the substrate. This stacking embodiment may be practiced with plasma-shells that use various color emitting gases such as the excimer gases. Phosphor coated plasma-shells in combination with excimers may also be used. Each plasma-shell may also be of a different color material such as tinted glass. The plasma-shells used in this stacking arrangement typically have geometric shapes with one or more flat sides such as plasma-discs and/or plasma-domes. A plasma-disc is a plasma-shell with at least two opposing flat sides. The other four sides may be round or flat. A plasma-dome is a plasma-shell with one flat side and an opposing domed side. The other four sides may be round or flat. In some stacking embodiments, other flat-sided shapes may also be used.

Plasma-Tubes

The PDP structure may comprise a combination of plasma-shells and plasma-tubes. Plasma-tubes comprise elongated tubes for example as disclosed in U.S. Pat. Nos. 3,602,754 (Pfaender et al.), 3,654,680 (Bode et al.), 3,927,342 (Bode et al.), 4,038,577 (Bode et al.), 3,969,718 (Stom), 3,990,068 (Mayer et al.), 4,027,188 (Bergman), 5,984,747 (Bhagavatula et al.), 6,255,777 (Kim et al.), 6,633,117 (Shinoda et al.), 6,650,055 (Ishimoto et al.), 6,677,704 (Ishimoto et al.), 7,122,961 (Wedding), 7,157,854 (Wedding), and 7,176,628 (Wedding), all incorporated herein by reference.

As used herein, the elongated plasma-tube is intended to include capillary, filament, filamentary, illuminator, hollow rod, or other such terms. It includes an elongated enclosed gas-filled structure having a length dimension that is greater than its cross-sectional width dimension. The width of the plasma-tube is the viewing width from the top or bottom (front or rear) of the display. The length of each plasma-tube may vary depending upon the PDP structure. In one embodiment hereof, an elongated tube is selectively divided into a multiplicity of lengths. In another embodiment, there is used a continuous tube that winds or weaves back and forth from one end to the other end of the PDP. The length of the plasma-tube is typically about 1400 microns to several feet or more. The PDP may comprise any suitable combination of plasma-shells and plasma-tubes. The plasma-tubes may be arranged in any configuration. In one embodiment, there are alternative rows of plasma-shells and plasma-tubes. The plasma-tubes may be used for any desired function or purpose including the priming or conditioning of the plasma-shells. In one embodiment, the plasma-tubes are arranged around the perimeter of the display to provide priming or conditioning. The plasma-tubes may be of any geometric cross-section including circular, elliptical, square, rectangular, triangular, polygonal, trapezoidal, pentagonal, or hexagonal. In one preferred embodiment, the viewing surface of the plasma-tube is flat. In another embodiment, each electrode-connecting surface such as top, bottom, and/or side(s) is flat. The plasma-tubes may contain secondary electron emission materials, luminescent materials, and reflective materials as discussed herein for plasma-shells. The plasma-tubes may also utilize positive column discharge as discussed herein for plasma-shells. A plasma-tube has multiple gas discharge pixels of about 100 or more, typically about 500 to 5000 or more per tube. A plasma-shell typically has only one gas discharge pixel. In some embodiments the plasma-shell may have more than one pixel, for example 2, 3, 4 pixels up to 10 pixels.

SUMMARY

Aspects of this invention may be practiced with a co-planar or opposing substrate PDP as disclosed in the U.S. Patents, 5,793,158 (Wedding) and 5,661,500 (Shinoda et al.) or with a single-substrate or monolithic PDP as disclosed in the U.S. Pat. Nos. 3,646,384 (Lay,) 3,860,846 (Mayer), 3,935,484 (Dick et al.) and other single substrate patents, discussed above and incorporated herein by reference. In the practice of this invention, the plasma-shells and/or plasma-tubes may be positioned and spaced in an AC gas discharge plasma display structure so as to utilize and take advantage of the positive column of the gas discharge. The positive column is described in U.S. Pat. No. 6,184,848 (Weber) and is incorporated herein by reference. In a positive column application, the plasma-shells and/or plasma-tubes must be sufficient in length along the discharge axis to accommodate the positive column discharge. Although this invention has been disclosed and described above with reference to dot matrix gas discharge displays, it may also be used in an alphanumeric gas discharge display using segmented electrodes. This invention may also be practiced in AC or DC gas discharge displays including hybrid structures of both AC and DC gas discharge. The plasma-shells or plasma-tubes may contain a gaseous mixture for a gas discharge display or may contain other substances such as an electroluminescent (EL) or liquid crystal materials for use with other displays technologies including electroluminescent displays (ELD), liquid crystal displays (LCD), field emission displays (FED), electrophoretic displays, and Organic EL or Organic LED (OLED). The use of plasma-shells or plasma-tubes on a single flexible substrate allows the encapsulated pixel display device to be utilized in a number of applications. In one application, the device is used as a plasma shield to absorb electromagnetic radiation and to make the shielded object invisible to enemy radar. In this embodiment, a flexible sheet of plasma-shells or plasma-tubes may be provided as a blanket over the shielded object. The plasma-shell and/or plasma-tube PDP may also be used as an antenna to receive, transmit, and/or reflect signals. In the embodiments disclosed herein, the PDP device may used to detect radiation such as nuclear radiation from a nuclear device, mechanism, apparatus or container. This is particularly suitable for detecting hidden nuclear devices at airports, loading docks, bridges, and other such locations. The artifact reduction methods of this invention may be practiced with other display technologies. Such other display technologies include DC gas discharge (plasma) displays, electroluminescent displays (ELD), liquid crystal displays (LCD) including active matrix or thin film transistor LCD, passive LCD, light-emitting diode displays (LED), ferroelectric liquid crystal (FLC) displays, organic electroluminescent (OEL) displays, and organic light emitting diode (OLED) displays. OLED is also called organic light emitting display. OLED is divided into molecular electroluminescent (EL) and polymer EL. Molecular OLED is disclosed in the prior art by Eastman Kodak, Pioneer of Japan, and Sanyo of Japan. Polymer OLED is disclosed by Philips of Holland, Dow Chemical, UNIAX, and Cambridge University (UK). OLED may be passive matrix or active matrix. Other display technologies also include projection displays such as digital micro-mirror device (DMD) arrays are disclosed in the prior art by Texas Instruments. Liquid Crystal on Silicon (LCOS) displays are contemplated. This invention is especially suitable with displays which use time multiplexing gray scale. The foregoing description of various preferred embodiments of the invention has been presented for purposes of illustration and description. It is not intended to be exhaustive or to limit the invention to the precise forms disclosed. Obvious modifications or variations are possible in light of the above teachings. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims to be interpreted in accordance with the breadth to which they are fairly, legally, and equitably entitled.

The invention claimed is:

1. In an AC gas discharge plasma display comprising a multiplicity of gas discharge pixels, the improvement wherein each pixel is defined by a plasma-shell in contact with two or more electrodes, electronic circuitry being connected to each electrode for addressing and sustaining the gas discharge of each plasma-shell pixel, and wherein the display has one or more artifact reduction means including gamma correction, error diffusion, and/or dithering.

2. The invention of claim 1 wherein each plasma shell has memory margin.

3. The invention of claim 1 wherein each plasma-shell is a plasma-sphere, plasma-disc, or plasma-dome.

4. The invention of claim 1 wherein each plasma-shell pixel discharge emits photons in the UV, IR, and/or visible range.

5. The invention of claim 1 wherein the display is divided into at least two separate sections, each section comprising a multiplicity of plasma-shells, each plasma-shell being connected to addressing and sustaining electrodes.

6. The invention of claim 5 wherein the electronic circuitry is SAS electronic architecture for addressing one section of plasma-shells while simultaneously sustaining another section of plasma-shells.

7. The invention of claim 1 wherein each plasma-shell is operated with a positive column gas discharge.

8. The invention of claim 1 wherein the display contains at least one elongated gas filled plasma-tube.

9. The invention of claim 8 wherein each plasma-tube is operated with a positive column gas discharge.

10. As an Article of manufacture, an AC gas discharge plasma display comprising a multiplicity of plasma-shells, the display being divided into at least two separate sections, each said section containing a multiplicity of said plasma-shells connected to addressing and sustaining electrodes, and electronic circuitry being connected to the electrodes for addressing the plasma-shells in one section of the display while simultaneously sustaining the plasma-shells in another section of the display.

11. The invention of claim 10 wherein the display includes means for the reduction of visual artifacts between different sections of the display.

12. The invention of claim 10 wherein each plasma-shell is a plasma-sphere, plasmas-disc, or plasma-dome.

13. The invention of claim 10 wherein the display contains at least one elongated gas filled plasma-tube.

14. The invention of claim 10 wherein a luminescent substance is located in close proximity to at least one plasma-shell, said luminescent substance emitting photons when excited by photons from a gas discharge within a plasma-shell.

15. In the operation of a gas discharge display comprising a multiplicity of pixels, each pixel being defined by a gas filled plasma-shell, the display being divided into two or more separate sections of plasma-shells, the improvement wherein one display section is addressed with electronic signals while another display section is simultaneously sustained and wherein artifacts are reduced between sections by gamma correction, error diffusion, and/or dithering.

16. The invention of claim 15 wherein each plasma-shell is a plasma-sphere, plasma-disc, or plasma-dome.

17. The invention of claim 15 wherein a luminescent substance is located in close proximity to at least one plasma-shell, said luminescent substance emitting photons when excited by photons from a gas discharge within a plasma-shell.

18. The invention of claim 15 wherein each plasma-shell is operated with a positive column gas discharge.

19. The invention of claim 15 wherein the display contains at least one elongated gas tilled plasma-tube.

20. The invention of claim 19 wherein each plasma-tube is operated with a positive column gas discharge.

* * * * *